US008074404B2

(12) United States Patent
Zhang

(10) Patent No.: US 8,074,404 B2
(45) Date of Patent: Dec. 13, 2011

(54) DOUBLE-LAYER CABLE-STRUT ROOF SYSTEM

(75) Inventor: Li Zhang, Shanghai (CN)

(73) Assignee: Guibao Xue, Shanghai (CN)

( * ) Notice: Subject to any disclaimer, the term of this patent is extended or adjusted under 35 U.S.C. 154(b) by 140 days.

(21) Appl. No.: 12/294,925

(22) PCT Filed: Apr. 9, 2007

(86) PCT No.: PCT/CN2007/001150

§ 371 (c)(1),
(2), (4) Date: Apr. 28, 2010

(87) PCT Pub. No.: WO2007/115500

PCT Pub. Date: Oct. 18, 2007

(65) Prior Publication Data

US 2011/0162294 A1 Jul. 7, 2011

(30) Foreign Application Priority Data

Apr. 10, 2006 (CN) ..... 2006 1 0025558

(51) Int. Cl.
*E04B 7/14* (2006.01)

(52) U.S. Cl. ..... 52/83; 52/81.1; 52/223.13

(58) Field of Classification Search .... 52/83, 81.1–81.2, 52/223.8–223.12, 231, 643, 644, 633, 637–639, 52/654.3, 653.1
See application file for complete search history.

(56) References Cited

U.S. PATENT DOCUMENTS

| | | | | |
|---|---|---|---|---|
| 5,440,840 | A * | 8/1995 | Levy | 52/83 |
| 5,704,169 | A * | 1/1998 | Richter | 52/81.2 |
| 2006/0053726 | A1 * | 3/2006 | Reynolds et al. | 52/633 |

* cited by examiner

*Primary Examiner* — Brian Glessner
*Assistant Examiner* — Paola Agudelo

(57) ABSTRACT

A double-layer cable-strut roof system includes a central structure and an edge structure, a plurality of sets of first diagonal struts and a plurality of sets of second diagonal struts provided between the two structures, each set of first diagonal struts being arranged alternately with one set of second diagonal struts. Or a plurality of sets of diagonal struts are provided between the two structures, each of which including a plurality of first diagonal struts and second diagonal struts joined together node to node, each first diagonal strut being arranged alternately with one second diagonal strut The roof structure may cover the underlying building space in its entirety or, alternatively, may cover a perimeter portion of the building space leaving the center area uncovered, or may be constituted by a plurality of structural units, which is adapted for spanning large areas devised for a wide range of building shapes.

25 Claims, 47 Drawing Sheets

DOUBLE-LAYER CABLE-STRUT ROOF SYSTEM

BACKGROUND OF THE PRESENT INVENTION

1. Field of Invention

The present invention relates to a cable-strut roof system, and more particularly to a double-layer cable-strut roof system which comprises a plurality of tension members and compression members arranged in a new manner, and is adapted for exhibition venue, stadium, theater, airport terminal, railway station and other large-span space structure buildings.

2. Description of Related Arts

In recent decades, various types of large-span roof systems are widely used, such as reticulated shell structure constructed of rigid structural members. Reticulated shell structures, however, exhibit high ratio of rise to span, in order to obtain necessary stiffness and good work performance. The structure is heavyweight and more expensive to build with increasing in span.

Lightweight roof structures have gradually been applied with the development of new materials and new technology, such as application of prestressed flexible structures like cable network structures, tensioned membrane structures, and so on. The prestressed system has no stiffness and uncertain shape prior to prestressing. Here flexible system means each internal node thereof receives only flexible tension members such as cables or membranes without rigid compression members. As regards the way forces are transmitted through the system, the internal system is in continuous tension. This structure has the advantages of large-span and beautiful shape, while the internal system must rely on an external supporting system. Only when boundary nodes of the internal system are anchored to an external boundary and a lower supporting system, with their strong support and by prestressing flexible elements, the internal system could be a structure undertaking external loading. The boundary and lower supporting system can only be designed firmly for equilibrating internal tension forces, leading to high cost and a complicated prestressed structure. Another disadvantage of flexible structures involves too large structural deformation under loading.

A self-stressed structure, called a tensegrity structure, has been presented to optimize internal forces distribution, which is a system in a self-stress state and in a stable self-equilibrated state comprising a continuous set of tension members and a discontinuous or continuous set of compression members. Here the self-stress state means that tension members and compression members are connected together with predefined topological relations. During the assembling process, the interaction between members, and the interaction between members and nodes lead to the tension of the tension members and the compression of the compression members. The internal forces of the system do not result from external effect and do not rely on an external supporting system, so that the internal forces are self-stresses. This also indicates that the tensegrity system is an independent system and is essentially different from prestressed system. The stability and self-equilibrium indicate the initial mechanical state of the system, before any loading, even gravitational. The self-equilibrium of the system is in a self-stress state. The stability means that the system is capable of re-establishing its equilibrium position after a perturbation. The stability of the system is closely related to rational topological relations between the two sets of tension members and compression members of the system. Tensegrity structure is also essentially different from traditional structures (such as grid structure, reticulated shell structure, etc.) in members' arrangement and the way forces are distributed within it. It is a system in continuous tension and discontinuous or continuous compression. This mechanical mechanism is a very rational form pursued by engineers in engineering field. But, so far, with the exception of some tensegrity sculpture having the characteristics of art, tensegrity structure hasn't been used in buildings of large-span roof system in the field of construction.

A circular cable truss dome is illustrated in U.S. Pat. No. 4,736,553 to Geiger who has been inspired by the tensegrity principle. This cable truss dome is constructed of a plurality of upper tensioned members, diagonal tensioned members and vertical rigid struts in compression. The upper tensioned members and diagonal tensioned members are radially oriented and attached to an inner tension ring or to the vertical rigid struts, or to an outer compression ring. Several tensioned hoops are affixed to the lower end of the compression members. A flexible membrane is placed on top of the vertical rigid struts to form a roof for the delineated area. This structure is different from cable network structure and prestressed flexible membrane structure as it is constructed of flexible elements such as cables with stiff elements such as compression struts. Combination of stiff elements and flexible elements increase in the stiffness of the structure and overcome a disadvantage of a flexible structure resulting in large deformation under loading. The cable dome structure comprising a plurality of discontinuous compression members is also different from traditional structures such as reticulated shell structure in which compression necessitates the continuity of forces transmission, which efficiently use the tensile strength of cable, tremendously reducing the overall steel consumption and being lightweight. However, this structure does not use triangulated construction, so the structure lacks a degree of lateral stability at the top radial chord of the dome. Furthermore, due to the radial arrangement of the vertical strut, this structure is only appropriate for use in circular plane.

U.S. Pat. Nos. 5,259,158, 5,355,641 and 5,440,840 to Levy utilize a triangulated arrangement of tension members and compression members to construct a roof structure, which are based on the cable dome designed by Geiger. As a result the structure is more appropriate for an oval roof structure. The triangulated roof structure designed by Levy also includes a central truss positioned along the major axis of the oval. Furthermore, the structure can also be designed as triangulated cable dome with annular roof or retractable roof.

Compared with the Geiger system, the Levy system has higher stiffness and structural stability. Both the Geiger system and the Levy system are adapted for spanning large areas for supporting a roof such as arena or stadium for Olympic game. The two systems improved the traditional way that forces are transmitted, which are applicable to span large areas with attractive design. For example, the average steel weight of the Georgia Dome roof designed according to the Levy patent is about 30 kg/m$^2$. The forces transmitted through the two systems are similar, both from the inside such as the innermost tension hoop (or center truss), the vertical struts and cables (including upper cables, tension hoops and diagonal cables) to the outside such as outer upper cables and diagonal cables and finally to the outer compression ring. The outer compression ring receives tension forces resulting from the inner cables of the inner system affixed to it in all directions. The system is built by assembling all components and anchoring the outermost upper cables and diagonal cables to the outer compression ring. Generally, compared with the inner components, the compression ring made of reinforced concrete or prestressed concrete has a huge size. Moreover the compression ring has been a part of the whole building, it is very difficult to identify cable dome structure as an independent structure. As the Geiger system and the Levy system rely on a robust supporting system around and down below, they are still in the scope of prestressed structures and will inevitably have disadvantages of prestressed structure. Furthermore, such domes are costly to build due to node fabrication, construction and installation.

Because of the drawbacks highlighted above of the rigid reticulated shell structure, prestressed flexible structure and cable dome structure, it is necessary to develop a new type of large-span lightweight space structure, which can be simple to construct and have considerable economic benefits, also have innovative features with unique visual effects.

SUMMARY OF THE PRESENT INVENTION

An object of the present invention is to provide a double-layer cable-strut roof structure with rational forces transmission and without strong peripheral and lower supporting system by applying the tensegrity principle. The structure overcomes the disadvantages and shortcomings of the rigid reticulated shell structure, prestressed flexible structure and cable dome structure, having the advantages of tensegrity structure such as stable self equilibrium in the self-stress state, lightweight, independence, which can be applied in exhibition venue, stadium, theater, airport terminal, railway station and other large-span space structures. More specifically, the invention of the double-layer cable-strut roof system includes a central structure, an edge structure and an intermediate structure between them. The intermediate structure comprises a plurality of cable-strut units constructed of a plurality of tension members and compression members arranged in the predefined manner, in which tension members form a continuous network and compression members are discontinuous or continuous, each node receiving a plurality of tension members but only one or two compression members. In order to facilitate the description, each node receiving only one compression member within intermediate structure is named as a first system, otherwise as a second system.

The first system of the invention provides a double-layer cable-strut roof system, comprising: a continuous compression central structure; a continuous compression edge structure; a plurality of sets of first diagonal struts each of which positioning along a first direction and extending from the central structure to the edge structure; a plurality of sets of second diagonal struts each of which positioning along a second direction and extending from the central structure to the edge structure, wherein an inner node of each of the first diagonal struts is located on an upper layer and an outer node of each of the first diagonal strut is located on a lower layer; wherein an inner node of each of the second diagonal struts is located on the lower layer and an outer node of each of the second diagonal strut is located on the upper layer; wherein each of the sets of first diagonal struts comprises at least one first diagonal strut being spaced apart from each other, an innermost first diagonal strut being connected to the central structure and an outermost first diagonal strut being connected to the edge structure; wherein each of the sets of second diagonal struts comprises at least one second diagonal strut being spaced apart from each other, an innermost second diagonal strut being connected to the central structure and an outermost second diagonal strut being connected to the edge structure; wherein the first direction of each of the sets of first diagonal struts is spaced apart from the second direction of each of the sets of second diagonal struts between the central and the edge structures; wherein each of the sets of first diagonal struts is arranged alternately with one of the sets of second diagonal struts; and a plurality of cables interconnecting the first diagonal struts and the second diagonal struts and comprising: a first diagonal cable extending from the inner node of one of the first diagonal struts of one of the sets of first diagonal struts to the outer node of an inner adjacent one of the first diagonal struts of the same set; a second diagonal cable extending from the inner node of one of the second diagonal struts of one of the sets of second diagonal struts to the outer node of an inner adjacent one of the second diagonal struts of the same set; a first upper cable extending from the inner node of one of the first diagonal struts of one of the sets of first diagonal struts to the outer node of a transversely adjacent one of the second diagonal struts of an adjacent one of the sets of second diagonal struts; a second upper cable extending from the inner node of the first diagonal strut of the set of first diagonal struts to the outer node of one of the second diagonal struts located on outer adjacent side of the transversely adjacent second diagonal strut of the adjacent set of second diagonal struts; a first lower cable extending from the inner node of one of the second diagonal struts of one of the sets of second diagonal struts to the outer node of a transversely adjacent one of the first diagonal struts of an adjacent one of the sets of first diagonal struts; and a second lower cable extending from the inner node of the second diagonal strut of the set of second diagonal struts to the outer node of one of the first diagonal struts located on outer adjacent side of the transversely adjacent first diagonal strut of the adjacent set of first diagonal struts.

The way forces distributed within the first system is similar to that within tensegrity structure. The topology of the first system is predefined, each node receiving a plurality of cables and a single strut (a plurality of struts only in the central and edge structures). The first system is independently of the external supporting system, during assembling the components and the nodes, tension in cables and compression in struts being established by interaction of cables, struts and nodes. When each node is in equilibrium between tension and compression, which is in a self equilibrated state, all cables are in tension and all struts are in compression, the whole system being in a stable self equilibrated state. The roof system of the invention, placed on the ground or hoisted to a hanging position such as top of support columns or other lower supporting structure, is independent of the external around or down below supporting system and an independent structure after assembling. So the cable-strut roof system is a self-equilibrium system, which makes essential difference from prestressed system anchored to an external supporting system. Furthermore, the invention of the first system utilizes the way of transmitting forces of continuous tension and discontinuous compression, and efficiently uses the material characteristics of high tensile strength of cable and the compressive strength of strut to make the structure with rational forces distribution, low cost and lightweight. Thus, the invention of the double-layer cable-strut roof system overcomes the disadvantages and shortcomings of the above mentioned Geiger system and Levy system, which rely on a strong external supporting system, and has the advantages what tensegrity structure has. Moreover, as the topology of the system is predefined, the forces are evenly distributed within the system. Thus, as the span increases, the size of components has little change, so that steel consumption and dead weight of the structure substantially increase in proportion to the span to achieve a more large-span structure. Moreover, in practical projects, the less variety of nodes and component specifications can be used to allow for low cost and industrialization.

A preferred embodiment of the invention is that the edge structure and the central structure include an inward and an outward suspended cable-strut structure respectively. Both the inward and the outward suspended cable-strut structures comprise: a plurality of upper tension-compression rings, lower tension-compression rings, upper compression rings and lower compression rings, and a plurality of diagonal struts between the upper and the lower layers and continuous cables, etc.

The central and the edge structures may also utilize cable-strut structure so as to bring great convenience for fabrication and assembling of structural components. The diagonal struts, cables, compression rings and tension-compression rings are arranged in a manner with specified topology of structural components, so the values of compression in the compression rings, in the tension-compression rings and in the diagonal struts belong to a same level. The struts specifications used in the compression rings, in the tension-compression rings and in the diagonal struts could be same without huge reinforced concrete rings or prestressed concrete rings so as to greatly simplify the structural design and assembling construction to allow for low cost and industrialization.

The second system of the invention provides a double-layer cable-strut roof system comprising: a continuous compression central structure; a continuous compression edge structure; a plurality of sets of diagonal struts, each of which being located along a predefined direction and comprising at least one first diagonal strut or at least one second diagonal strut, extending from the central structure to the edge structure, wherein each of the first diagonal struts has an inner node located on an upper layer and an outer node located on a lower layer; wherein each of the second diagonal struts has an inner node located on the lower layer and an outer node located on the upper layer; wherein the first and the second diagonal struts of each of the sets are arranged alternately and joined together node-to-node, forming a zig-zag shape, an innermost first or second diagonal strut being connected to the central structure, an outermost first or second diagonal strut being connected to the edge structure; wherein each of the sets is spaced apart from each other and the sets are independent of one another between the central and the edge structures; wherein each of the first diagonal struts of the sets is transversally adjacent to the second diagonal strut of an adjacent one of the sets and vice versa; and a plurality of cables interconnecting the first diagonal struts and the second diagonal struts and comprising: a diagonal cable extending from the inner node of one of the first diagonal struts of one of the sets of diagonal struts to the inner node of a transversely adjacent one of the second diagonal struts of an adjacent one of the sets of diagonal struts; a diagonal cable extending from the outer node of the first diagonal strut of the set of diagonal struts to the outer node of the transversely adjacent second diagonal strut of the adjacent set of diagonal struts; an upper cable extending from the inner node of the first diagonal strut of the set to the outer node of the transversely adjacent second diagonal strut of the adjacent set of diagonal struts; an upper cable extending from the inner node of the first diagonal strut of the set to the inner node of another one of the first diagonal struts whose outer node is connected to the inner node of the transversely adjacent second diagonal strut of the adjacent set of diagonal struts; a lower cable extending from the outer node of the first diagonal strut of the set of diagonal struts to the inner node of the transversely adjacent second diagonal strut of the adjacent set of diagonal struts; and a lower cable extending from the outer node of the first diagonal strut of the set of diagonal struts to the outer node of another one of the first diagonal struts whose inner node is connected to the outer node of the transversely adjacent second diagonal strut of the adjacent set of diagonal struts.

The above mentioned second system of the cable-strut roof system has the advantages not only of what the first system has, such as no need to be anchored to an external supporting system, self-stress, self-equilibrium, rational and uniform forces distribution within the system, etc., but also of lower cost. As the second system is in continuous tension and continuous compression, which is different from the first system that is in continuous tension and discontinuous compression so as to have a lower steel consumption compared with the first system.

Better is that the edge structure and the central structure include a plurality of upper and lower compression rings.

Compared with the central and the edge structures comprising cable-strut structures in the first system, the central and the edge structures in the second system comprise a simpler structure to bring a greater convenience for structural designing, component fabrication, construction and installation.

Moreover, the structural members in the roof system are arranged regularly whether in the first or in the second system, so the structural units are arranged flexibly and designed to be adaptable for various building shapes according to building function, which are applicable to exhibition venue, stadium, theater, airport terminal building, railway station and other large-span space buildings. The upper and the lower layers of the roof system could be flat or curve which is in a regular or irregular form, or is a convex surface or a concave surface. The plan projection of the roof system may be an oval curve, a circular curve or other non-circular curve, may also be a quadrangular curve or other polygonal curve. The roof system may be closed entirely, may have a large opening intermediately or may comprise a plurality of structural units. The distance between the upper and the lower layers is adjustable due to the diagonal struts provided between the upper and the lower layers. The ratio of rise to span can be adjusted flexibly according to design required. The upper layer could be parallel or unparallel to the lower layer.

These and other objectives, features, and advantages of the present invention will become apparent from the following detailed description, the accompanying drawings, and the appended claims.

DETAILED DESCRIPTION OF THE PREFERRED EMBODIMENT

Referring to FIGS. 1 to 23, a double-layer cable-strut roof system according to preferred embodiments of the present invention is illustrated.

Figure 1:
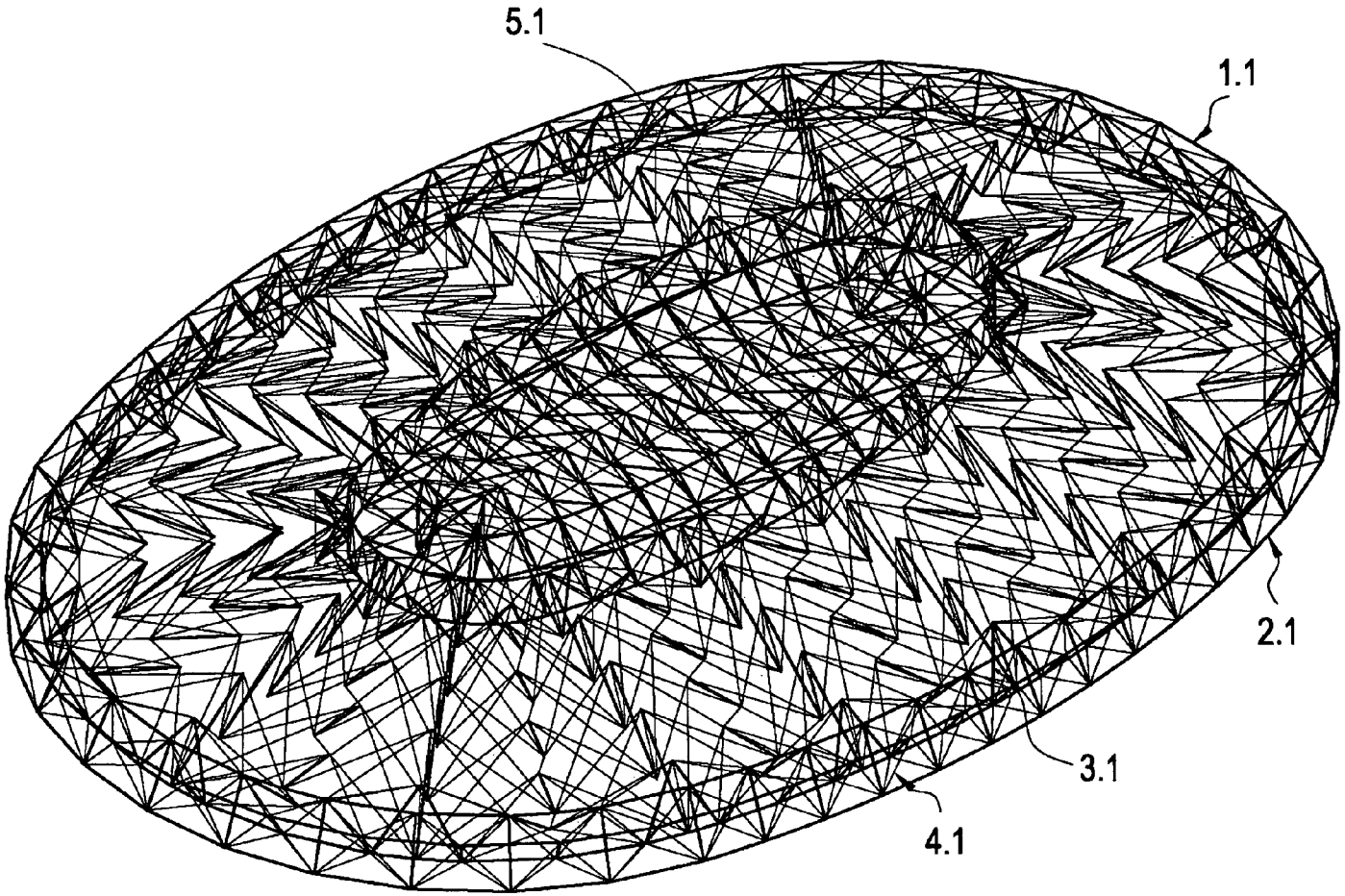
FIG. 1 is a perspective view of a double-layer cable-strut roof system projecting in plan a substantially oval curve according to a preferred embodiment of the first system of the present invention.

FIG. 1 is a perspective view of a double-layer cable-strut roof system in accordance with one embodiment of the first system of the present invention. It is to be noted that structural members are arranged regularly in the system but people skilled in the art will understand after reading the description that the system can be constructed in various manners with irregular structural members' arrangement. An upper layer 1.1 of the roof system may cover entirely or partially roofing materials space as required. In this embodiment of the present invention, a lower layer 2.1 is parallel to the upper layer 1.1, but they may not parallel each other. A plurality of diagonal struts 3.1, diagonal cables 4.1 and vertical cables 5.1 are arranged between the upper and the lower layers. Plan views of the upper and the lower layers, layout drawings of the diagonal struts 3.1, the diagonal cables 4.1 and the vertical cables 5.1 are shown in FIGS. 2 to 6, in which struts are shown with thick continuous lines and cables are shown with thin continuous lines.

Figure 2:
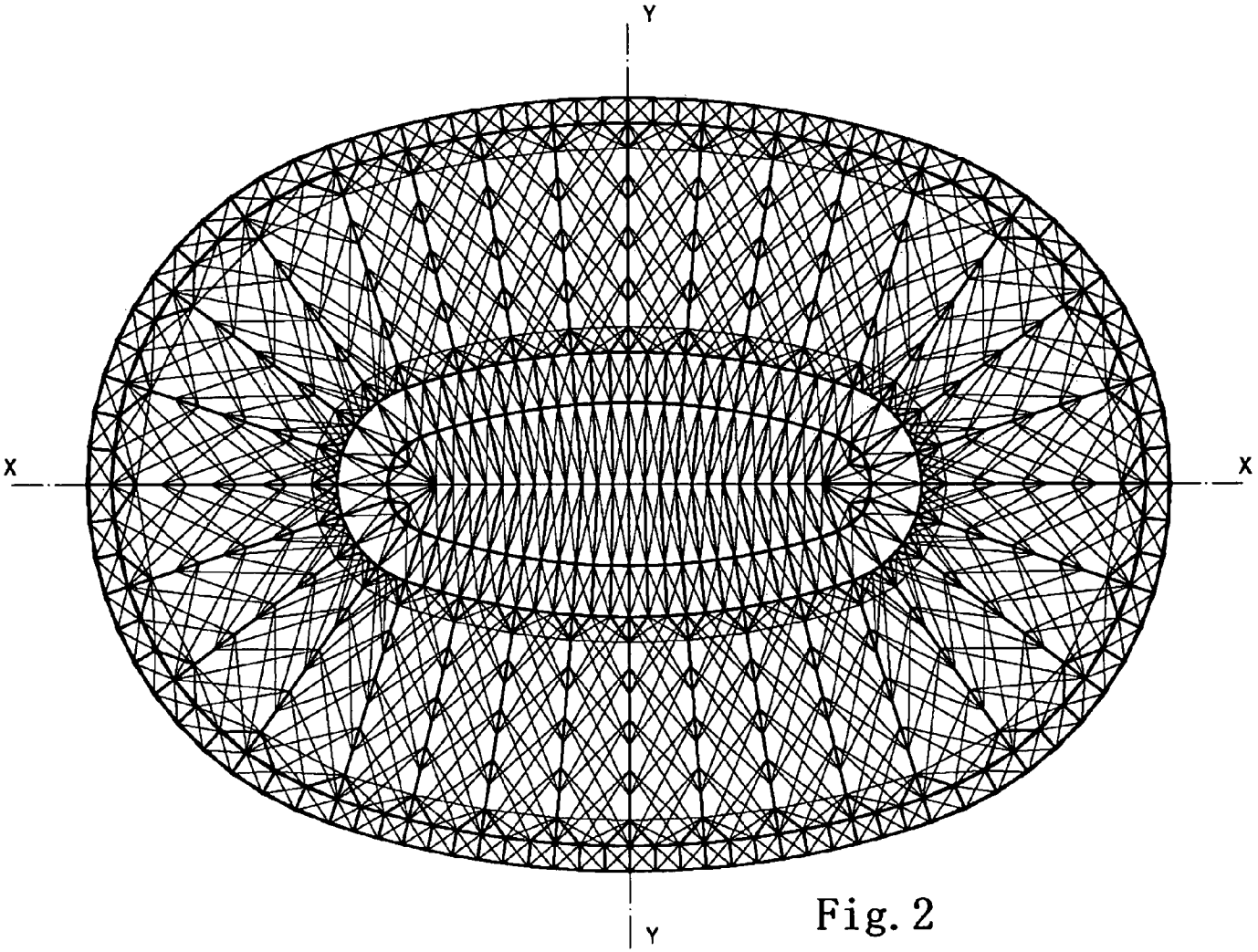
FIG. 2 is a top plan view of the roof system of FIG. 1.

FIG. 2 is a plan view of the roof system of FIG. 1. A plane projection of the roof system is a substantially closed oval curve having a major axis X-X and a minor axis Y-Y.

Figure 3:
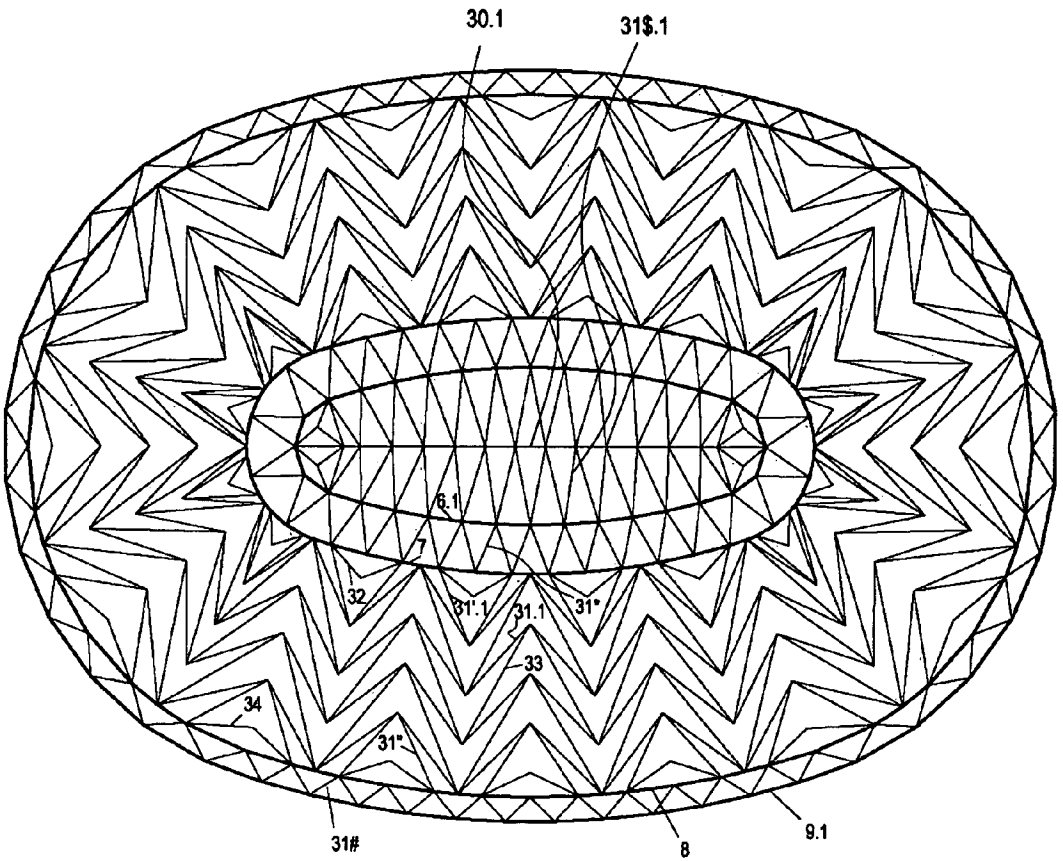
FIG. 3 is a top plan view depicting an upper layer of the roof system of FIG. 1.

FIG. 3 is a top plan view depicting the upper layer 1.1 of the roof system of FIG. 1, wherein all reticulated lines are cables except an inner compression ring 6.1, tension-compression rings 7, 8 and an outer compression ring 9.1.

Figure 4:
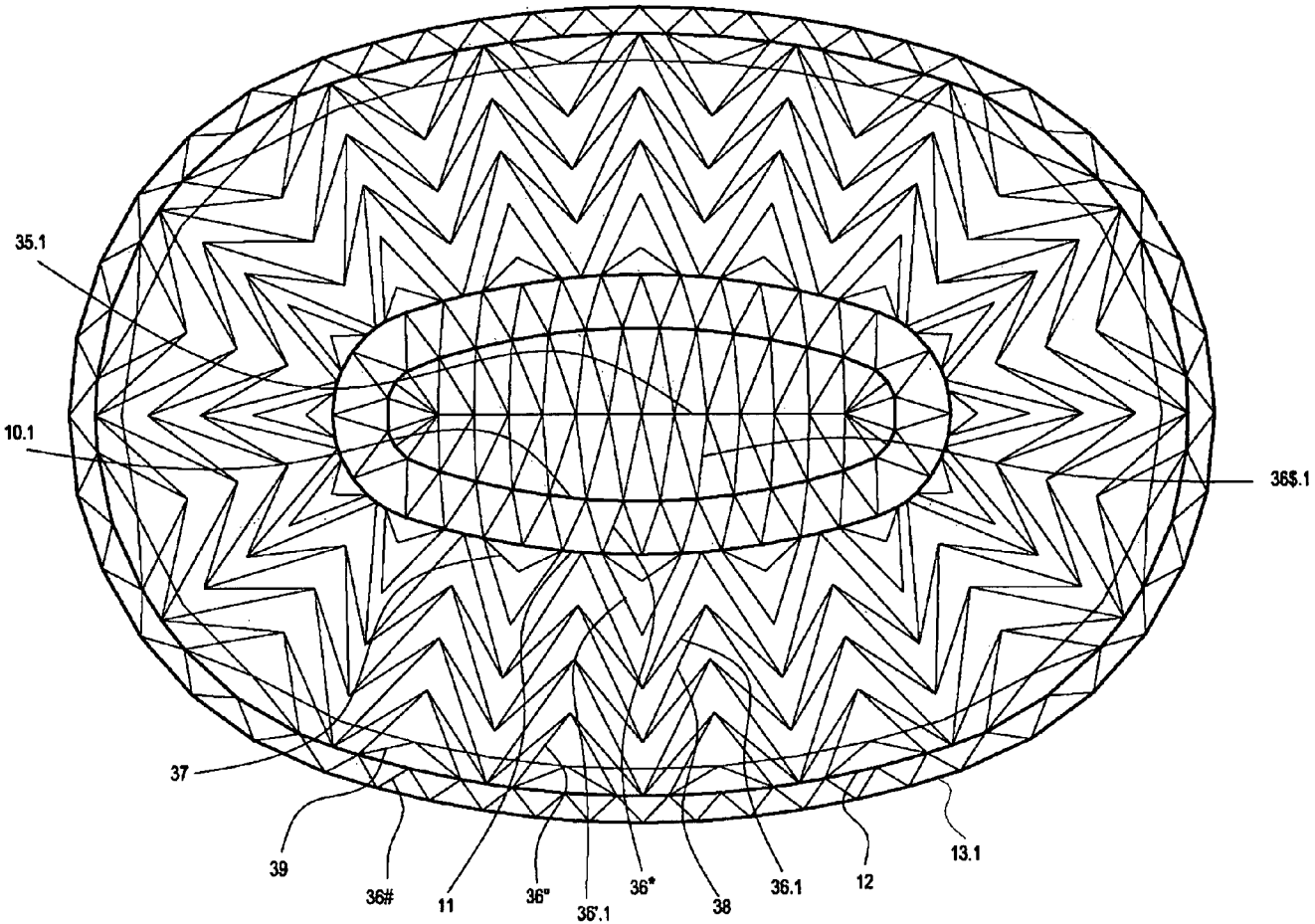
FIG. 4 is a top plan view depicting a lower layer of the roof system of FIG. 1.

FIG. 4 is a top plan view depicting the lower layer 2.1 of the roof system of FIG. 1, wherein all reticulated lines are cables except an inner compression ring 10.1, tension-compression rings 11, 12 and an outer compression ring 13.1.

Figure 5:
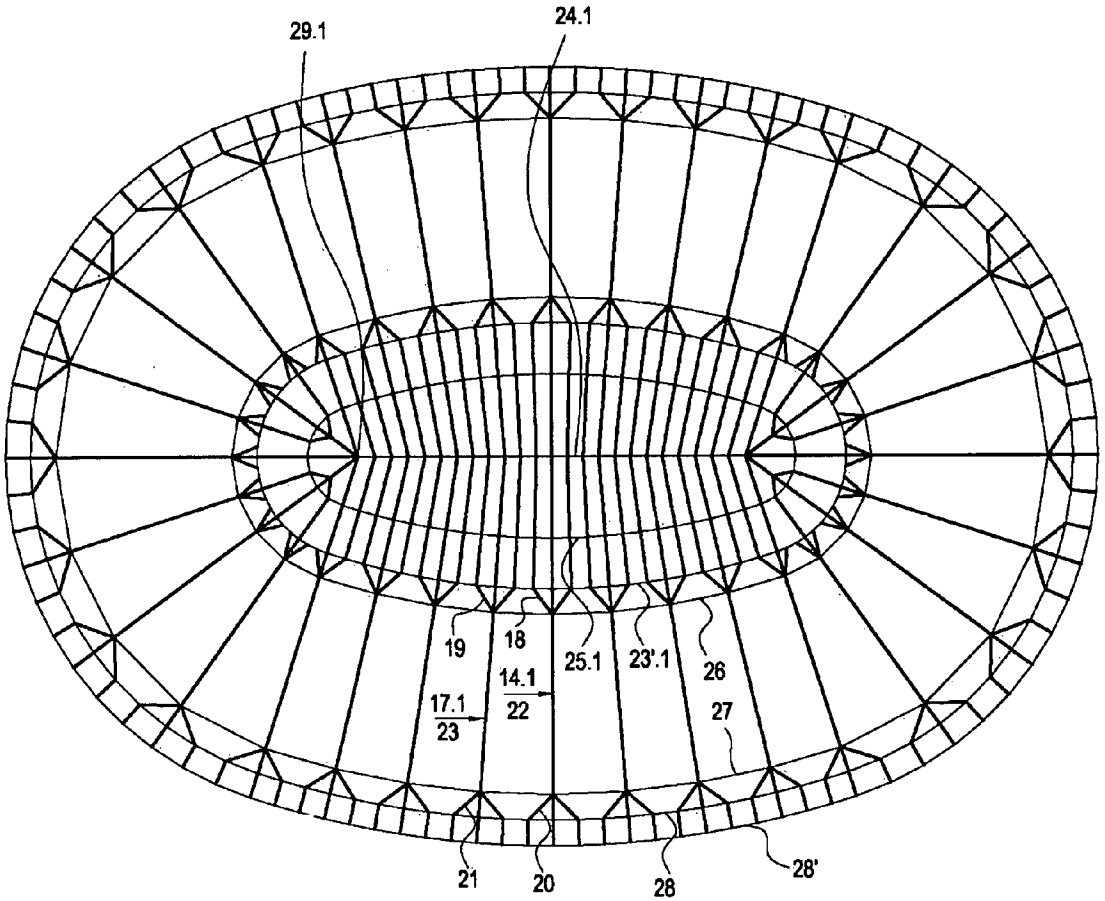
FIG. 5 is a top plan view depicting a plurality of diagonal cables and diagonal struts provided between the upper and the lower layers of the roof system of FIG. 1.

FIG. 5 is a top plan view depicting arrangement of the diagonal struts 3.1, the diagonal cables 4.1 and the vertical cables 5.1 in accordance with the roof system shown in FIG. 1.

Figure 6:
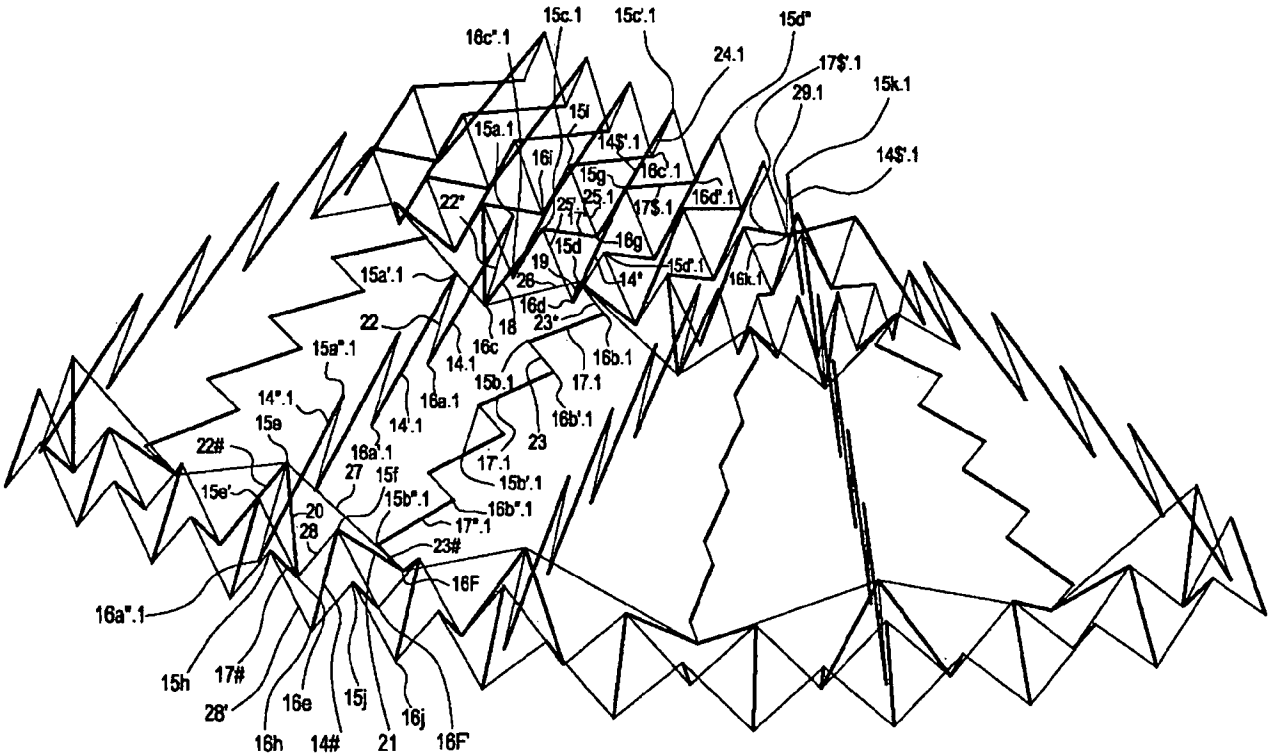
FIG. 6 is a perspective view depicting a quarter of the diagonal cables and the diagonal struts shown in FIG. 5.

FIG. 6 is a perspective view depicting arrangement of the diagonal struts 3.1, the diagonal cables 4.1 and the vertical cables 5.1 in accordance with the roof system shown in FIG. 1, wherein only a quarter of the cables and the struts are shown for symmetry of the system.

As shown in FIGS. 5 and 6, the upper and lower ends of the diagonal struts 3.1 define upper and lower points or nodes of the system. The diagonal struts 3.1 comprise: (1) a first diagonal strut 14.1 running radially and outwardly from an upper inner end defining an upper point or node 15*a*.1 to a lower outer end defining a lower point or node 16*a*.1; (2) a second diagonal strut 17.1 being spaced apart and arranged alternately with the first diagonal strut 14.1, running radially and inwardly from an upper outer end defining an upper point or node 15*b*.1 to a lower inner end defining a lower point or node 16*b*.1; (3) a first pair of inner diagonal struts 18 running outwardly from two inner nodes 15*c* connected to the outer nodes of two second diagonal struts 17* respectively to a lower common outer end defining a lower point or node 16*c*; (4) a second pair of inner diagonal struts 19 being spaced apart and arranged alternately with the first pair of inner diagonal struts 18 along a hoop direction, running inwardly from an upper common outer end defining an upper point or node 15*d* to two lower inner nodes 16*d* connected to the outer nodes of two first diagonal struts 14* respectively; (5) a first pair of outer diagonal struts 20 running outwardly from an upper common inner end defining an upper point or node 15*e* to two lower outer nodes 16*e* connected to the inner nodes of two second diagonal struts 17# respectively; (6) a second pair of outer diagonal struts 21 being spaced apart and arranged alternately with the first pair of outer diagonal struts 20 along a hoop direction, running inwardly from two upper outer nodes 15*f* connected to the inner nodes of two first diagonal struts 14# respectively to a lower common inner end defining a lower point or node 16*f*.

The diagonal cables 4.1 interconnect each diagonal strut 3.1 to an adjacent diagonal strut 3.1. The diagonal cables 4.1 comprise (FIGS. 5 and 6):

(1) first diagonal cables such as 22 each of which running radially and outwardly from the upper node of one diagonal strut to the lower node of an adjacent diagonal strut, which comprise: (a) a first diagonal cable 22* extending from upper inner node 15*a*.1 of the first diagonal strut 14.1 to lower outer node 16*c* of the adjacent first pair of inner struts 18; (b) a first diagonal cable 22 extending from an upper inner node 15*a*'.1 of a first diagonal strut 14'.1 to lower outer node 16*a*.1 of the adjacent first diagonal strut 14.1; (c) a first diagonal cable 22# extending from upper inner node 15*e* of the first pair of outer diagonal struts 20 to a lower outer node 16*a*".1 of an adjacent first diagonal strut 14".1.

(2) second diagonal cables such as 23 each of which being arranged transversely alternately with the first diagonal cable and running radially and inwardly from the upper node of one diagonal strut to the lower node of an adjacent diagonal strut, which comprise: (a) a second diagonal cable 23* extending from upper outer node 15*d* of the second pair of inner diagonal struts 19 to lower inner node 16*b*.1 of the adjacent second diagonal strut 17.1; (b) a second diagonal cable 23 extending from upper outer node 15*b*.1 of the second diagonal strut 17.1 to a lower inner node 16*b*'.1 of an adjacent second diagonal strut 17'.1; (c) a second diagonal cable 23# extending from an upper outer node 15*b*".1 of a second diagonal strut 17".1 to lower inner node 16*f* of the adjacent second pair of outer diagonal struts 21.

(3) a central diagonal cable 24.1 being positioned along the major axis of the oval and extending from an upper inner node 15*c*'.1 of a first diagonal strut 14$.1 to a lower inner node 16*d*'.1 of an adjacent second diagonal strut 17$.1, a plurality of which forming a zigzag shape.

(4) inner annular diagonal cables such as 25.1, a plurality of each of which forming a closed zigzag shape respectively, including: (a) an inner annular diagonal cable 25.1 extending from an upper common node 15*g* at which the second diagonal strut 17$.1 crosses the first diagonal strut 14* to a lower common node 16*g* at which the first diagonal strut 14$.1 adjacent to the second diagonal strut 17$.1 crosses the second diagonal strut 17*; (b) an inner annular diagonal cable 25'.1 extending from upper outer node 15*c* of the second diagonal strut 17* to lower outer node 16*d* of the adjacent first diagonal strut 14*.

(5) an inner annular diagonal cable 26 extending from upper outer node 15*d* of the second pair of inner diagonal struts 19 to lower outer node 16*c* of the adjacent first pair of inner diagonal struts 18, a plurality of which forming a zigzag shape.

(6) an outer annular diagonal cable 27 extending from upper inner node 15*e* of the first pair of outer diagonal struts 20 to lower inner node 16*f* of the adjacent second pair of outer diagonal struts 21, a plurality of which forming a zigzag shape.

(7) outer annular diagonal cables such as 28, a plurality of each of which forming a zigzag shape respectively, comprising: (a) an outer annular diagonal cable 28 extending from upper inner node 15*f* of the first diagonal strut 14# to lower inner node 16*e* of the adjacent second diagonal strut 17#; (b) an outer annular diagonal cable 28' extending from an upper outer node 15*h* of the second diagonal strut 17# to a lower outer node 16*h* of the adjacent first diagonal strut 14#.

As best shown in FIGS. 3 and 6, the compression rings and the tension-compression rings on the upper layer comprise: (1) the inner compression ring 6.1 comprising a plurality of struts joined together node-to-node, one of which running between two adjacent upper common nodes 15*g* and 15*i* at which the second diagonal strut 17$.1 crosses the first diagonal strut 14* respectively; (2) the tension-compression ring 7 comprising a plurality of struts and cables joined together node-to-node, one of which extending from upper inner node 15*a*.1 of the first diagonal strut 14.1 to the adjacent upper common node 15*c* at which one of the first pair of inner diagonal struts 18 crosses the second diagonal strut 17*, and another one of which running between two adjacent upper outer nodes 15*c* and 15*d*'.1 of two second diagonal struts 17*; (3) the tension-compression ring 8 comprising a plurality of struts and cables joined together node-to-node, one of which extending from upper outer node 15*b*".1 of the second diagonal strut 17".1 to the adjacent upper common node 15*f* at which one of the second pair of outer diagonal struts 21 crosses the first diagonal strut 14#, and another one of which running between two adjacent upper inner nodes 15*f* and 15*e*' of two first diagonal struts 14#; (4) the outer compression ring 9.1 comprising a plurality of struts joined together node-to-node, one of which running between two adjacent upper outer nodes 15*h* and 15*j* of two second diagonal struts 17#.

As shown in FIGS. 4 and 6, the compression rings and the tension-compression rings on the lower layer comprise: (1) the inner compression ring 10.1 comprising a plurality of struts joined together node-to-node, one of which running between two adjacent lower common nodes 16*g* and 16*i* at which the first diagonal strut 14$.1 crosses the second diagonal strut 17* respectively; (2) the tension-compression ring 11 comprising a plurality of struts and cables joined together node-to-node, one of which extending from lower inner node 16*b*.1 of the second diagonal strut 17.1 to the adjacent lower common node 16*d* at which one of the second pair of inner diagonal struts 19 crosses the first diagonal strut 14*, and another one of which running between two adjacent lower outer nodes 16*d* and 16*c*".1 of two first diagonal struts 14*; (3) the tension-compression ring 12 comprising a plurality of struts and cables joined together node-to-node, one of which extending from lower outer node 16*a*".1 of the first diagonal strut 14".1 to the adjacent lower common node 16*e* at which one of the first pair of outer diagonal struts 20 crosses the second diagonal strut 17#, and another one of which running between two adjacent lower inner nodes 16*e* and 16*f* of two second diagonal struts 17#; (4) the outer compression ring 13.1 comprising a plurality of struts joined together node-to-node, one of which running between two adjacent lower outer nodes 16*h* and 16*j* of two first diagonal struts 14#.

The vertical cables 5.1 run between the upper node of one diagonal strut and the lower node of an adjacent diagonal strut located on the major axis of the oval. As seen in FIGS. 5 and 6, these vertical cables include: a vertical cable 29.1 extending from an upper inner node 15*k*.1 of a first diagonal strut 14$'.1 to a lower inner node 16*k*.1 of an adjacent second diagonal strut 17$'.1.

A plurality of upper cables are provided for running between the upper node of one diagonal strut 3.1 and the upper node of an adjacent diagonal strut 3.1, forming a continuous network. As shown in FIGS. 3 and 6, these upper cables include:

(1) a central upper cable 30.1 running between two adjacent upper inner nodes 15*c*'.1 and 15*d*" of two first diagonal struts 14$.1 located on the major axis of the oval.

(2) upper cables such as 31, including: (a) an upper cable 31$.1 extending from upper inner node 15*c*'.1 of the first diagonal strut 14$.1 to upper outer node 15*g* (or 15*i*) of the adjacent second diagonal strut 17$.1; (b) an upper cable 31* extending from upper common node 15*g* at which the first diagonal strut 14* crosses the second diagonal strut 17$.1 to upper outer node 15*c* (or 15*d*'.1) of the adjacent second diagonal strut 17*; (c) an upper cable 31'.1 extending from upper outer node 15*b*.1 of the second diagonal strut 17.1 to upper inner node 15*c* of the proximal one of the adjacent first pair of inner diagonal struts 18; (d) an upper cable 31.1 extending from upper inner node 15*a*.1 of the first diagonal strut 14.1 to upper outer node 15*b*.1 of the adjacent second diagonal strut 17.1; (e) an upper cable 31" extending from an upper inner node 15*a*".1 of the first diagonal strut 14".1 to upper outer node 15*f* of the proximal one of the adjacent second pair of outer diagonal struts 21; (f) an upper cable 31# extending from upper inner node 15*f* of the first diagonal strut 14# to upper outer node 15*h* (or 15*j*) of the adjacent second diagonal strut 17#.

(3) an upper cable 32 extending from upper outer node 15*d* of the second pair of inner diagonal struts 19 to upper inner node 15*c* of the proximal one of the adjacent first pair of inner diagonal struts 18.

(4) an upper cable 33 extending from upper inner node 15*a*.1 of the first diagonal strut 14.1 to an upper outer node 15*b*'.1 of the second diagonal strut 17'.1 located on outer proximal side of the second diagonal strut 17.1 which is transversely adjacent to the first diagonal strut 14.1.

(5) an upper cable 34 extending from upper inner node 15*e* of the first pair of outer diagonal struts 20 to upper outer node 15*f* of the proximal one of the adjacent second pair of outer diagonal struts 21.

A plurality of lower cables are provided for running between the lower node of one diagonal strut 3.1 and the lower node of an adjacent diagonal strut 3.1, forming a continuous network. As shown in FIGS. 4 and 6, these lower cables include:

(1) a lower cable 35.1 running between two adjacent lower inner nodes 16*c*'.1 and 16*d*'.1 of two second diagonal struts 17$.1 located on the major axis of the oval.

(2) lower cables such as 36, including: (a) a lower cable 36$.1 extending from lower inner node 16*d*'.1 of the second diagonal strut 17$.1 to lower outer node 16*g* of the adjacent first diagonal strut 14$.1; (b) a lower cable 36* extending from lower common node 16*g* at which the second diagonal strut 17* crosses the first diagonal strut 14$.1 to lower outer node 16*d* (or 16*c*".1) of the adjacent first diagonal strut 14*; (c) a lower cable 36'.1 extending from lower outer node 16*a*.1 of the first diagonal strut 14.1 to lower inner node 16*d* of the proximal one of the adjacent second pair of inner diagonal struts 19; (d) a lower cable 36.1 extending from lower inner node 16*b*.1 of the second diagonal strut 17.1 to lower outer node 16*a*.1 of the adjacent first diagonal strut 14.1; (e) a lower cable 36" extending from a lower inner node 16*b*".1 of the second diagonal strut 17".1 to lower outer node 16*e* of the proximal one of the adjacent first pair of outer diagonal struts 20; (f) a lower cable 36# extending from lower inner node 16*e* of the second diagonal strut 17# to lower outer node 16*h* of the adjacent first diagonal strut 14#.

(3) a lower cable 37 extending from lower outer node 16*c* of the first pair of inner diagonal struts 18 to lower inner node 16*d* of the proximal one of the adjacent second pair of inner diagonal struts 19.

(4) a lower cable 38 extending from lower inner node 16*b*.1 of the second diagonal strut 17.1 to a lower outer node 16*a*'.1 of the first diagonal strut 14'.1 located on outer proximal side of the first diagonal strut 14.1 which is transversely adjacent to the second diagonal strut 17.1.

(5) a lower cable 39 extending from lower inner node 16*f* of the second pair of outer diagonal struts 21 to lower outer node 16*e* of the proximal one of the adjacent first pair of outer diagonal struts 20.

As thus far described, the first system of the invention comprises a continuous compression central structure and a continuous compression edge structure, a plurality of sets of diagonal struts being provided between them which are independent of one another within one set or in different sets, a plurality of cables being arranged for interconnecting each diagonal strut to an adjacent diagonal strut, forming a continuous network. In the above embodiment, (1) the central structure includes: the tension-compression rings 7 and 11, the pairs of inner diagonal struts 18 and 19, the first diagonal cables 22*, the second diagonal cables 23*, the annular diagonal cables 25'.1 and 26, the upper cables 31'.1, 32 and the lower cables 36'.1, 37. As this embodiment is a center closed structure, within the tension-compression rings 7 and 11 the central structure further includes the inner compression rings 6.1, 10.1, the first diagonal struts 14$.1 (14$'.1, 14*), the second diagonal struts 17$.1 (17$'.1, 17*), the central diagonal cables 24.1, the annular diagonal cables 25.1, the upper cables 30.1, 31$.1 (31*), the lower cables 35.1, 36$.1 (36*) and the vertical cables 29.1 therein; (2) the edge structure includes: the tension-compression rings 8 and 12, the compression rings 9.1 and 13.1, the pairs of outer diagonal struts 20 and 21, the first diagonal struts 14#, the second diagonal struts 17#, the first diagonal cables 22#, the second diagonal cables 23#, the annular diagonal cables 27 and 28 (28'), the upper cables 31" (31#), 34 and the lower cables 36" (36#) and 39; (3) between the central and the edge structures, a plurality of sets of the first diagonal struts 14.1 (14'.1, 14".1) and the second diagonal struts 17.1 (17'.1, 17".1) are oriented radially and independent of one another within one set or in different sets and interconnected by the first diagonal cables 22, the second diagonal cables 23, the upper cables 31.1, 33, and the lower cables 36.1, 38.

In the present embodiment, the central and the edge structures are constructed in a preferred manner, but those skilled in the art will recognize that other structure types may be used, for example, an annular truss or double layer annular structure constructed of rigid structural members or concrete. Preferably, as the topology of cables and struts is predefined, all nodes are in self-equilibriums and the edge structure only contributes to stabilizing those nodes located on it or be adjacent to it, which is different from Geiger system and Levy system relying on an outer compression ring generally made of reinforced concrete or prestressed concrete.

Figure 7:
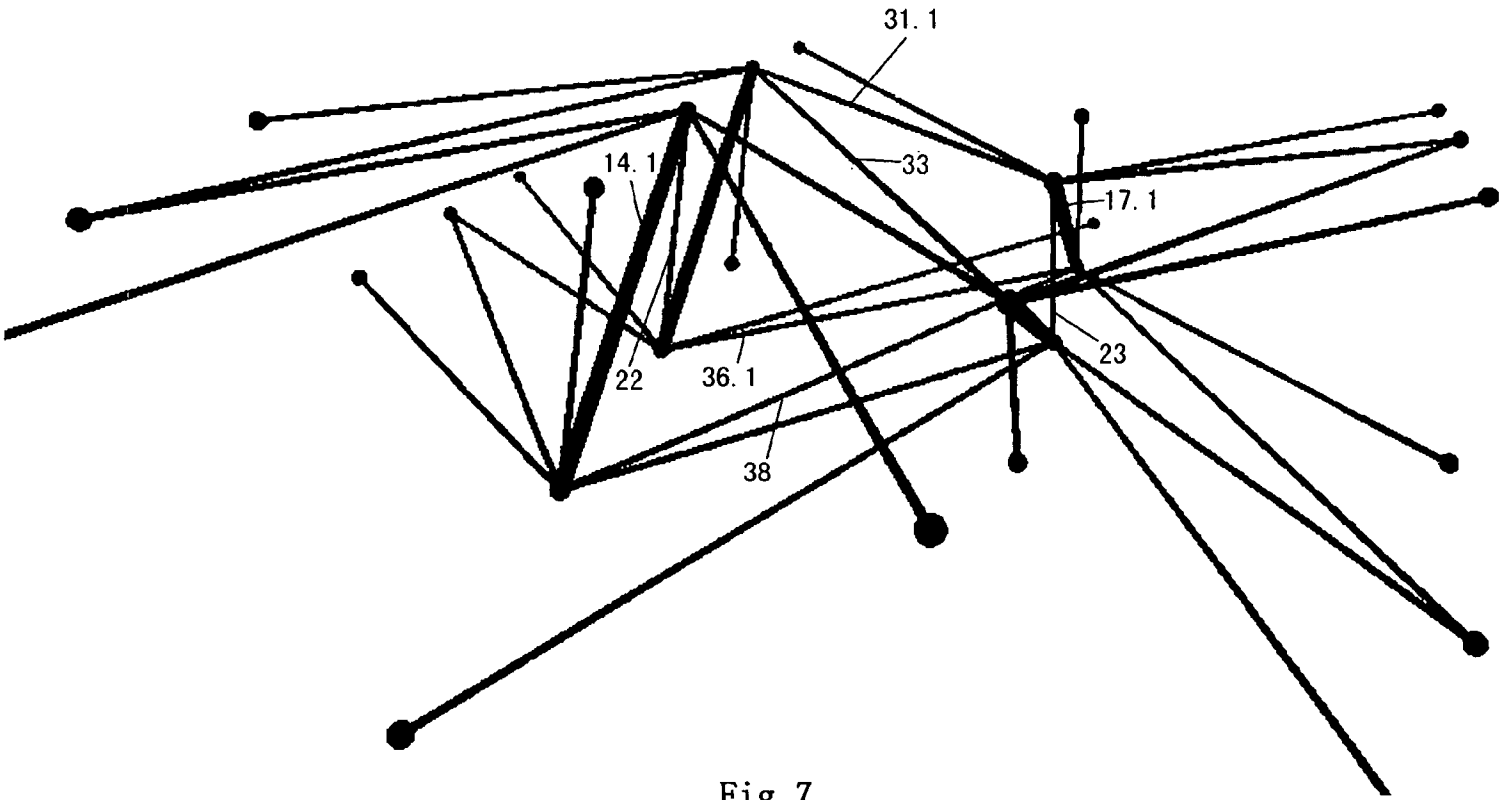
FIG. 7 illustrates one unit forming part of the intermediate structure of the roof system of FIG. 1.
Figure 8:
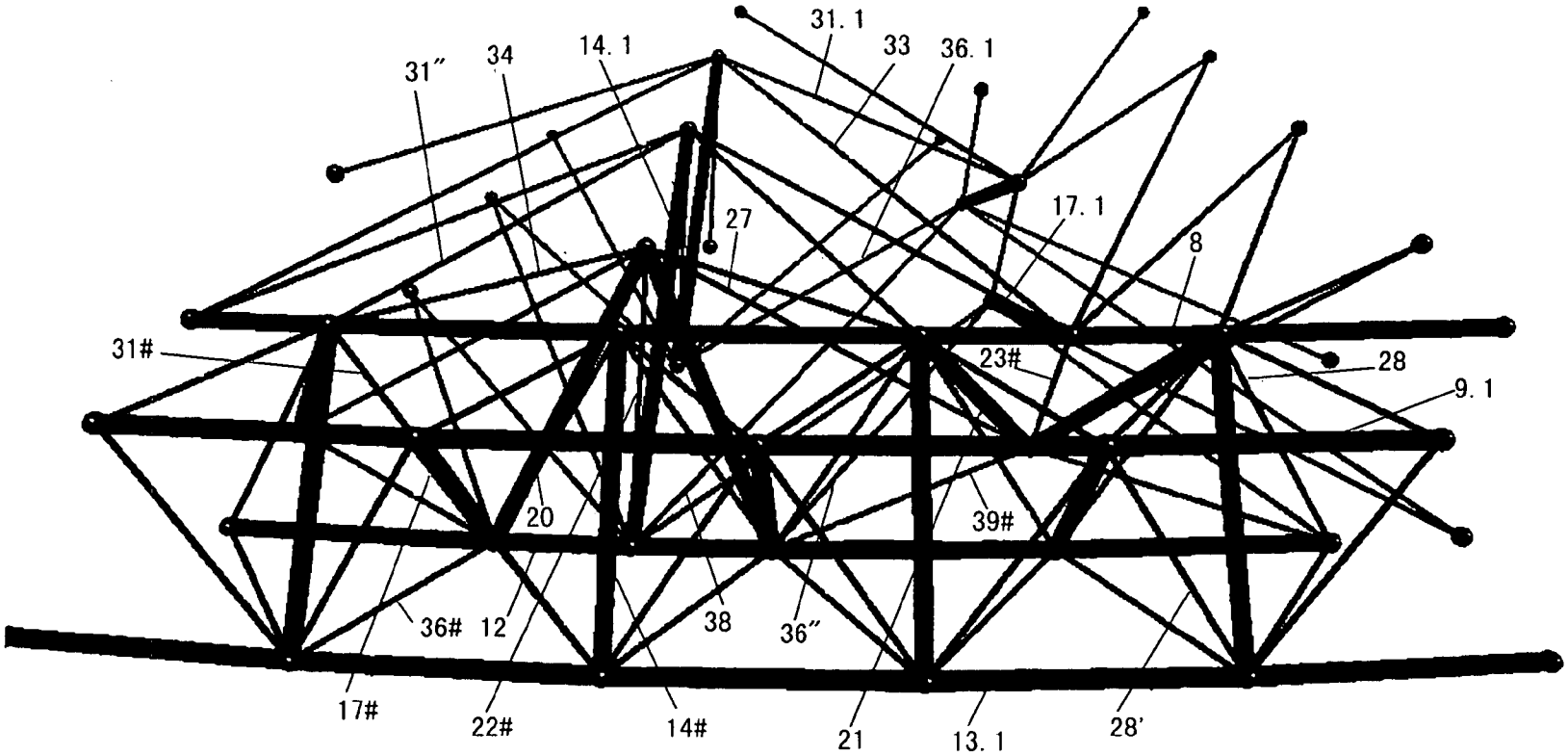
FIG. 8 illustrates one unit forming part of the intermediate structure and one unit forming part of the edge structure of the roof system of FIG. 1.
Figure 8A:
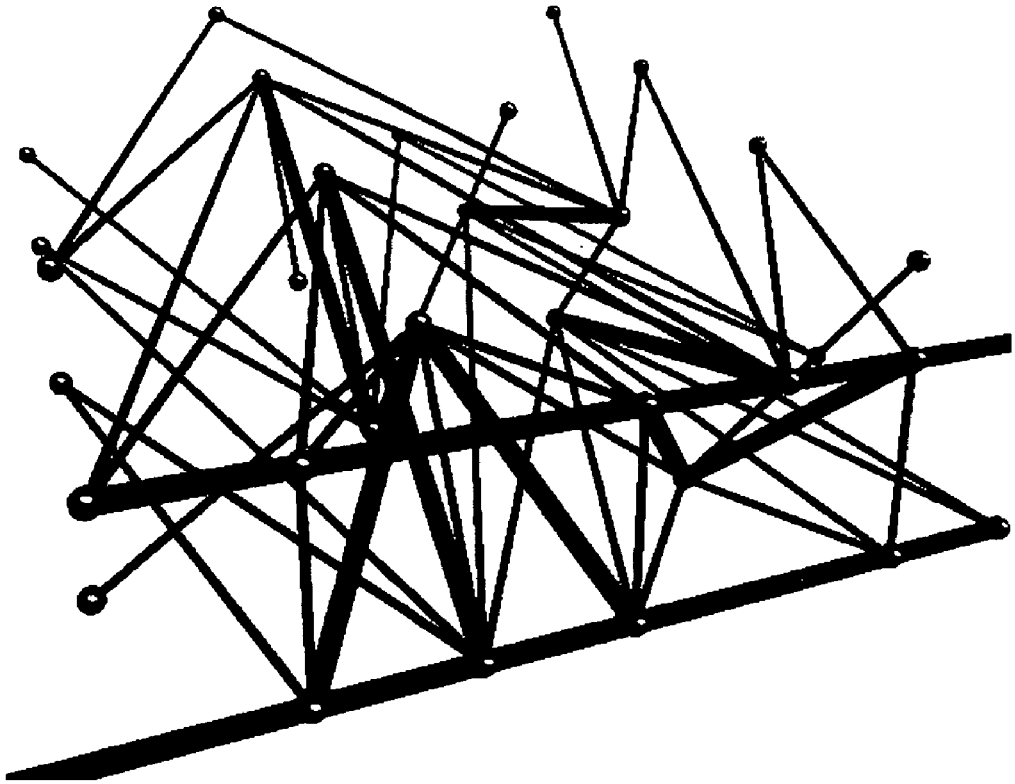
FIG. 8A illustrates one unit forming part of the intermediate structure of the roof system of FIG. 1 and another unit forming part of an edge structure.

FIG. 7 illustrates one unit forming part of the intermediate structure of the roof system of FIG. 1. FIG. 8 illustrates one unit forming part of the intermediate structure and one unit forming part of a boundary structure of the roof system of FIG. 1. The boundary structure could be the central structure or the edge structure, as the topologies of the both are similar and here the edge structure is regarded as an example. It is to be understood that the boundary structure shown in FIG. 8A could be an alternative one of FIG. 8 in which the edge structure does not comprise the first diagonal struts, the second diagonal struts, the tension-compression rings of FIG. 8 and wherein like reference numerals represent like elements. It is clear from above description that the roof system shown in FIG. 1 is devised by arrangement of a plurality of the above described units in a predefined manner. Those skilled in the art could recognize that other arrangements could be devised, for example, forming the following detailed described preferred embodiments of the invention. The intermediate structure could also be arranged not only between a central and an edge structures but also between two relative boundary structures.

Figure 9:
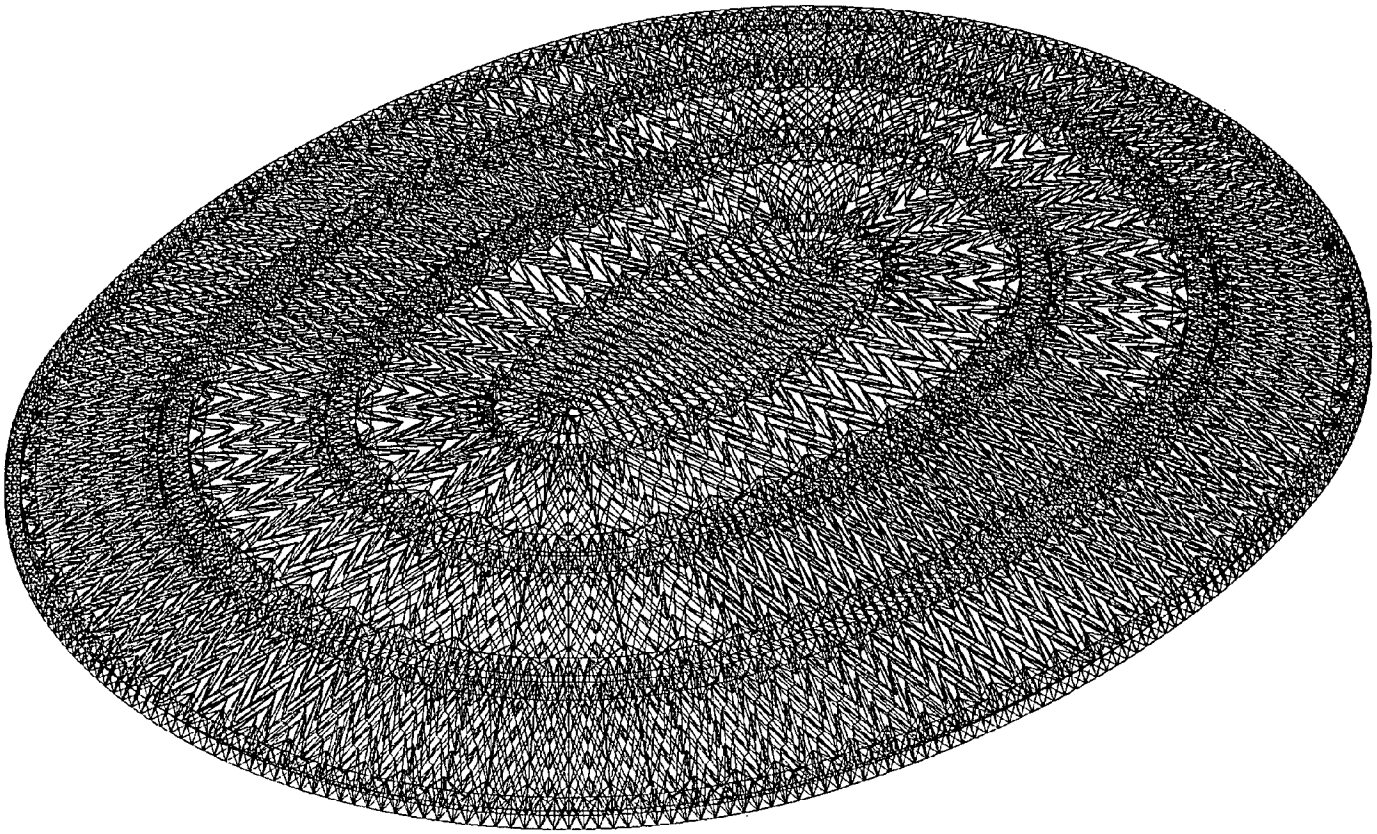
FIG. 9 is a perspective view of a double-layer cable-strut roof system projecting in plan another substantially oval curve in accordance with another embodiment of the first system of the present invention.

FIG. 9 is a perspective view of a double-layer cable-strut roof system projecting in plan another substantially closed oval curve in accordance with another embodiment of the first system of the present invention. The roof system includes: four compression rings and four tension-compression rings being positioned on an upper layer and on a lower layer at different locations respectively, a plurality of first diagonal struts, second diagonal struts, pairs of diagonal struts along a hoop direction, annular diagonal cables, first diagonal cables, second diagonal cables, upper cables and lower cables being arranged in the system. The present embodiment is constructed in a similar manner as that discussed in the previous embodiment shown in FIG. 1 but is adaptable for spanning large areas with more cables and struts provided, and two more upper and lower inner compression rings and two more upper and lower inner tension-compression rings being included accordingly in the system compared with the system shown in FIG. 1, also accordingly a plurality of first diagonal struts, second diagonal struts, pairs of diagonal struts along a hoop direction, annular diagonal cables, first diagonal cables, second diagonal cables, upper cables and lower cables being arranged in the system.

Figure 10:
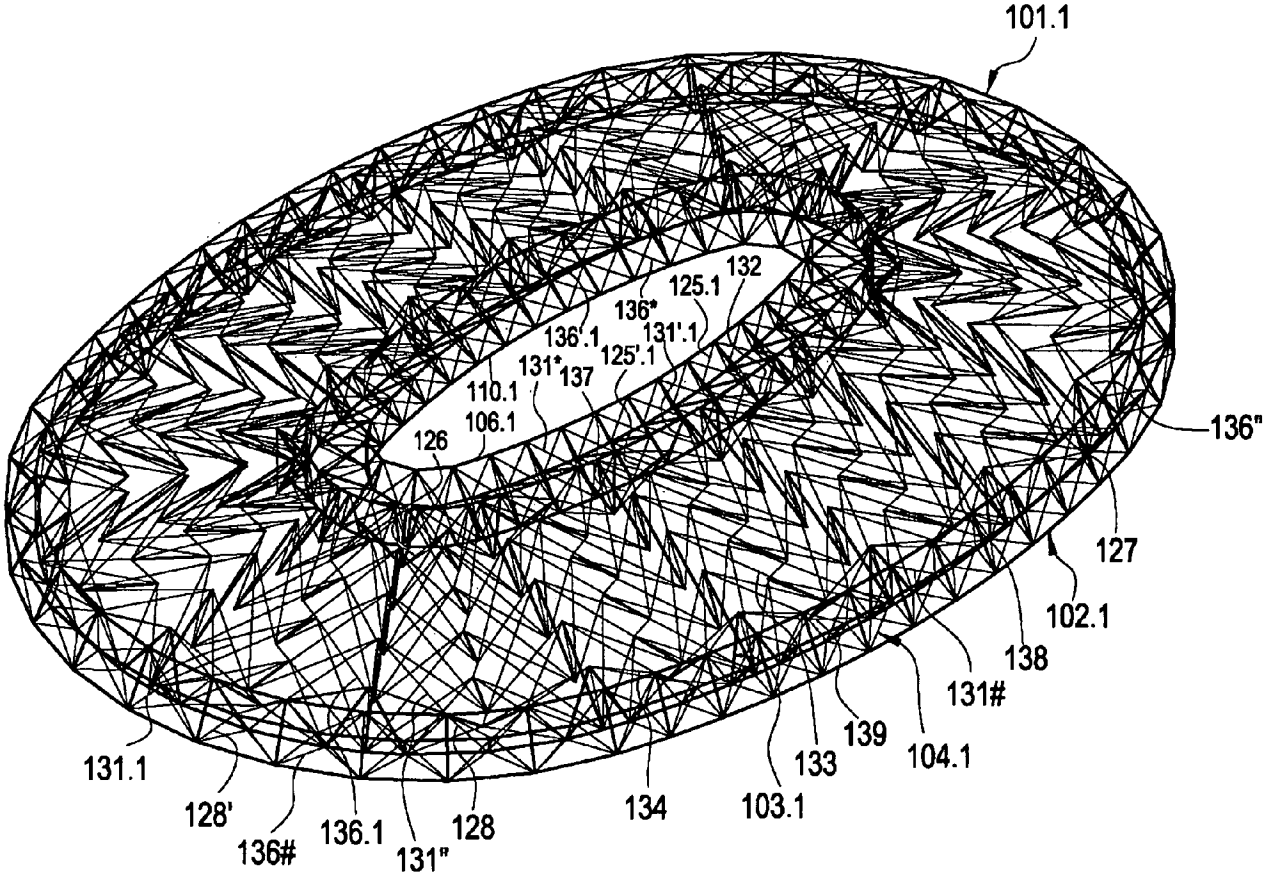
FIG. 10 is a perspective view of a double-layer cable-strut roof system projecting in plan a substantially oval annular curve in accordance with another embodiment of the first system of the present invention.

FIG. 10 is a perspective view of a double-layer cable-strut roof system projecting in plan a substantially oval annular curve in accordance with yet another embodiment of the first system of the present invention. Roofing materials overlay an upper layer 101.1 while leave the center portion of the system uncovered, which is well-suited for open-air stadium construction. Advantageously, it may be used to shelter stadium seating areas, while the event surface or playing field remains exposed.

Figure 11:
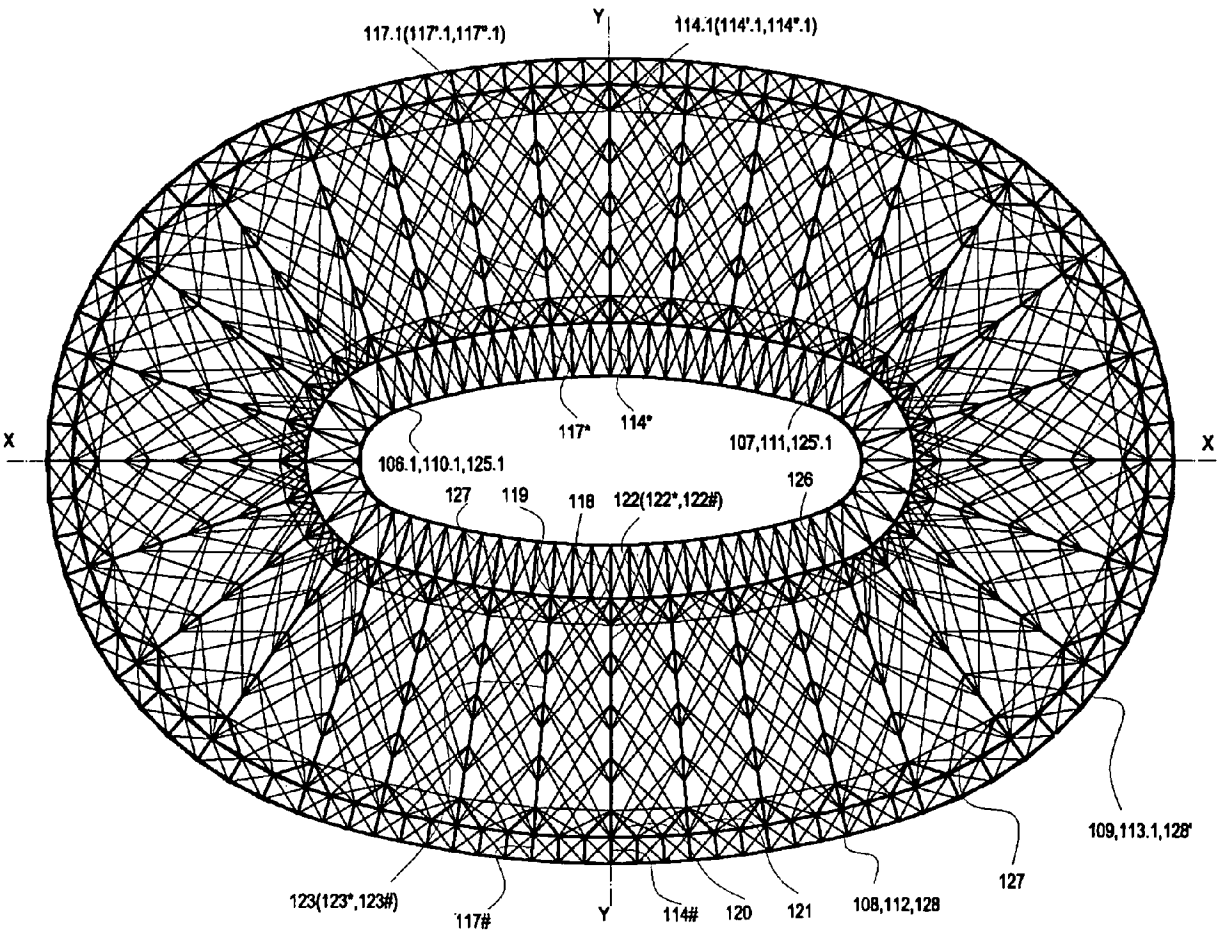
FIG. 11 is a top plan view of the roof system of FIG. 10.

FIG. 11 is a plan view of the roof system of FIG. 10, the substantially oval annular curve having a major axis X-X and a minor axis Y-Y. The erection of the present roof system is similar to that discussed in connection with FIG. 1 but this embodiment eliminates the need for cables and struts within the inner upper compression ring 6.1 and the inner lower compression ring 10.1, wherein like reference numerals represent like elements, and number 100 is added only in FIG. 1 so that the reference numeral 1.1 shown in FIG. 1 is a reference numeral 101.1 shown in FIG. 10.

As shown in FIG. 10, the roof system comprises the upper layer 101.1 and a lower layer 102.1 parallel to the upper layer 101.1. A plurality of diagonal struts 103.1 each having an upper end and a lower end define upper and lower points or nodes of the system respectively. As shown in FIG. 11, these diagonal struts include: a radially oriented first diagonal strut 114.1 (114'.1, 114".1, 114*, 114#), a radially oriented second diagonal strut 117.1 (117'.1, 117".1, 117*, 117#), pairs of inner diagonal struts 118 and 119 located along a hoop direction, pairs of outer diagonal struts 120 and 121 located along another hoop direction.

A plurality of diagonal cables 104.1 (FIG. 10) are provided for running between the upper node of one diagonal strut 103.1 and the lower node of an adjacent diagonal strut 103.1. These diagonal cables include (FIGS. 10 and 11): a radially oriented first diagonal cable 122 (122*, 122#), a radially oriented second diagonal cable 123 (123*, 123#), inner annular diagonal cables 125.1, 125'.1, 126 constructed along a different hoop direction respectively, outer annular diagonal cables 127, 128 (128') constructed along a different hoop direction respectively.

As best shown in FIGS. 10 and 11, the compression rings, tension-compression rings and cables on the upper layer 101.1 comprise: an inner compression ring 106.1 and an outer compression ring 109.1; tension-compression rings 107, 108 and a plurality of upper cables 131.1 (131*, 131'.1, 131", 131#), 132 through 134 being provided between the inner and outer compression rings. The compression rings, tension-compression rings and cables on the lower layer 102.1 comprise (FIGS. 10 and 11): an inner compression ring 110.1 and an outer compression ring 113.1; tension-compression rings 111, 112 (FIG. 11) and a plurality of lower cables 136.1 (136*, 136'.1, 136", 136#), 137-139 being provided between the inner and the outer compression rings.

All above elements is arranged in the manner shown in FIG. 1.

Figure 12:
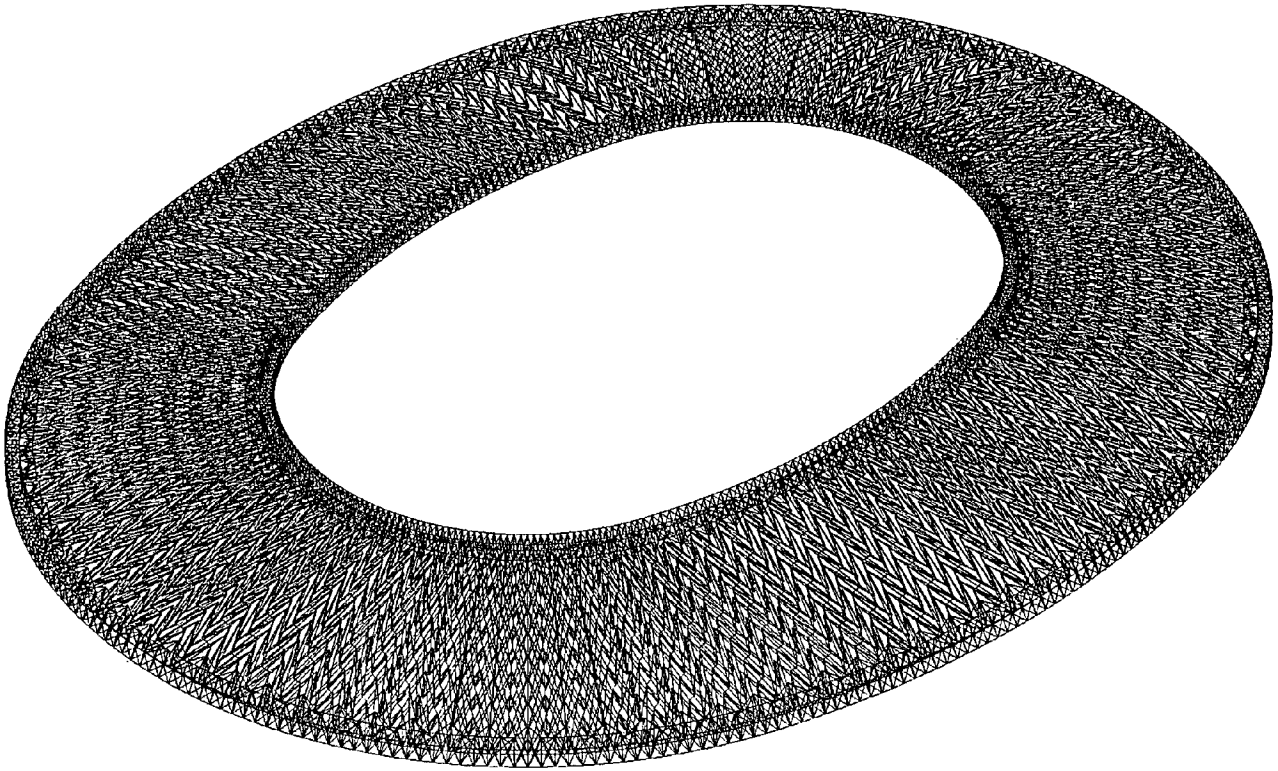
FIG. 12 is a perspective view of a double-layer cable-strut roof system projecting in plan another substantially oval annular curve in accordance with a further embodiment of the first system of the present invention.

FIG. 12 is a perspective view of a double-layer cable-strut roof system projecting in plan another substantially oval annular curve in accordance with yet a further embodiment of the first system of the present invention. The roof system is constructed in a similar manner shown in FIG. 10 with two compression rings and two tension-compression rings located on an upper layer and on a lower layer at different locations respectively, but this embodiment is adaptable for spanning large areas with more cables and struts provided accordingly.

Figure 13:
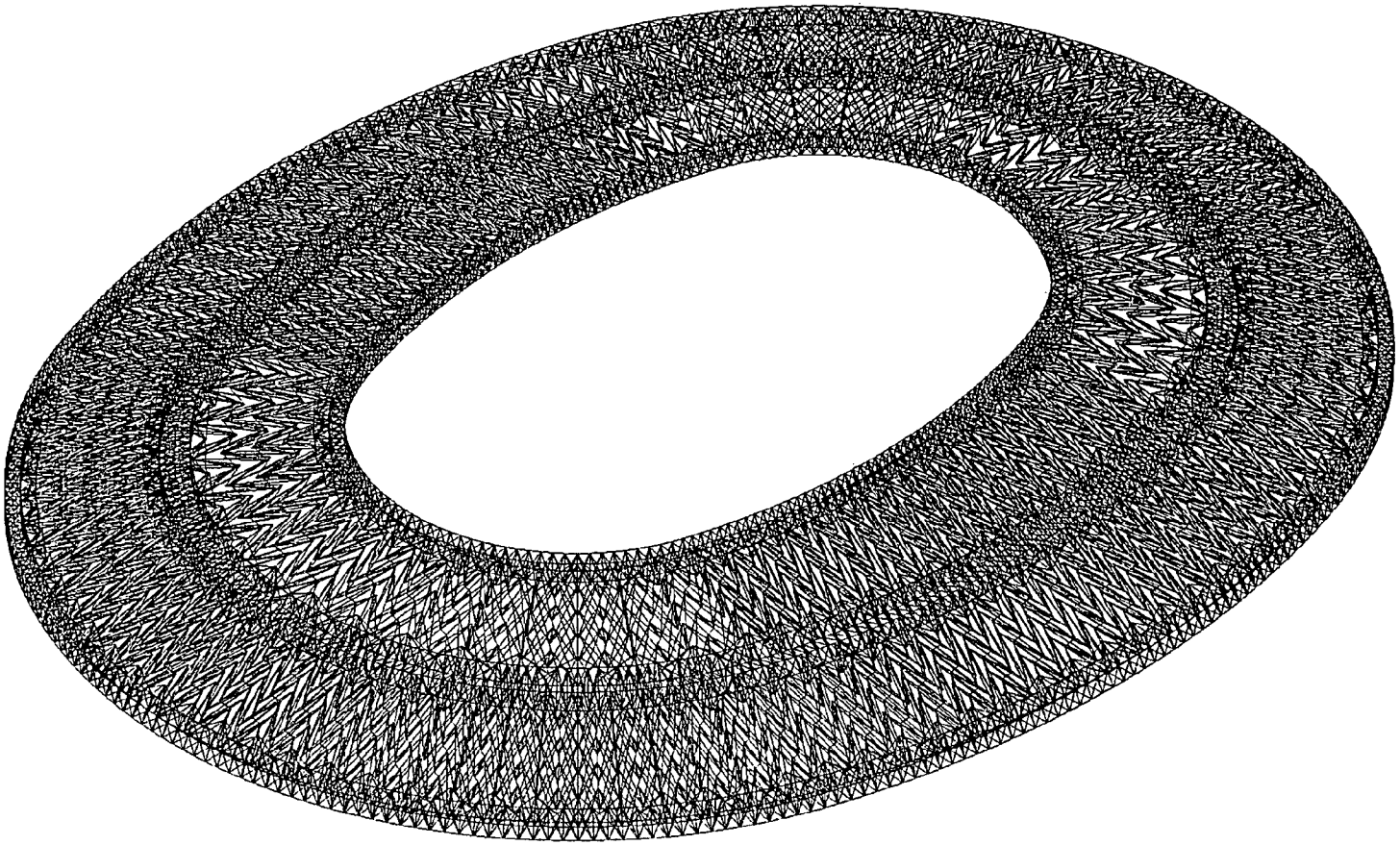
FIG. 13 is a perspective view of a double-layer cable-strut roof system projecting in plan yet another substantially oval annular curve in accordance with still a further embodiment of the first system of the present invention.

FIG. 13 is a perspective view of a double-layer cable-strut roof system projecting in plan yet another substantially oval annular curve in accordance with still a further embodiment of the first system of the present invention. The roof system includes three compression rings and three tension-compression rings located on an upper layer and on a lower layer at different locations respectively, which is constructed in a similar manner shown in FIG. 10 but is adaptable for spanning large areas with more cables and struts provided, one more upper and lower inner compression rings and one more upper and lower inner tension-compression rings being also included accordingly in the system compared with the system shown in FIG. 10, also accordingly a plurality of first diagonal struts, second diagonal struts, pairs of diagonal struts along different hoop directions, annular diagonal cables, first diagonal cables, second diagonal cables, upper cables and lower cables being arranged in the system.

Figure 14:
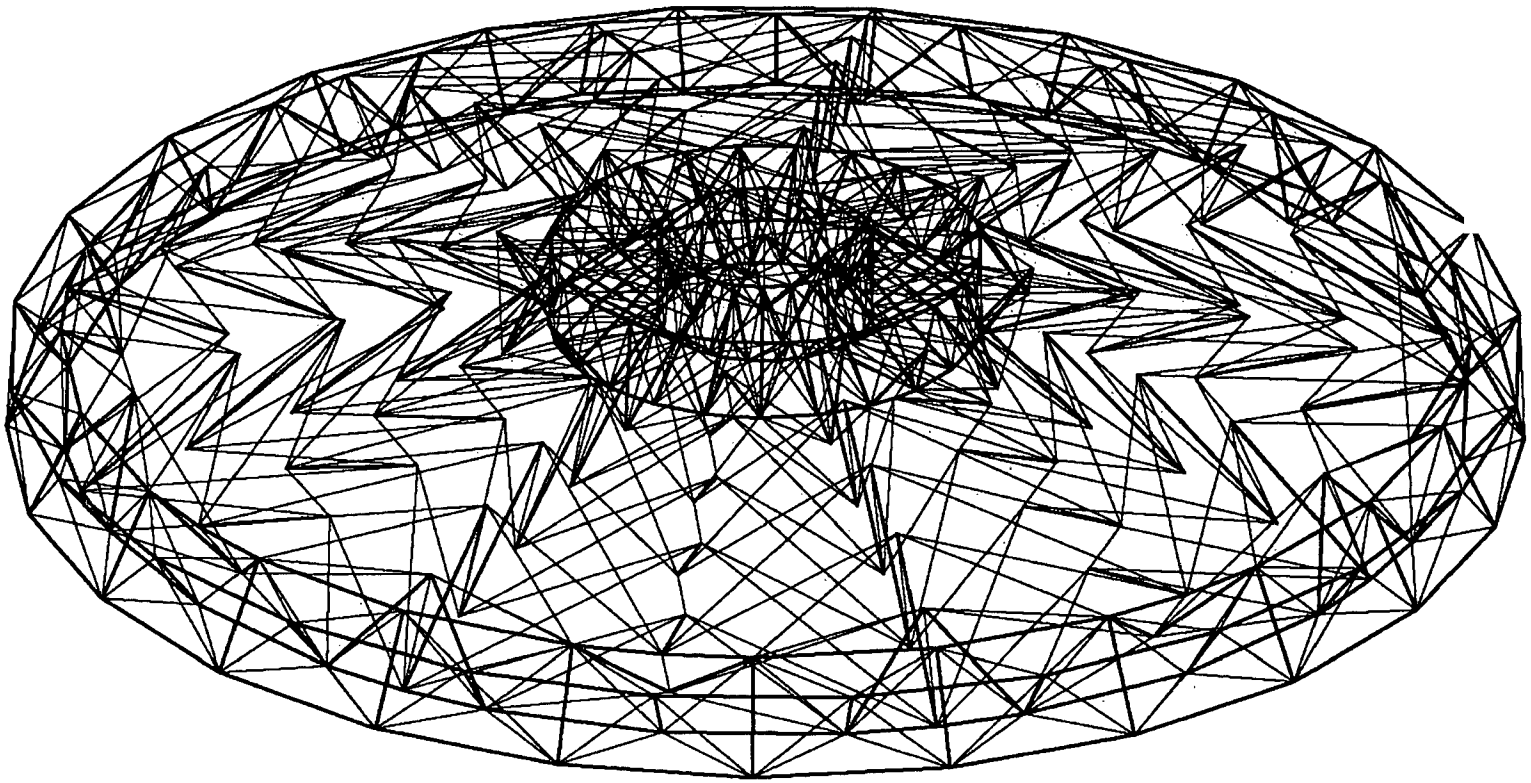
FIG. 14 is a perspective view of a double-layer cable-strut roof system projecting in plan a substantially circular curve in accordance with still a further embodiment of the first system of the present invention.
Figure 15:
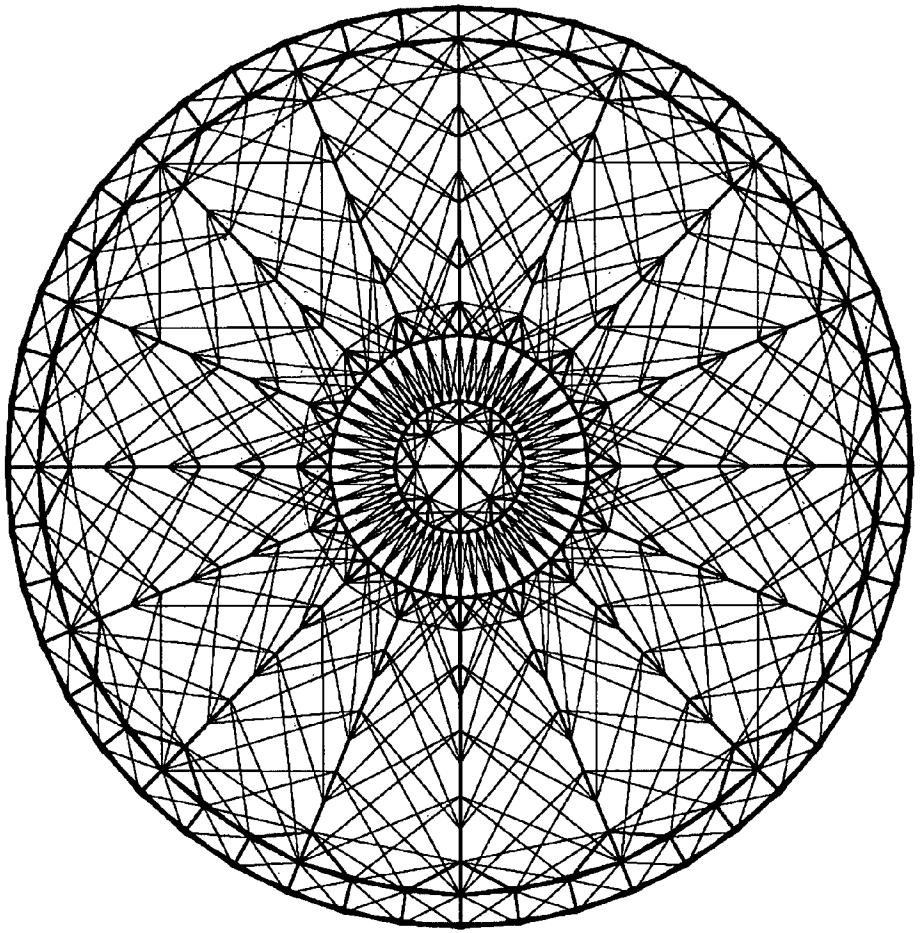
FIG. 15 is a top plan view of the roof system of FIG. 14.

FIG. 14 is a perspective view of a double-layer cable-strut roof system projecting in plan a substantially circular curve in accordance with still a further embodiment of the first system of the present invention. FIG. 15 is a top plan view of the roof system of FIG. 14. The roof system is constructed in a similar manner shown in FIG. 1, but the major axis and the minor axis of this embodiment are equal in length and only one central vertical compression cable is provided within the inner compression rings.

Figure 16:
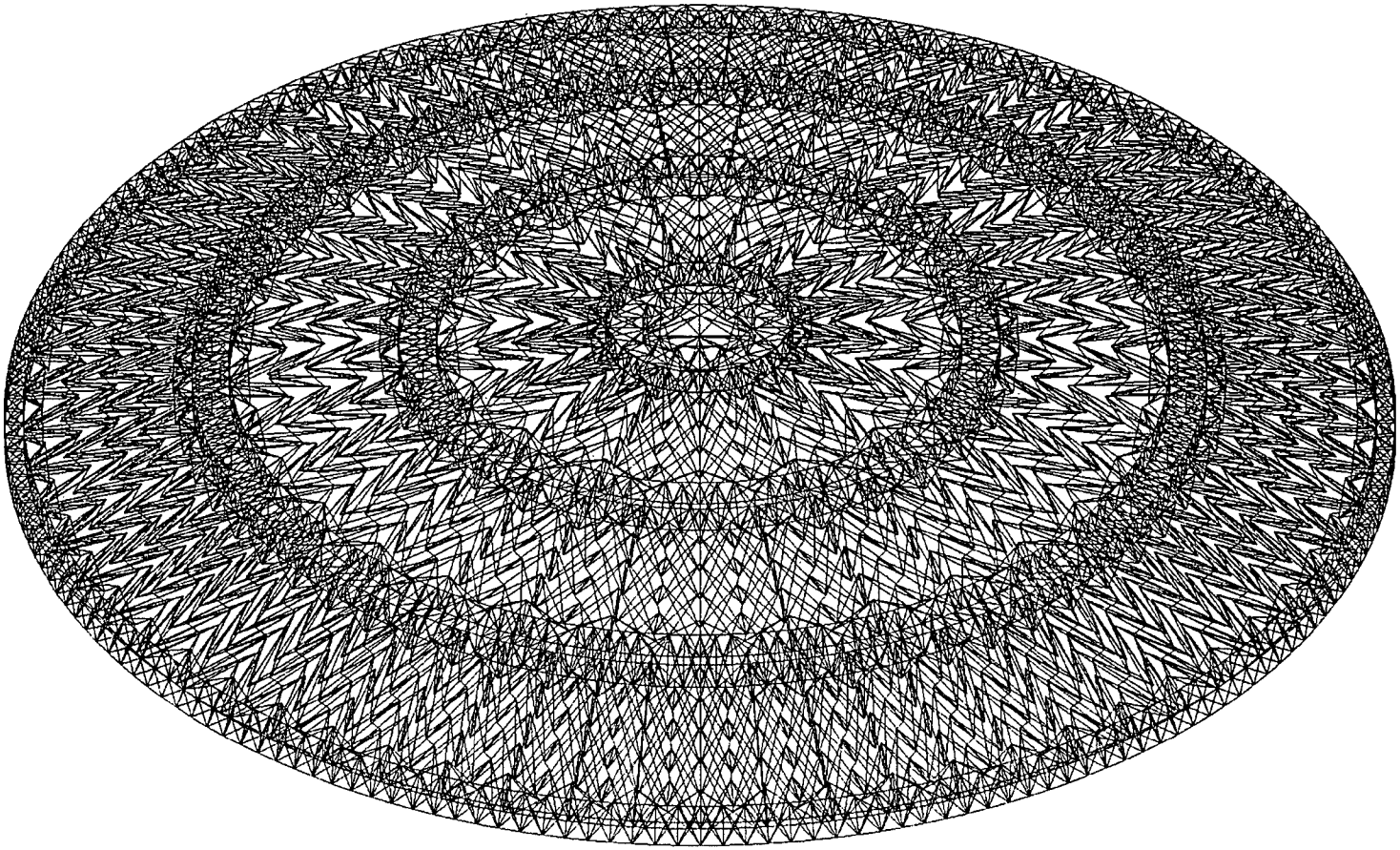
FIG. 16 is a perspective view of a double-layer cable-strut roof system projecting in plan another substantially circular curve in accordance with still a further embodiment of the first system of the present invention.

FIG. 16 is a perspective view of a double-layer cable-strut roof system projecting in plan another substantially circular curve in accordance with still a further embodiment of the first system of the present invention. The roof system includes four compression rings and four tension-compression rings located on an upper layer and on a lower layer at different locations respectively, which is constructed in a similar manner shown in FIG. 14 but is adaptable for spanning large areas with more cables and struts provided, two more upper and lower inner compression rings and two more upper and lower inner tension-compression rings being included accordingly in the system compared with the system shown in FIG. 14, also accordingly a plurality of first diagonal struts, second diagonal struts, pairs of diagonal struts along different hoop directions, annular diagonal cables, first diagonal cables, second diagonal cables, upper cables and lower cables being arranged in the system.

Figure 17:
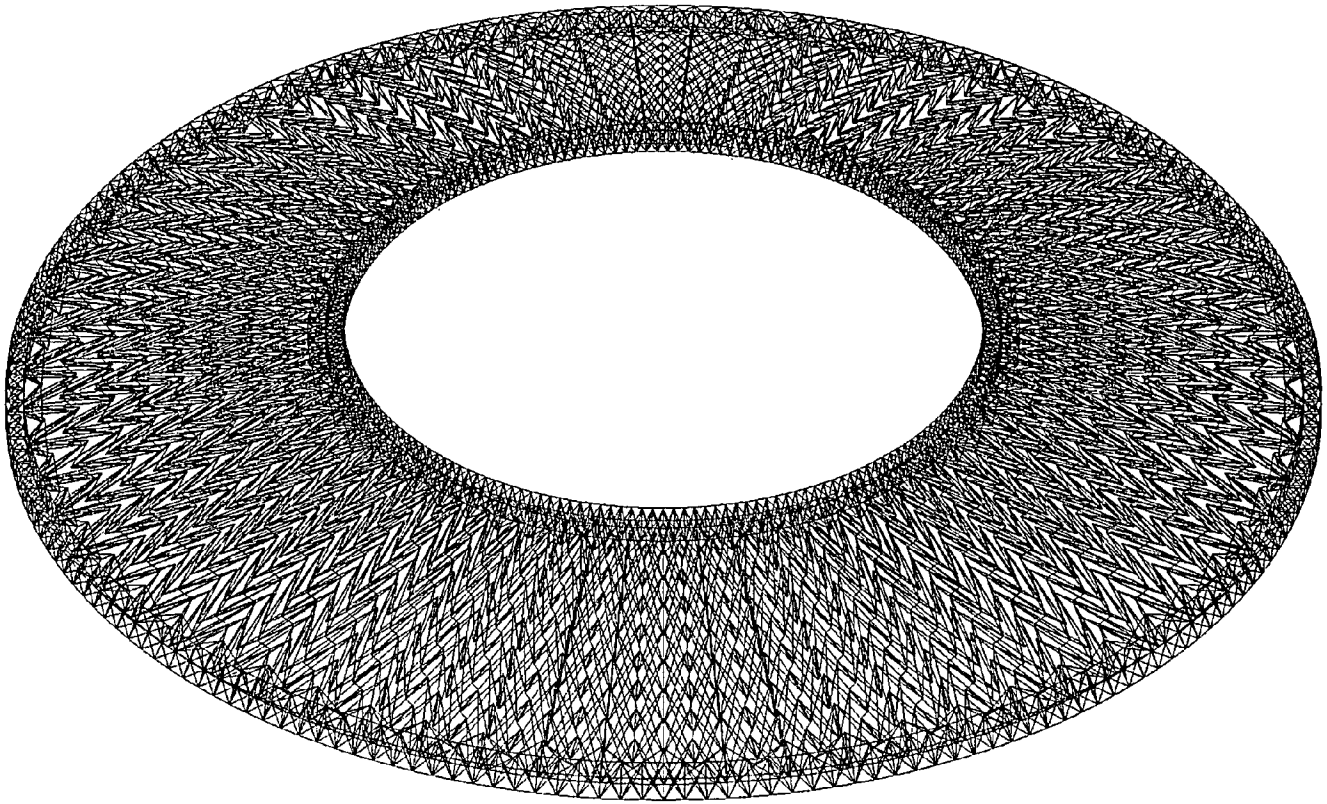
FIG. 17 is a perspective view of a double-layer cable-strut roof system projecting in plan a substantially circular annular curve in accordance with still a further embodiment of the first system of the present invention.

FIG. 17 is a perspective view of a double-layer cable-strut roof system projecting in plan a substantially circular annular curve in accordance with still a further embodiment of the first system of the present invention. The roof system is constructed in a similar manner shown in FIG. 12 but the major axis and the minor axis of this embodiment are equal in length.

Figure 18:
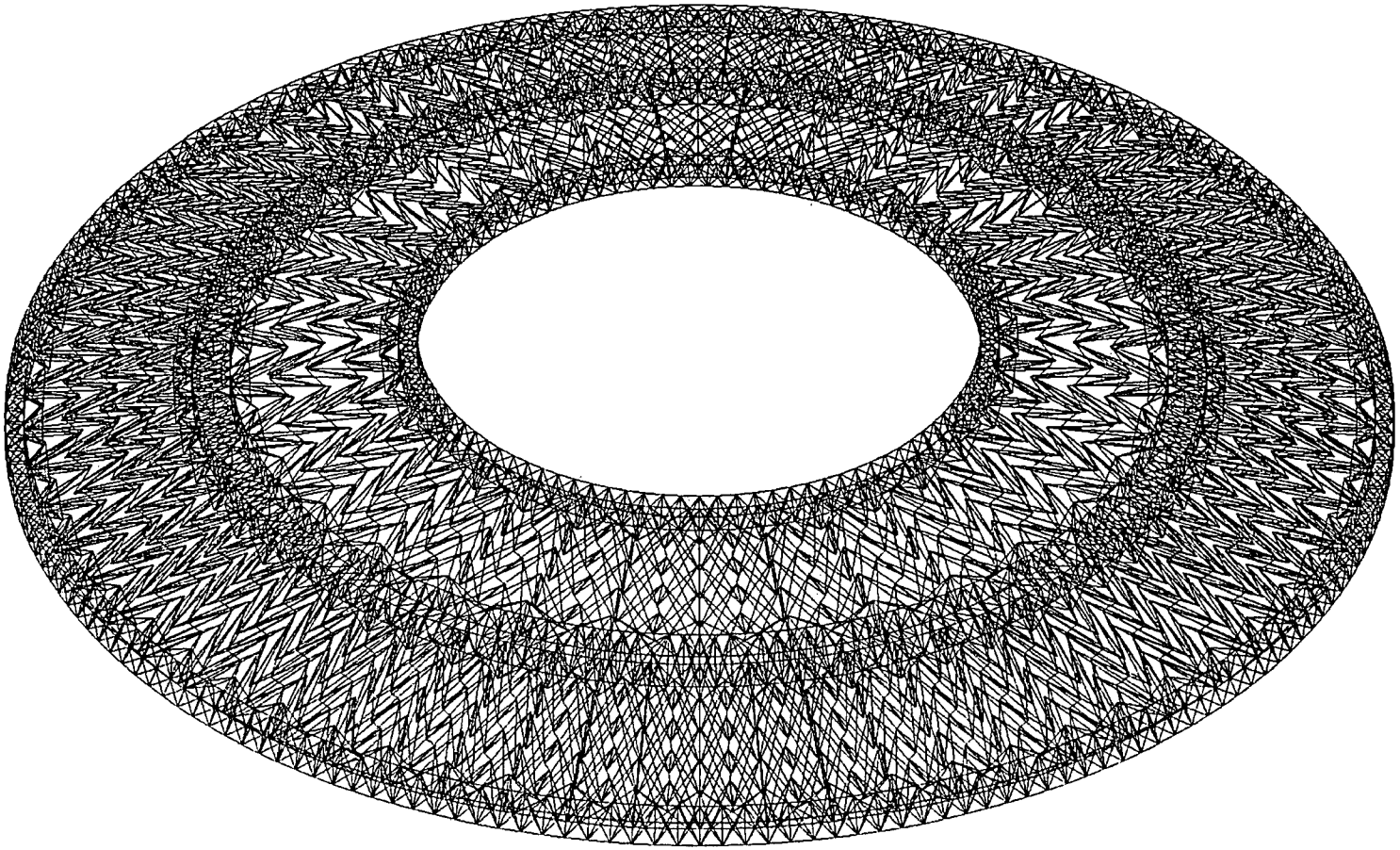
FIG. 18 is a perspective view of a double-layer cable-strut roof system projecting in plan another substantially circular annular curve in accordance with still a further embodiment of the first system of the present invention.

FIG. 18 is a perspective view of a double-layer cable-strut roof system projecting in plan another substantially circular annular curve in accordance with still a further embodiment of the first system of the present invention. The roof system includes three compression rings and three tension-compression rings located on an upper layer and on a lower layer at different locations respectively, which is constructed in a similar manner shown in FIG. 17 but one more upper and lower inner compression rings and one more upper and lower inner tension-compression rings being included in the system, also accordingly a plurality of first diagonal struts, second diagonal struts, pairs of diagonal struts along different hoop directions, annular diagonal cables, first diagonal cables, second diagonal cables, upper cables and lower cables being arranged in the system.

Figure 19:
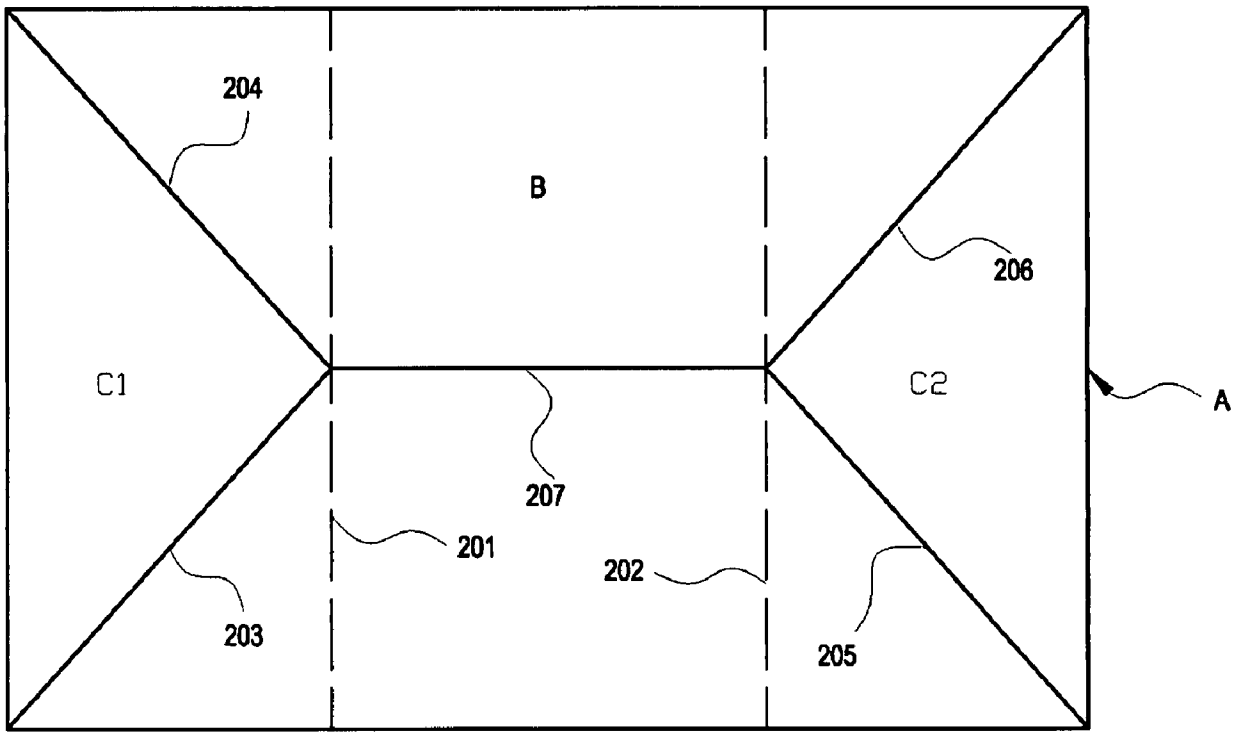
FIG. 19 is a schematic view of inner axes of a rectangle.

FIG. 19 is a schematic view of inner axes of a rectangle designated by the letter A. Dashed lines 201, 202 divide the rectangle A into three parts including an intermediate rectangle B, a left and a right half-squares C1 and C2. Lines 203-207 constitute inner axes of the rectangle A.

Figure 20:
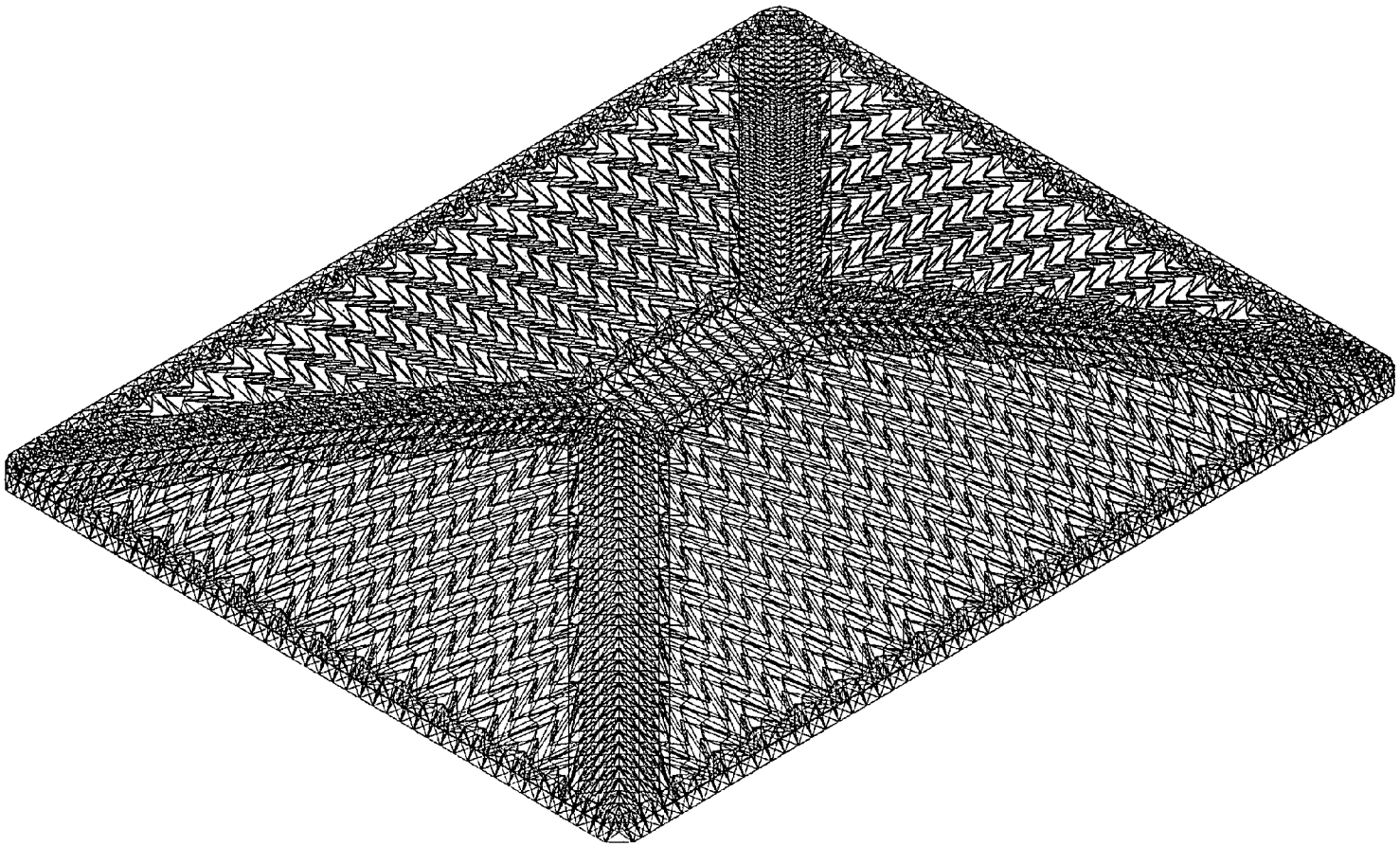
FIG. 20 is a perspective view of a double-layer cable-strut roof system projecting in plan a substantially rectangular curve in accordance with still a further embodiment of the first system of the present invention.

FIG. 20 is a perspective view of a double-layer cable-strut roof system projecting in plan a substantially rectangular curve in accordance with still a further embodiment of the first system of the present invention, which comprises an upper layer and a lower layer parallel to the upper layer. A plurality of diagonal struts each having an upper end and a lower end are provided for defining upper and lower points or nodes of the system. These diagonal struts include: (1) a longitudinally oriented (which is parallel to a short outer side of the rectangular curve) first diagonal strut extending outwardly from an upper node to a lower node; a longitudinally oriented second diagonal strut extending inwardly from an upper node to a lower node, being arranged transversely alternately with the longitudinally oriented first diagonal strut; a transversely oriented (which is parallel to a long outer side of the rectangular curve) first diagonal struts extending outwardly from an upper node to a lower node; a transversely oriented second diagonal strut extending inwardly from an upper node to a lower node, being arranged longitudinally alternately with the transversely oriented first diagonal strut; (2) a pair of diagonal struts being located along each of the outer sides of the rectangular curve; (3) a pair of diagonal struts being located along each of the inner axes of the rectangular curve.

A plurality of diagonal cables are provided for running between the upper node of one diagonal strut and the lower node of an adjacent diagonal strut. The diagonal cables include: (1) a longitudinally or transversely oriented first diagonal cable running from the upper node of one first diagonal strut to the lower node of an inner adjacent first diagonal strut, or interconnecting one first diagonal strut to a proximal pair of diagonal struts located along one of the outer sides or along one of the inner axes of the rectangular curve, extending outwardly from the upper node to the lower node; a longitudinally or transversely oriented second diagonal cable running from the upper node of one second diagonal strut to the lower node of an outer adjacent second diagonal strut, or interconnecting one second diagonal strut to a proximal pair of diagonal struts located along one of the outer sides or along one of the inner axes of the rectangular curve, extending inwardly from the upper node to the lower node; (2) peripheral diagonal cables being positioned along each of the outer sides of the rectangular curve, including: a peripheral diagonal cable running between the inner nodes of two adjacent pairs of diagonal struts located along one of the outer sides of the rectangular curve; a peripheral diagonal cable running between the inner nodes (some of which being connected to .the outer nodes of the pairs of diagonal struts located along one of the outer sides of the rectangular curve) of two adjacent first and second diagonal struts of an edge structure; a peripheral diagonal cable running between the outer nodes of two adjacent first and second diagonal struts of the edge structure; (3) axial diagonal cables being positioned along each of the inner axes of the rectangular curve, including: an axial diagonal cable running between the outer nodes of two adjacent pairs of diagonal struts located along one of the inner axes of the rectangular curve; an axial diagonal cable running between the outer nodes (some of which being connected to the inner nodes of the pairs of diagonal struts located along one of the inner axes of the rectangular curve) of two adjacent first and second diagonal struts of a central structure; an axial diagonal cable running between the inner nodes of two adjacent first and second diagonal struts of the central structure.

A plurality of struts and cables positioned along each of the inner axes of the rectangular curve, a plurality of compression rings and tension-compression rings, and a network of cables are provided on the upper layer and on the lower layer of the roof system respectively. The network of cables includes: (1) a cable interconnecting one first diagonal strut to an adjacent second diagonal strut; (2) a cable interconnecting one first diagonal strut to a proximal pair of diagonal struts located along one of the outer sides of the rectangular curve; (3) a cable interconnecting one second diagonal strut to a proximal pair of diagonal struts located along one of the outer sides of the rectangular curve; (4) a cable interconnecting one first diagonal strut to a proximal pair of diagonal struts located along one of the inner axes of the rectangular curve; (5) a cable interconnecting one second diagonal strut to a proximal pair of diagonal struts located along one of the inner axes of the rectangular curve; (6) a cable interconnecting two adjacent pairs of diagonal struts located along one of the outer sides of the rectangular curve; (7) a cable interconnecting two adjacent pairs of diagonal struts located along one of the inner axes of the rectangular curve.

In the present embodiment, the pairs of struts and the correlative cables and the struts positioned along each of the inner axes of the rectangular curve constitute the central structure, while those positioned along each of the outer sides of the rectangular curve constitute the edge structure. The plurality of sets of discontinuous diagonal struts and continuous cables are arranged in a similar manner discussed in previous embodiments, but here the sets of diagonal struts are located parallel to the long outer side or the short outer side of the rectangular curve.

Figure 21:
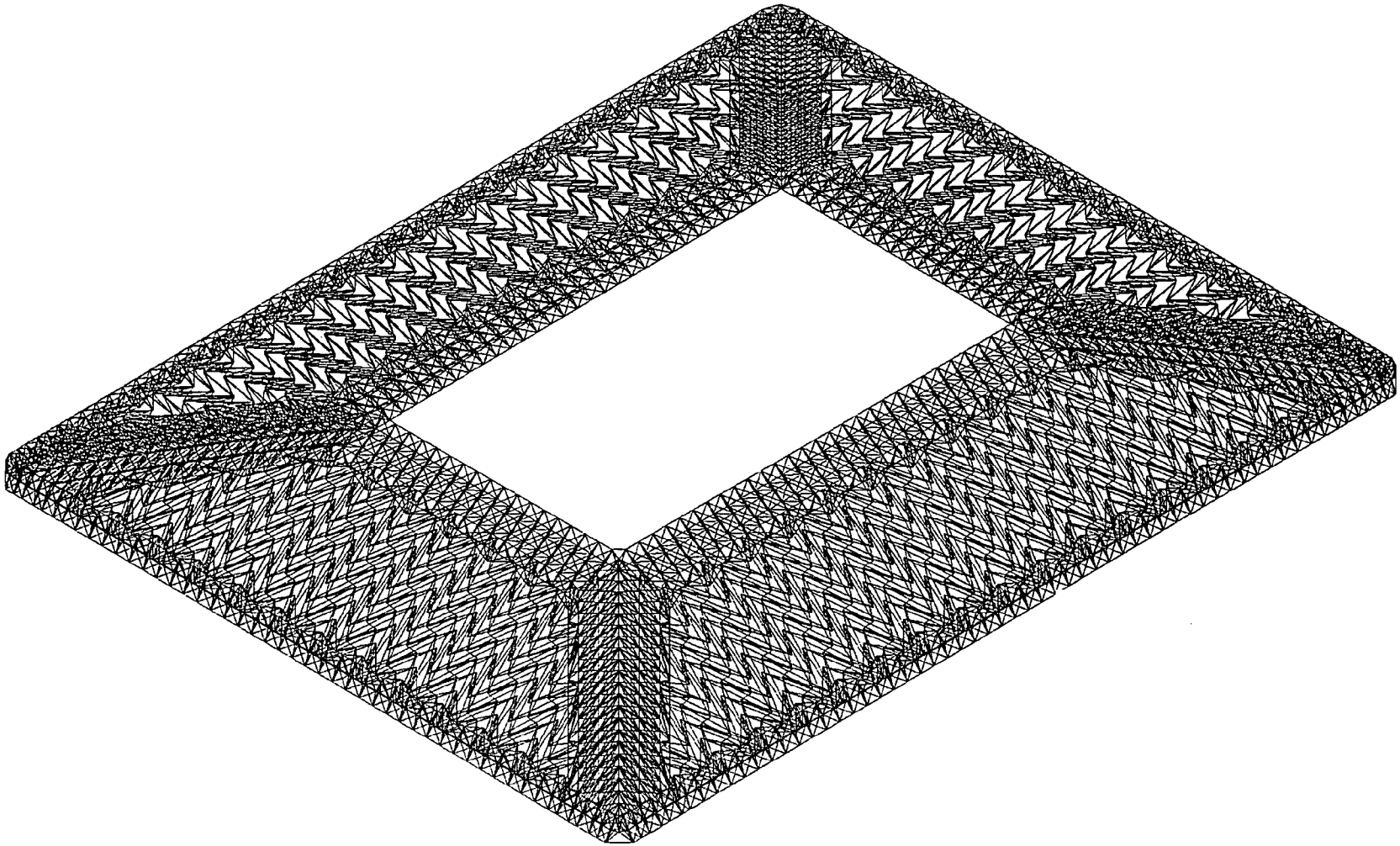
FIG. 21 is a perspective view of a double-layer cable-strut roof system projecting in plan a substantially rectangular annular curve in accordance with still a further embodiment of the first system of the present invention.

FIG. 21 is a perspective view of a double-layer cable-strut roof system projecting in plan a substantially rectangular annular curve in accordance with still a further embodiment of the first system of the present invention. Four lines each connecting one vertex of an inner rectangle and a corresponding one vertex of an outer rectangle constitute the inner axes of the roof system.

As shown in FIG. 21, the roof system comprises an upper layer and a lower layer parallel to the upper layer. A plurality of diagonal struts each having an upper end and a lower end are provided for defining upper and lower points or nodes of the system. These diagonal struts include: (1) a longitudinally oriented first diagonal strut extending outwardly from an upper node to a lower node; a longitudinally oriented second diagonal strut extending inwardly from an upper node to a lower node and arranged transversely alternately with the longitudinally oriented first diagonal strut; a transversely oriented first diagonal strut extending outwardly from an upper node to a lower node; a transversely oriented second diagonal strut extending inwardly from an upper node to a lower node and arranged longitudinally alternately with the transversely oriented first diagonal strut; (2) a pair of inner diagonal struts being located along each of the sides of the inner rectangle; (3) a pair of outer diagonal struts being located along each of the sides of the outer rectangle; (4) a pair of axial diagonal struts being located along each of the inner axes of the roof system.

A plurality of diagonal cables are provided for running between the upper node of one diagonal strut and the lower node of an adjacent diagonal strut. The diagonal cables include: (1) a longitudinally or transversely oriented first diagonal cable running from the upper node of one first diagonal strut to the lower node of an inner adjacent first diagonal strut of the same set, or interconnecting one first diagonal strut to a proximal pair of diagonal struts located along one of the sides of the inner or the outer rectangle or to a proximal pair of diagonal struts located along one of the inner axes of the roof system, extending outwardly from the upper node to the lower node; a longitudinally or transversely oriented second diagonal cable running from the upper node of one second diagonal strut to the lower node of an outer adjacent second diagonal strut of the same set, or interconnecting one second diagonal strut to a proximal pair of diagonal struts located along one of the sides of the inner or the outer rectangle or to a proximal pair of diagonal struts located along one of the inner axes of the roof system, extending inwardly from the upper node to the lower node; (2) inner peripheral diagonal cables being positioned along each of the sides of the inner rectangle, including: an inner peripheral diagonal cable running between the outer nodes of two adjacent pairs of diagonal struts located along one of the sides of the inner rectangle; an inner peripheral diagonal cable running between the outer nodes (some of which being connected to the inner nodes of the pairs of diagonal struts located along one of the sides of the inner rectangle) of two adjacent first and second diagonal struts of an central structure; an inner peripheral diagonal cables running between the inner nodes of two adjacent first and second diagonal struts of the central structure; (3) outer peripheral diagonal cables being positioned along each of the sides of the outer rectangle, including: an outer peripheral diagonal cable running between the inner nodes of two adjacent pairs of diagonal struts located along one of the sides of the outer rectangle; an outer peripheral diagonal cable running between the inner nodes (some of which being connected to the outer nodes of the pairs of diagonal struts located along one of the sides of the outer rectangle) of two adjacent first and second diagonal struts of an edge structure; an outer peripheral diagonal cable running between the outer nodes of two adjacent first and second diagonal struts of the edge structure; (4) axial diagonal cables being positioned along each of the inner axes of the roof system, including: an axial diagonal cable running between the outer nodes of two adjacent pairs of diagonal struts located along one of the inner axes of the roof system; an axial diagonal cable running between the outer nodes (some of which being connected to the inner nodes of the pairs of diagonal struts located along one of the inner axes of the roof system) of two adjacent first and second diagonal struts of an axial structure; an axial diagonal cable running between the inner nodes of two adjacent first and second diagonal struts of the axial structure.

A plurality of struts and cables positioned along each of the inner axes of the roof system, a plurality of inner compression rings, inner tension-compression rings, outer tension-compression rings, outer compression rings and a network of cables are provided on the upper layer and on the lower layer of the roof system respectively. The network of cables includes: (1) a cable interconnecting one first diagonal strut to an adjacent second diagonal strut; (2) a cable interconnecting one first diagonal strut to a proximal pair of diagonal struts located along one of the sides of the inner or the outer rectangle; (3) a cable interconnecting one second diagonal strut to a proximal pair of diagonal struts located along one of the sides of the inner or the outer rectangle; (4) a cable interconnecting one first diagonal strut to a proximal pair of diagonal struts located along one of the inner axes of the roof system; (5) a cable interconnecting one second diagonal strut to a proximal pair of diagonal struts located along one of the inner axes of the roof system; (6) a cable interconnecting two adjacent pairs of diagonal struts located along one of the sides of the inner rectangle; (7) a cable interconnecting two adjacent pairs of diagonal struts located along one of the sides of the outer rectangle; (8) a cable interconnecting two adjacent pairs of diagonal struts located along one of the inner axes of the roof system.

Figure 22:
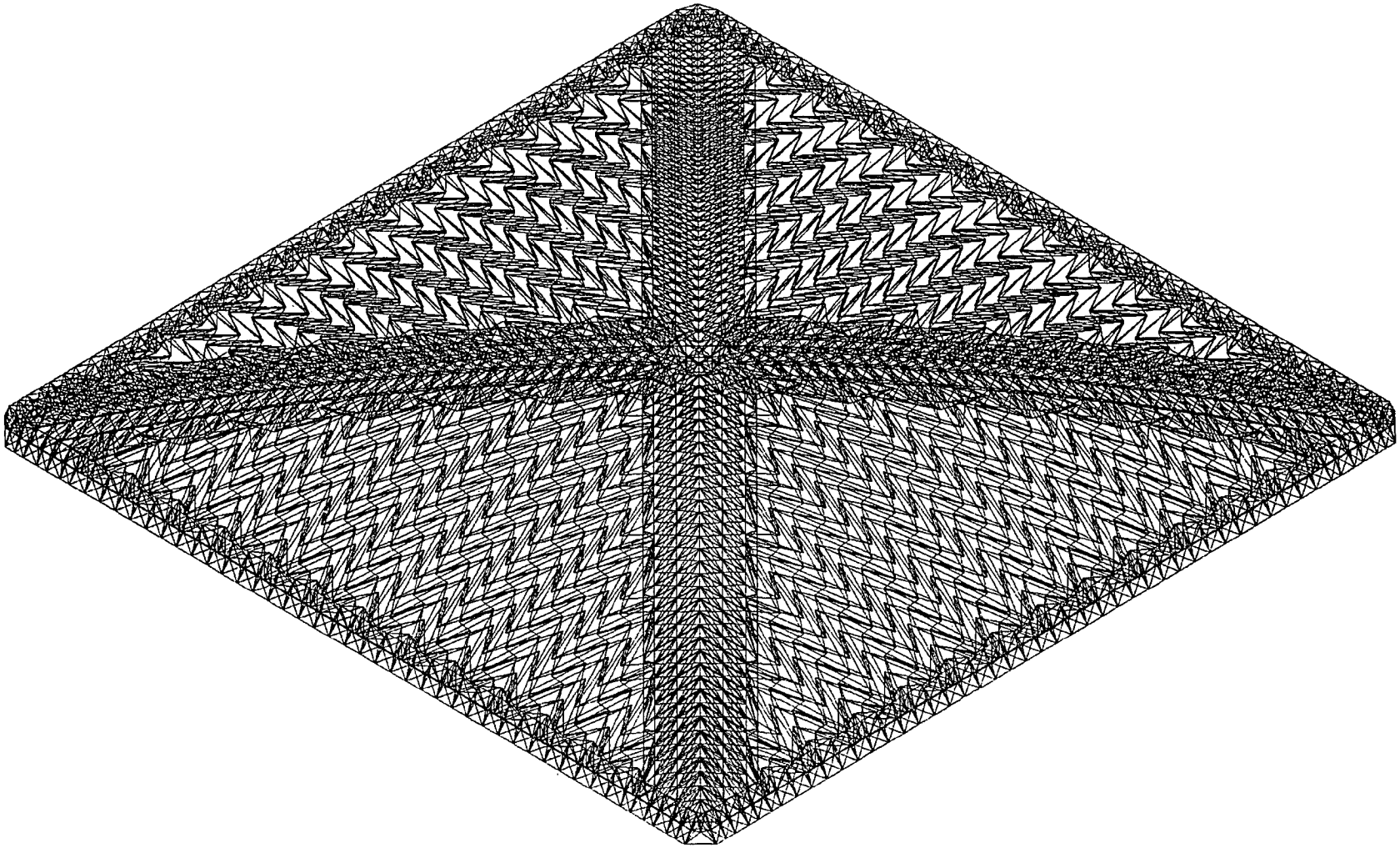
FIG. 22 is a perspective view of a double-layer cable-strut roof system projecting in plan a substantially square curve in accordance with still a further embodiment of the first system of the present invention.

FIG. 22 is a perspective view of a double-layer cable-strut roof system projecting in plan a substantially square curve in accordance with still a further embodiment of the first system of the present invention. The roof system is constructed in a similar manner shown in FIG. 20 but the long side and the short side of this square curve are equal in length.

Figure 23:
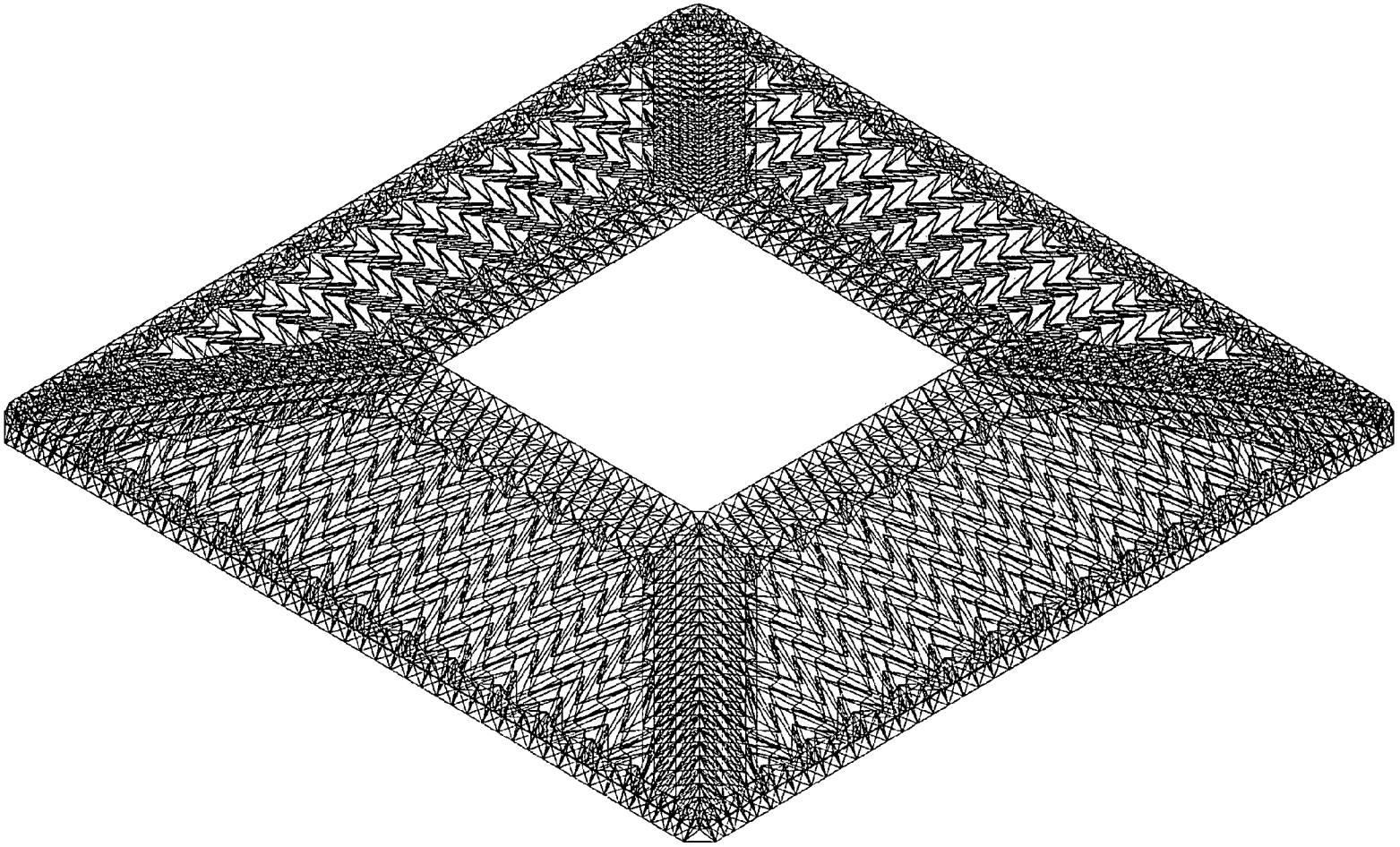
FIG. 23 is a perspective view of a double-layer cable-strut roof system projecting in plan a substantially square annular curve in accordance with still a further embodiment of the first system of the present invention.

FIG. 23 is a perspective view of a double-layer cable-strut roof system projecting in plan a substantially square annular curve in accordance with still a further embodiment of the first system of the present invention. The roof system is constructed in a similar manner shown in FIG. 21 but the long side and the short side of this square annular curve are equal in length.

The preferred embodiments according to the second system of the invention will be described in detail with reference to the drawings, FIGS. 24-45.

Figure 24:
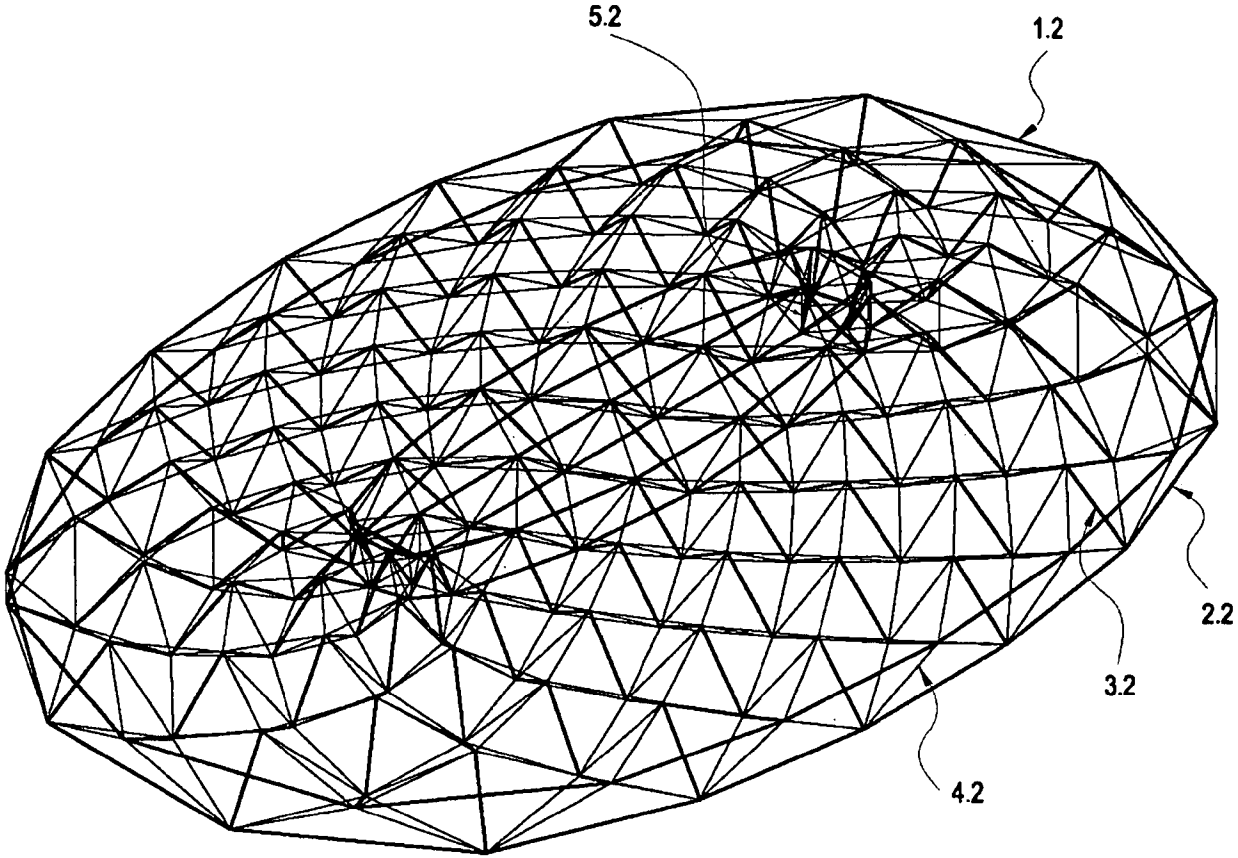
FIG. 24 is a perspective view of a double-layer cable-strut roof system projecting in plan a substantially oval curve in accordance with one embodiment of the second system of the present invention.

FIG. 24 is a perspective view of a double-layer cable-strut roof system projecting in plan a substantially closed oval curve in accordance with one embodiment of the second system of the present invention. It is to be noted that structural members are arranged regularly in the structure, but people skilled in the art will understand after reading the description that the system can be constructed in various manners with irregular structural members arrangement. Roofing materials overlay an upper layer 1.2 forming a roof for the underlying space which may cover in its entirety or, alternatively, may cover a perimeter portion of while leaving the center portion uncovered. A lower layer 2.2 is parallel to the upper layer 1.2, but they may not parallel each other. A plurality of diagonal struts 3.2, diagonal cables 4.2 and vertical cables 5.2 are arranged between the upper and the lower layers. Plan views of the upper and the lower layers, layout drawings of the diagonal struts 3.2, the diagonal cables 4.2 and the vertical cables 5.2 are shown in FIGS. 25 through 29, in which struts are shown with thick continuous lines and cables are shown with thin continuous lines.

Figure 25:
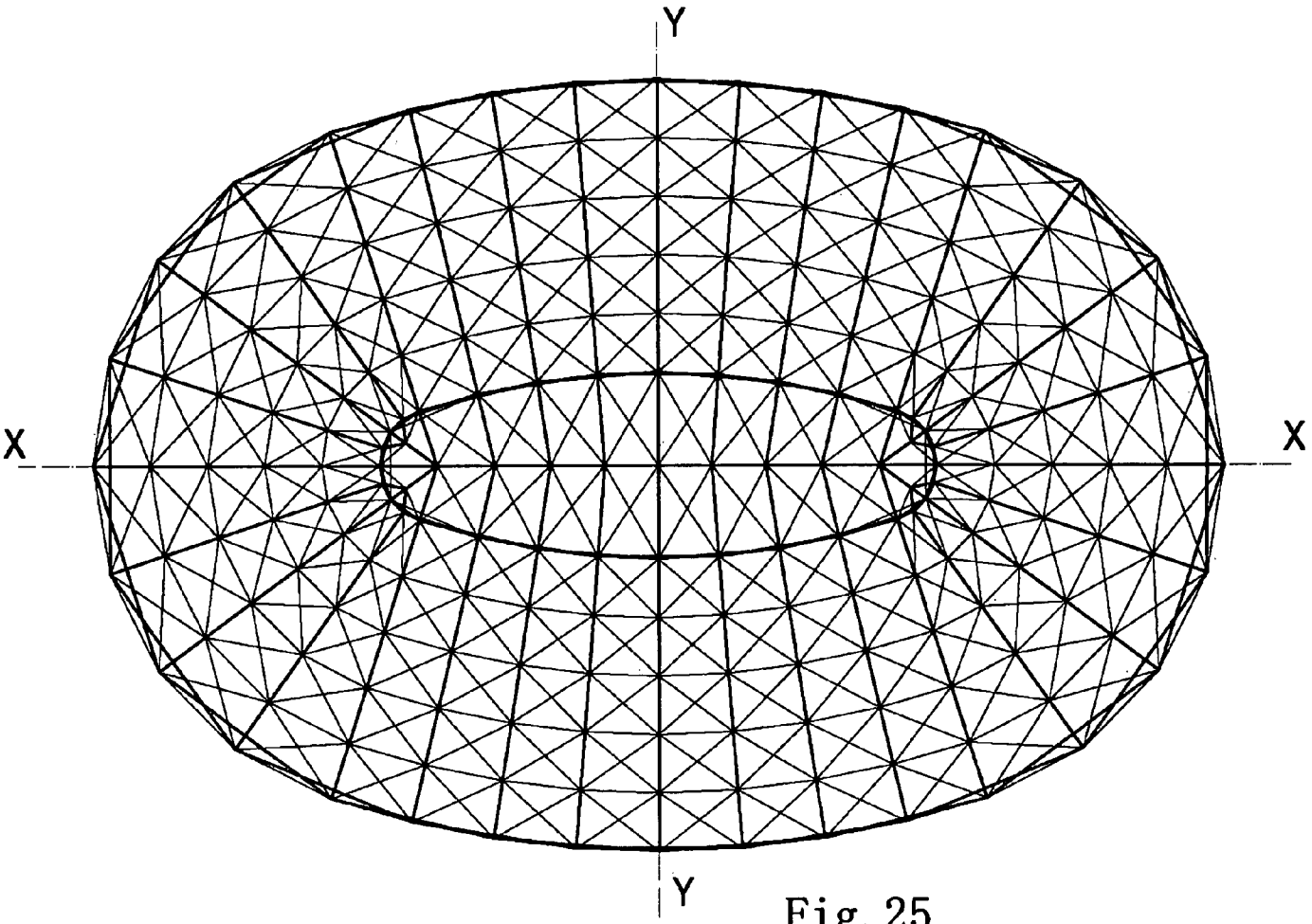
FIG. 25 is a top plan view of the roof system of FIG. 24.

FIG. 25 is a plan view of the roof system of FIG. 24, which projecting in plan a substantially oval curve has a major axis X-X and a minor axis Y-Y.

Figure 26:
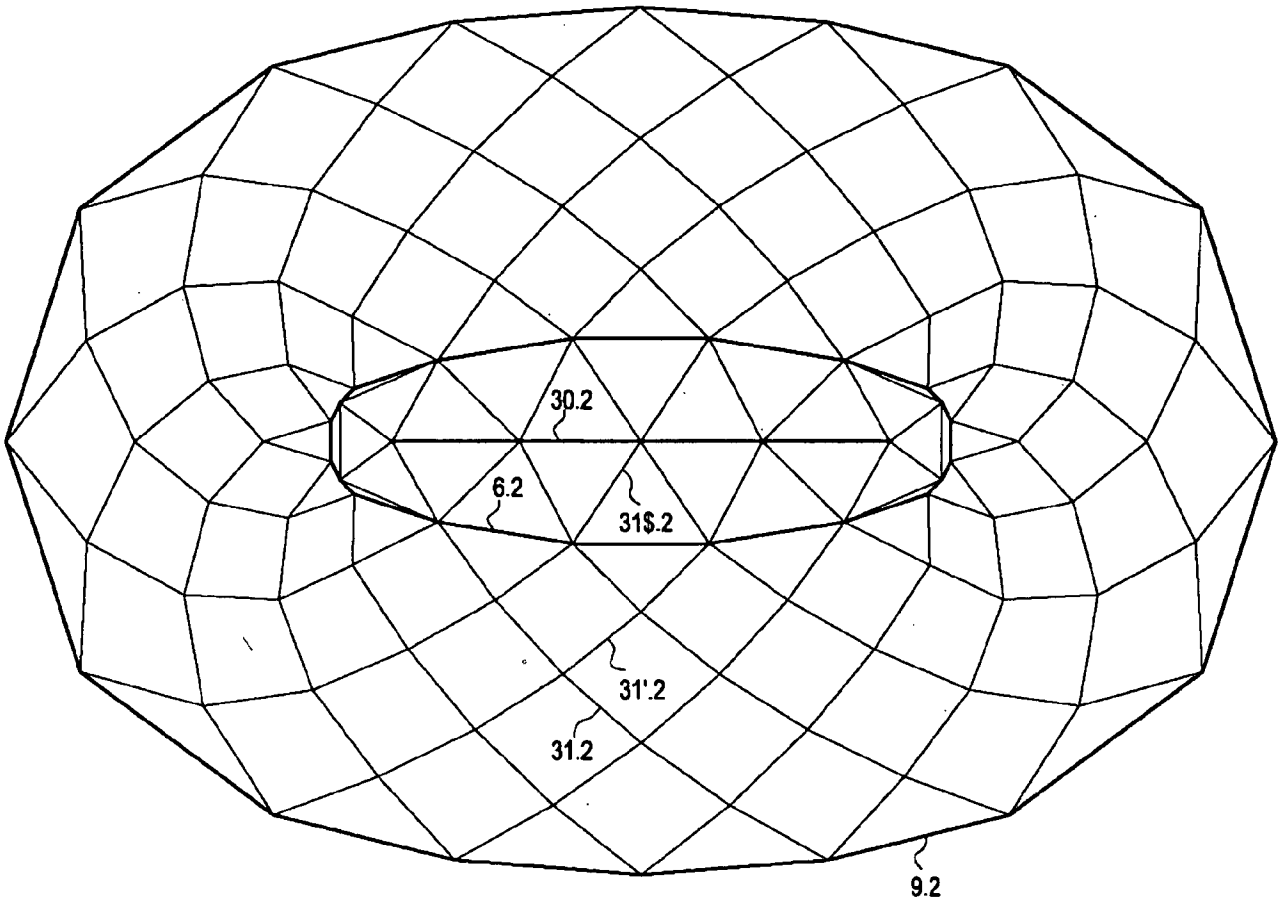
FIG. 26 is a top plan view depicting an upper layer of the roof system of FIG. 24.

FIG. 26 is a top plan view depicting the upper layer 1.2 of the roof system of FIG. 24, wherein all reticulated lines are cables except central struts 30.2, an inner compression ring 6.2 and an outer compression ring 9.2.

Figure 27:
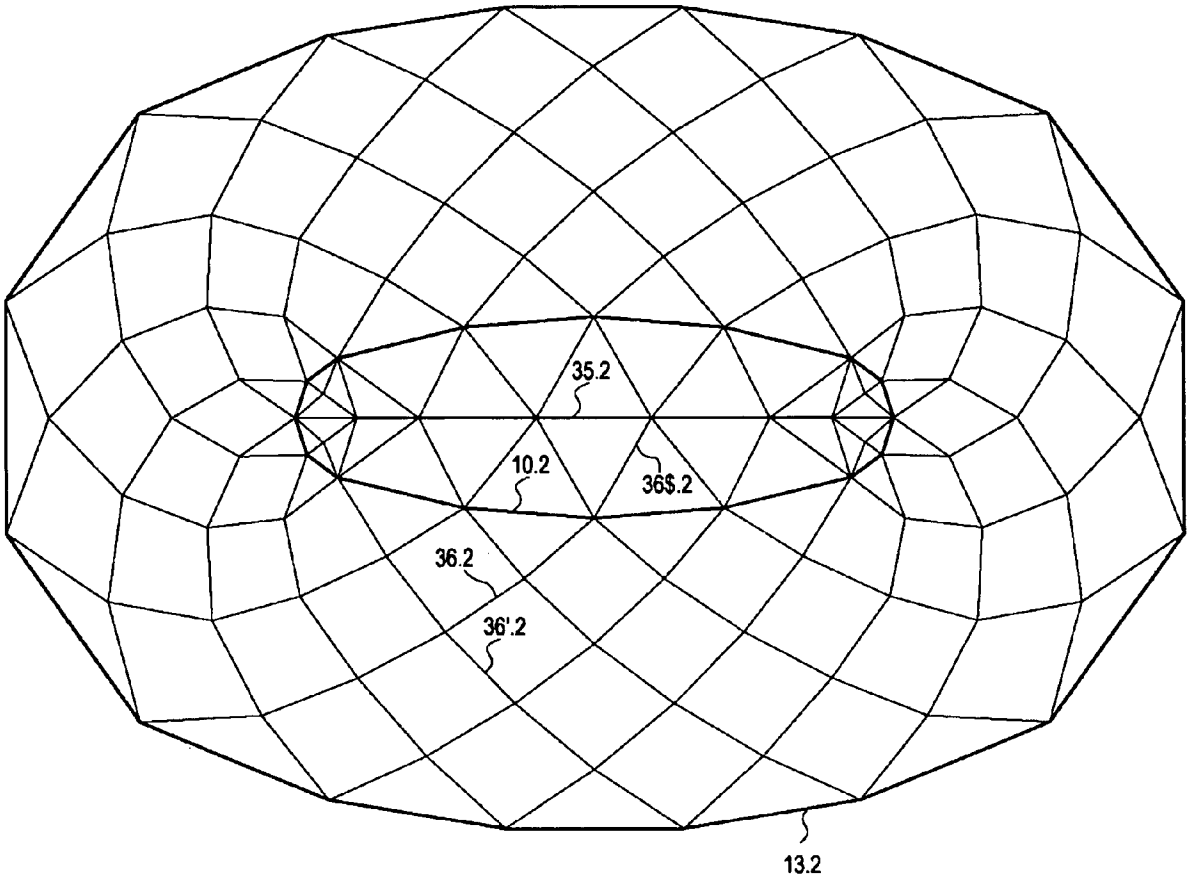
FIG. 27 is a top plan view depicting a lower layer of the roof system of FIG. 24.

FIG. 27 is a top plan view depicting the lower layer 2.2 of the roof system of FIG. 24, wherein all reticulated lines are cables except central struts 35.2, an inner compression ring 10.2 and an outer compression ring 13.2.

Figure 28:
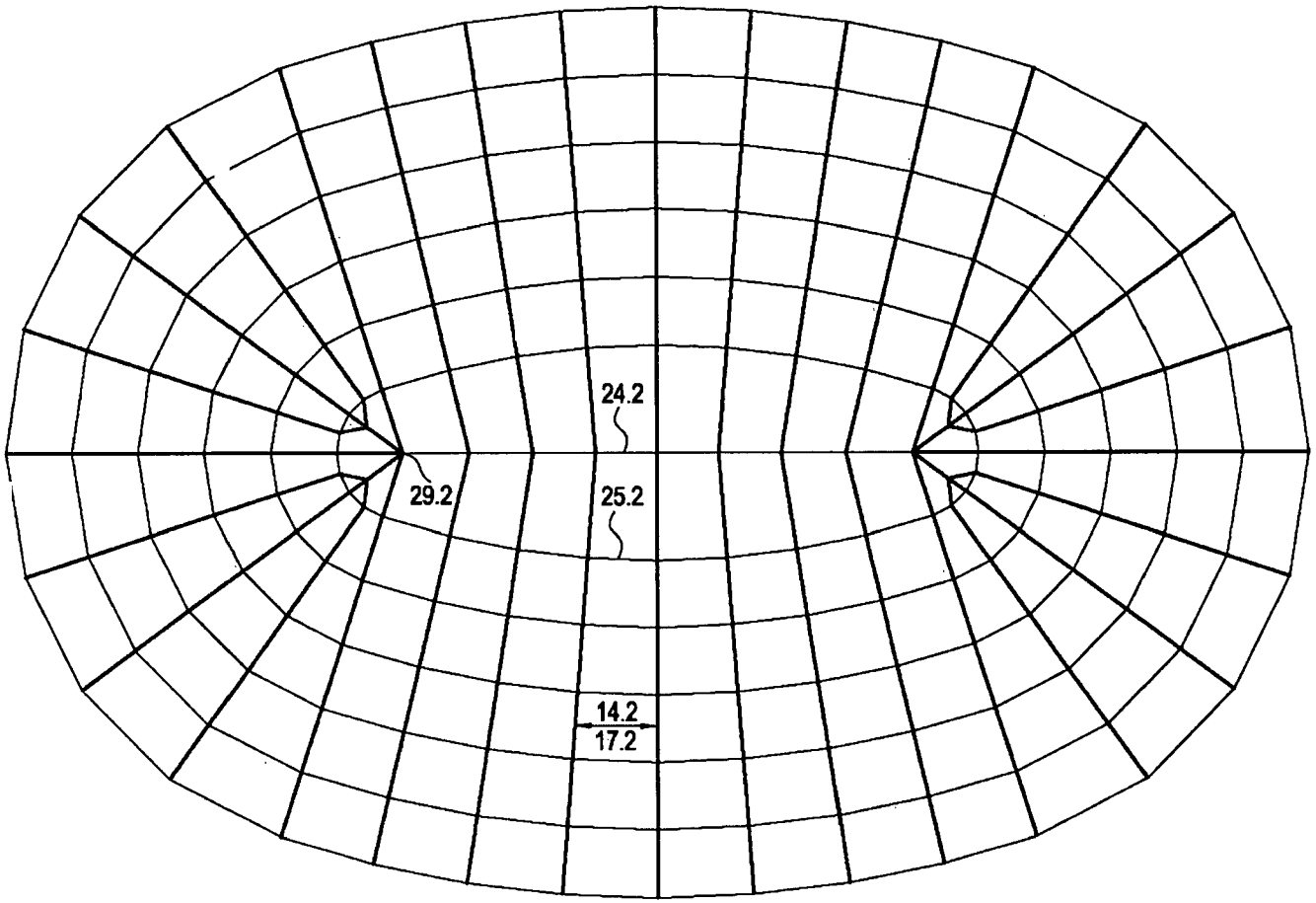
FIG. 28 is a top plan view depicting a plurality of diagonal cables and diagonal struts provided between the upper and the lower layers of the roof system of FIG. 24.

FIG. 28 is a top plan view depicting arrangement of the diagonal struts 3.2, the diagonal cables 4.2 and the vertical cables 5.2 in accordance with the roof system shown in FIG. 24.

Figure 29:
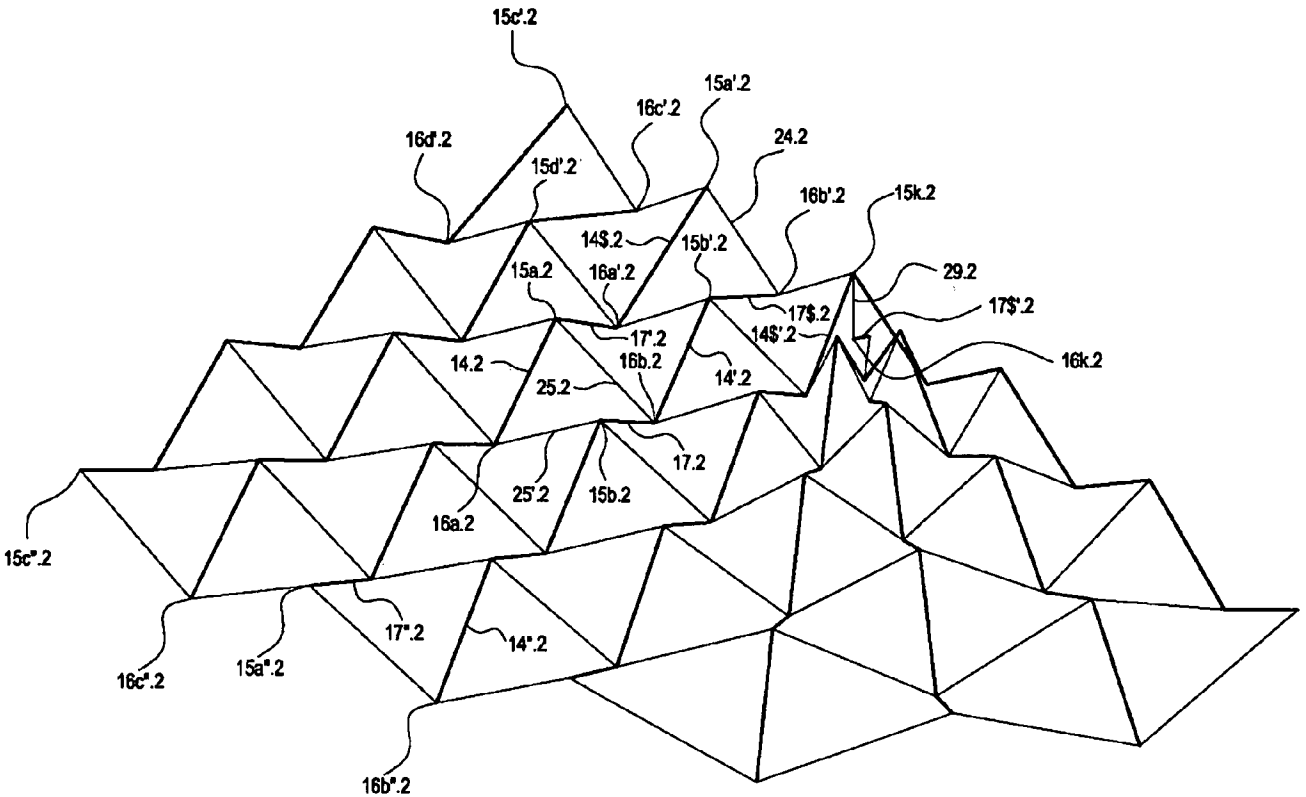
FIG. 29 is a perspective view depicting a quarter of the diagonal cables and the diagonal struts shown in FIG. 28.

FIG. 29 is a perspective view depicting arrangement of the diagonal struts 3.2, the diagonal cables 4.2 and the vertical cables 5.2 in accordance with the roof system shown in FIG. 24, in which only a quarter of the cables and the struts are shown for symmetry of the system.

As best shown in FIGS. 28 and 29, the upper and lower ends of the diagonal struts 3.2 define upper and lower points or nodes of the system. The diagonal struts 3.2 comprise: (1) a first diagonal strut 14.2 running radially and outwardly from an upper end defining an upper point or node 15*a*.2 to a lower end defining a lower point or node 16*a*.2; (2) a second diagonal strut 17.2 being spaced apart and arranged transversely alternately with the first diagonal strut 14.2, running radially and inwardly from an upper end defining an upper point or node 15*b*.2 to a lower end defining a lower point or node 16*b*.2. A plurality of first and second diagonal struts located along a same radial direction are also arranged alternately and joined together node to node, forming a zigzag shape. For example, a second diagonal strut 17'.2 and the first diagonal strut 14.2 located along a same radial direction cross at node 15*a*.2.

The diagonal cables 4.2 run between the upper node of one diagonal strut 3.2 and the lower node of an adjacent diagonal strut 3.2. As seen in FIGS. 28 and 29, these diagonal cables include:

(1) a central diagonal cable 24.2 being positioned along the major axis of the oval and extending from an upper inner node 15*a*'.2 of a first diagonal strut 14$.2 to a lower inner node 16*b*'.2 of a transversely adjacent second diagonal strut 17$.2, a plurality of which forming a zigzag shape.

(2) annular diagonal cables such as 25.2, a plurality of each of which forming a closed zigzag shape respectively, including: (a) an annular diagonal cable 25.2 extending from inner node 15*a*.2 of the first diagonal strut 14.2 to lower inner node 16*b*.2 of the transversely adjacent second diagonal strut 17.2; (b) an annular diagonal cable 25'.2 extending from upper outer node 15*b*.2 of the second diagonal strut 17.2 to lower outer node 16*a*.2 of the transversely adjacent first diagonal strut 14.2.

As shown in FIGS. 26 and 29, the central struts and the compression rings on the upper layer include: (1) the central struts 30.2 comprising a strut running between two adjacent upper inner nodes 15*a*'.2 and 15*c*'.2 of two first diagonal struts 14$.2 positioned along the major axis of the oval; (2) the inner compression ring 6.2 comprising a plurality of struts joined together node-to-node, one of which running between two adjacent upper common nodes 15*b*'.2 and 15*d*'.2 at which the second diagonal strut 17$.2 crosses a first diagonal strut 14'.2 respectively; (3) the outer compression ring 9.2 comprising a plurality of struts joined together node-to-node, one of which running between two adjacent upper outer nodes 15*a*".2 and 15*c*".2 of two second diagonal struts 17".2.

As shown in FIGS. 27 and 29, the central struts and the compression rings on the lower layer include: (1) the central struts 35.2 comprising a strut running between two adjacent lower inner nodes 16*b*'.2 and 16*c*'.2 of two second diagonal struts 17$.2 positioned along the major axis of the oval; (2) the inner compression ring 10.2 comprising a plurality of struts joined together node-to-node, one of which running between two adjacent lower common nodes 16*a*'.2 and 16*d*'.2 at which the first diagonal strut 14$.2 crosses the second diagonal strut 17'.2 respectively; (3) the outer compression ring 13.2 comprising a plurality of struts joined together node-to-node, one of which running between two adjacent lower outer nodes 16*b*".2 and 16*c*".2 of two first diagonal struts 14".2.

The vertical cables 5.2 run between the upper node of one diagonal strut and the lower node of another diagonal strut located on the major axis of the oval. As seen in FIGS. 28 and 29, these vertical cables include: a vertical cable 29.2 extending from an upper inner node 15*k*.2 of a first diagonal strut 14$'.2 to a lower inner node 16*k*.2 of a transversely adjacent second diagonal strut 17$'.2.

A plurality of upper cables are provided for running between the upper nodes of diagonal struts 3.2, forming a continuous network. As shown in FIGS. 26 and 29, these upper cables include:

upper cables such as 31.2, including: (a) an upper cable 31$.2 extending from upper inner node 15*a*'.2 of the first diagonal strut 14$.1 to upper outer node 15*b*'.2 (or 15*d*'.2) of the transversely adjacent second diagonal strut 17$.2; (b) an upper cable 31.2 extending from upper inner node 15*a*.2 of the first diagonal strut 14.2 to upper outer node 15*b*.2 of the transversely adjacent second diagonal strut 17.2; (c) an upper cable 31'.2 extending from upper inner node 15*a*.2 of the first diagonal strut 14.2 to upper inner node 15*b*'.2 of the first diagonal strut 14'.2 whose outer node is connected to the inner node of the second diagonal strut 17.2 which is laterally adjacent to the first diagonal strut 14.2.

A plurality of lower cables are provided for running between the lower nodes of diagonal struts 3.2, forming a continuous network. As shown in FIGS. 27 and 29, these lower cables include:

lower cables such as 36.2, including: (a) a lower cable 36$.2 extending from lower inner node 16*b*'.2 of the second diagonal strut 17$.2 to lower outer node 16*a*'.2 of the transversely adjacent first diagonal strut 14$.2; (b) a lower cable 36.2 extending from lower inner node 16*b*.2 of the second diagonal strut 17.2 to lower outer node 16*a*.2 of the transversely adjacent first diagonal strut 14.2; (c) a lower cable 36'.2 extending from lower outer node 16*a*.2 of the first diagonal strut 14.2 to lower outer node 16*b*'".2 of a first diagonal strut whose inner node is connected to the outer node of the second diagonal strut 17.2 which is laterally adjacent to the first diagonal strut 14.2.

As thus far described, the second system of the invention comprises: a continuous compression central structure and a continuous compression edge structure, a plurality of sets of diagonal struts being provided between the two structures, the diagonal struts being joined together node-to-node within one set but being independent of one another between any two adjacent sets. A plurality of cables are provided for interconnecting the diagonal struts, forming a continuous network. In the above embodiment, (1) the central structure includes: the compression rings 6.2 and 10.2. As this embodiment is a center closed structure, within the compression rings 6.2 and 10.2 the central structure further includes the first diagonal struts 14$.2 (14$'.2), the second diagonal struts 17$.2 (17$'.2), the central struts 30.2, 35.2, the central diagonal cables 24.2, the vertical cables 29.2, the upper cables 31$.2 and the lower cables 36$.2; (2) the edge structure includes: the compression rings 9.2 and 13.2; (3) between the central and the edge structures, the plurality of independent sets of radially oriented diagonal struts comprise the first diagonal struts 14.2 (14'.2, 14".2) and the second diagonal struts 17.2 (17'.2, 17".2), which are interconnected by the annular diagonal cables 25.2, 25'.2.

Figure 30:
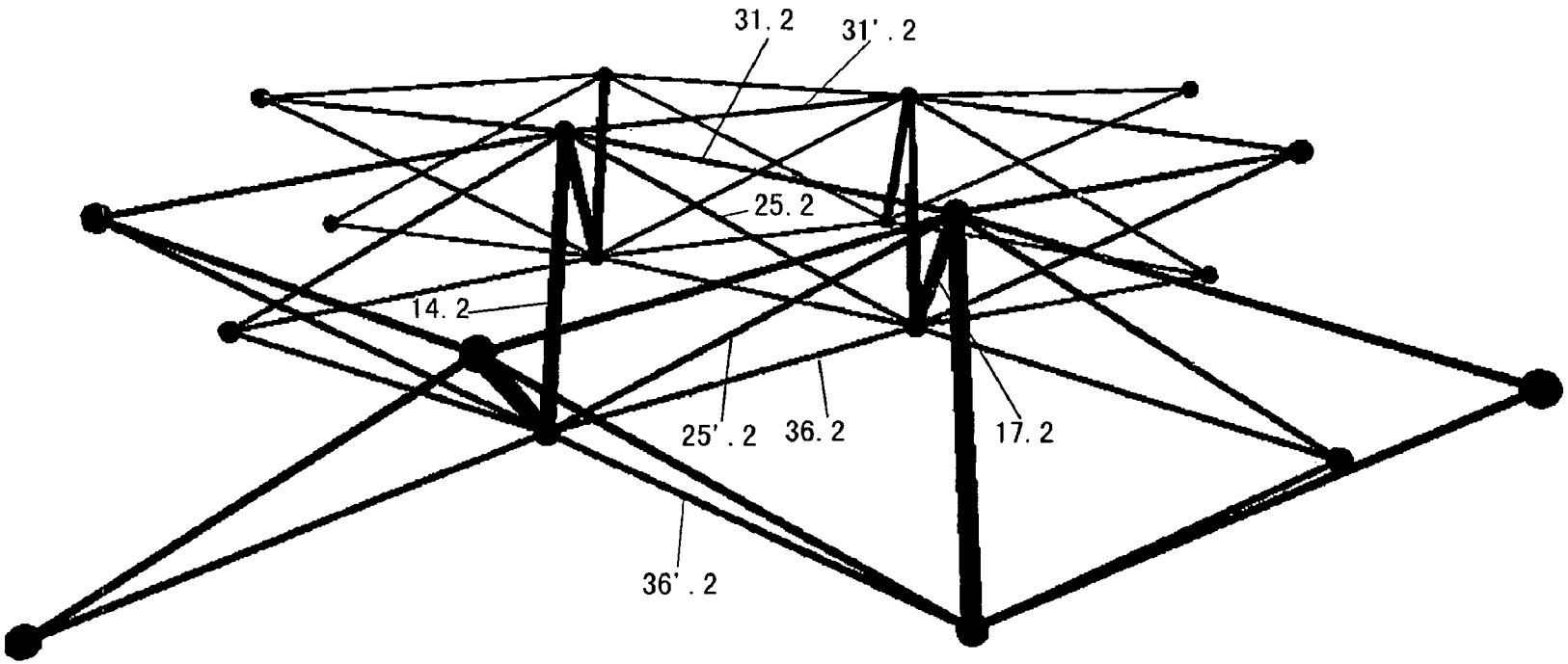
FIG. 30 illustrates one unit forming part of the intermediate structure of the roof system of FIG. 24.
Figure 31:
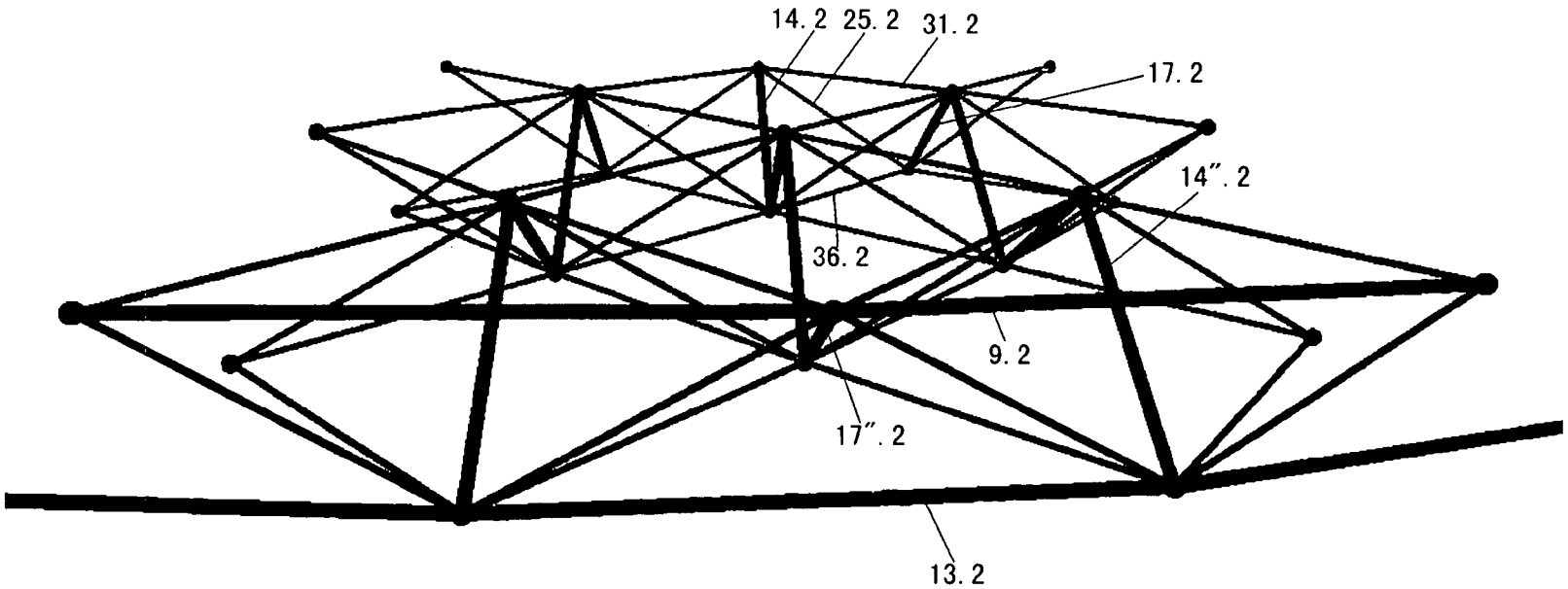
FIG. 31 illustrates one unit forming part of the intermediate structure and one unit forming part of the edge structure of the roof system of FIG. 24.

FIG. 30 illustrates one unit forming part of the intermediate structure of the roof system of FIG. 24. FIG. 31 illustrates one unit forming part of the intermediate structure and one unit forming part of a boundary structure of the roof system of FIG. 24. The boundary structure could be the central structure or the edge structure, as the topologies of the both are similar and here the edge structure is regarded as an example. In FIGS. 30 and 31 like reference numerals represent like elements as shown in FIGS. 26 to 29. It is clear from above description that the roof system shown in FIG. 24 is devised by arrangement of a plurality of the above described units in a predefined manner. Those skilled in the art could recognize that other arrangements could be devised, for example, forming the following detailed described preferred embodiments of the invention. The intermediate structure could also be arranged not only between a central and an edge structures but also between two relative boundary structures.

Figure 32:
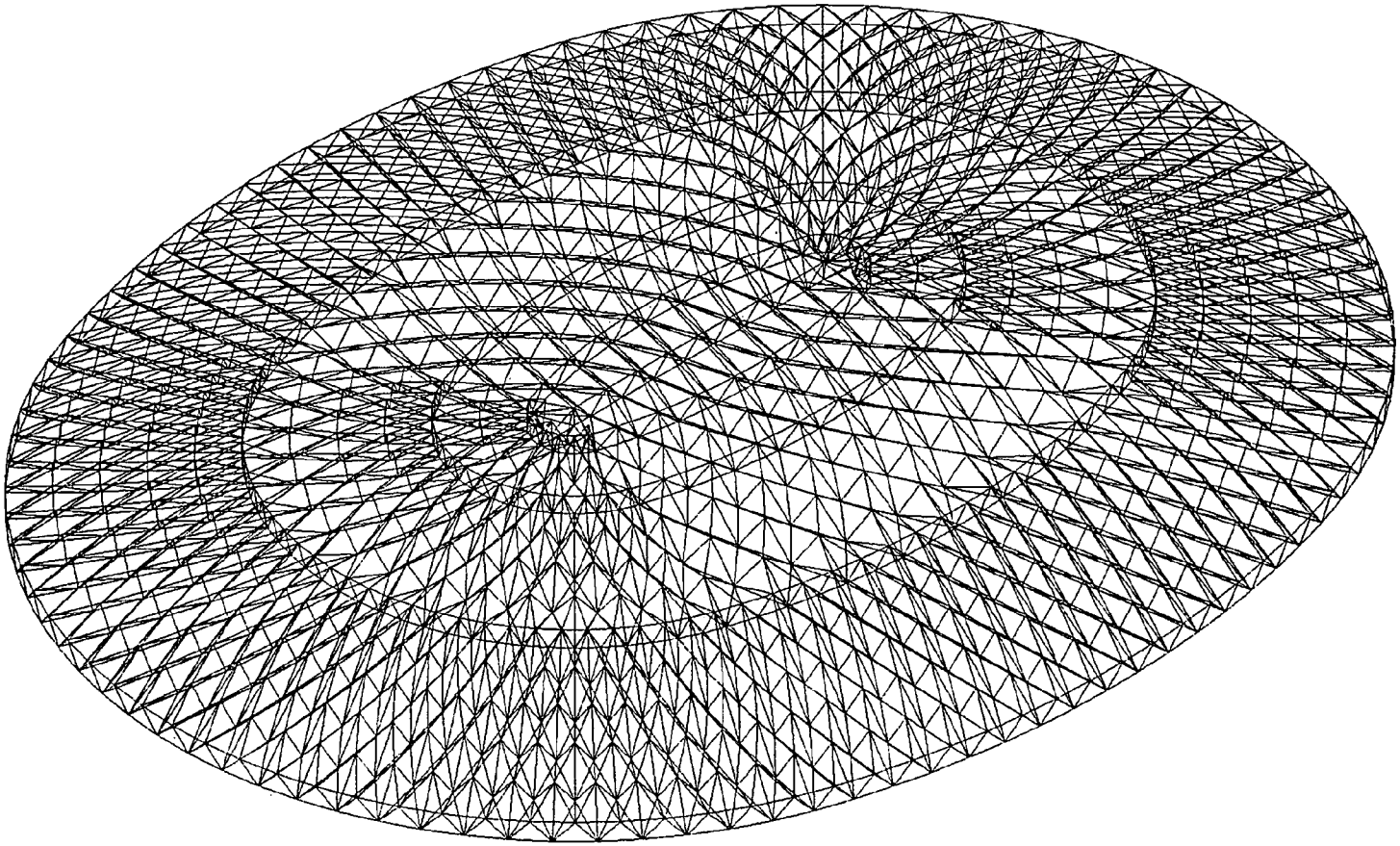
FIG. 32 is a perspective view of a double-layer cable-strut roof system projecting in plan another substantially oval curve in accordance with another embodiment of the second system of the present invention.

FIG. 32 is a perspective view of a double-layer cable-strut roof system projecting in plan another substantially oval curve in accordance with another embodiment of the second system of the present invention. The roof system includes four upper and four lower compression rings located on an upper and on a lower layers at different locations respectively, which is constructed in a similar manner shown in FIG. 24 but is adaptable for spanning large areas with more cables and struts provided, two more upper and lower inner compression rings being-included accordingly in the system compared with the system shown in FIG. 24.

Figure 33:
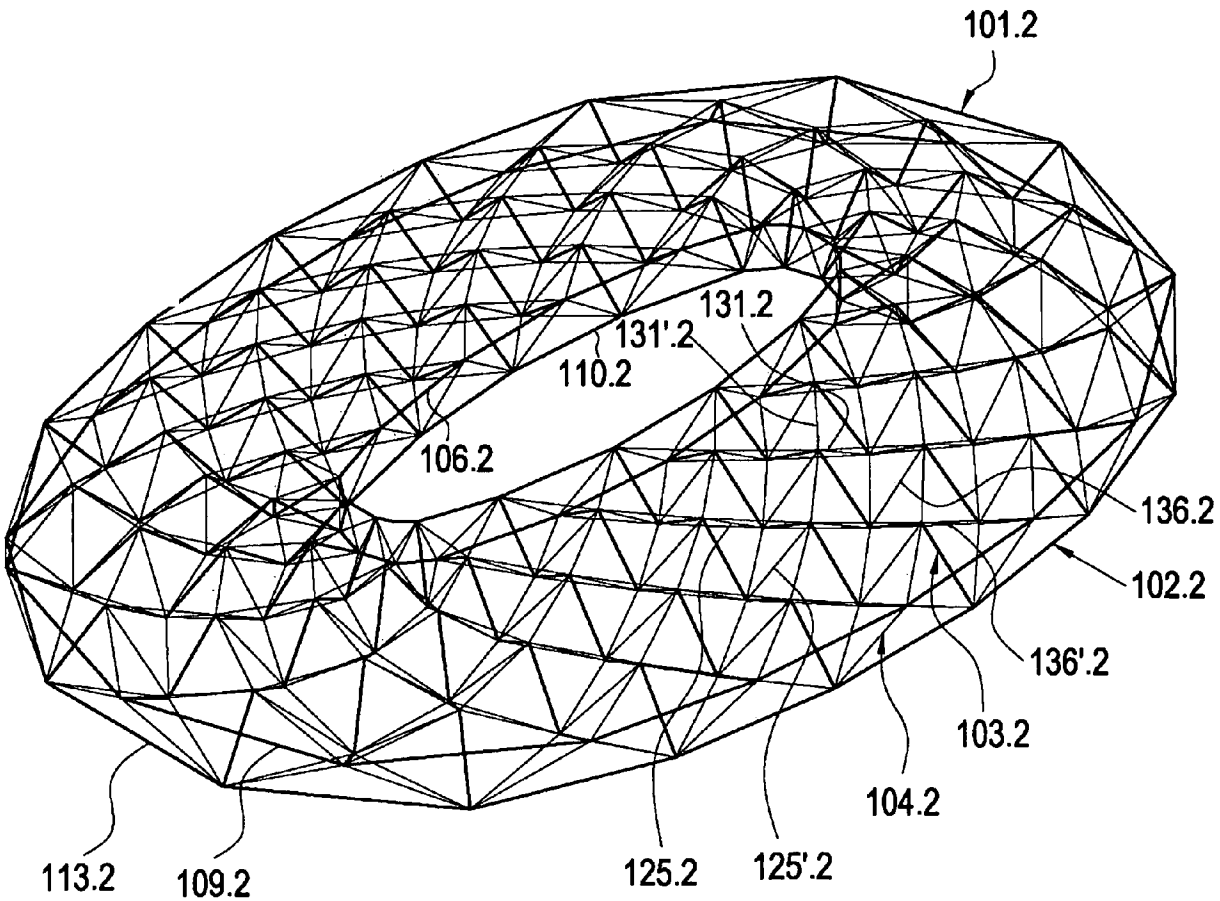
FIG. 33 is a perspective view of a double-layer cable-strut roof system projecting in plan a substantially oval annular curve in accordance with yet another embodiment of the second system of the present invention.

FIG. 33 is a perspective view of a double-layer cable-strut roof system projecting in plan a substantially oval annular curve in accordance with yet another embodiment of the second system of the present invention. Roofing materials overlay an upper layer 101.2 while leave the center portion of the system uncovered, which is well-suited for open-air stadium construction. Advantageously, it may be used to shelter stadium seating areas, while the event surface or playing field remains exposed.

Figure 34:
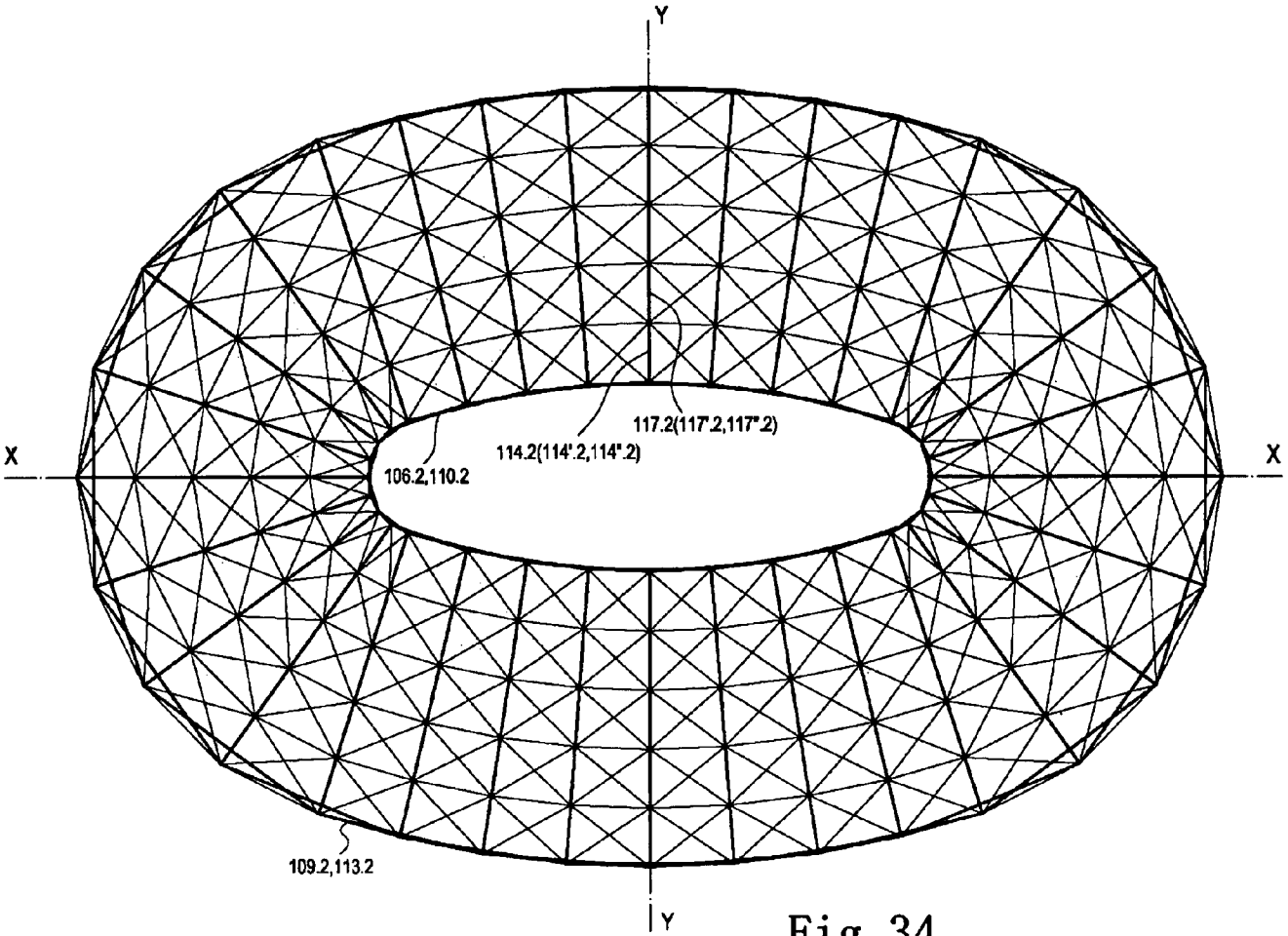
FIG. 34 is a top plan view of the roof system of FIG. 33.

FIG. 34 is a top plan view of the roof system of FIG. 33, the substantially oval annular curve having a major axis X-X and a minor axis Y-Y. The erection of the present roof system is similar to that discussed in connection with FIG. 24 but this embodiment eliminates the need for cables and struts within the upper inner compression ring 6.2 and the lower inner compression ring 10.2, wherein like reference numerals represent like elements, and number 100 is added only in FIG. 24 so that the reference numeral 1.2 shown in FIG. 24 is a reference numeral 101.2 shown in FIG. 33.

As shown in FIGS. 33 and 34, the roof system comprises the upper layer 101.2 and a lower layer 102.2 parallel to the upper layer 101.2. A plurality of diagonal struts 103.2 each having an upper end and a lower end define upper and lower points or nodes of the system. These diagonal struts include: a radially oriented first diagonal strut 114.2 (114'.2, 114".2), a radially oriented second diagonal strut 117.2 (117'.2, 117".2).

A plurality of diagonal cables 104.2 (FIG. 33) are provided for running between the upper node of one diagonal strut 103.2 and the lower node of an adjacent diagonal strut 103.2. As seen in FIG. 33, these diagonal cables include: an annular diagonal cable 125.2 and an annular diagonal cable 125'.2 constructed along a different hoop direction respectively.

As shown in FIGS. 33 and 34, the compression rings and cables on the upper layer 101.2 comprise: an inner compression ring 106.2, an outer compression ring 109.2, and a plurality of upper cables 131.2, 131'.2 being provided between the inner and the outer compression rings. The compression rings and cables on the lower layer 102.2 comprise: an inner compression ring 110.2, an outer compression ring 113.2, and a plurality of lower cables 136.2, 136'.2 being provided between the inner and the outer compression rings.

All above elements is arranged in the manner shown in FIG. 24.

Figure 35:
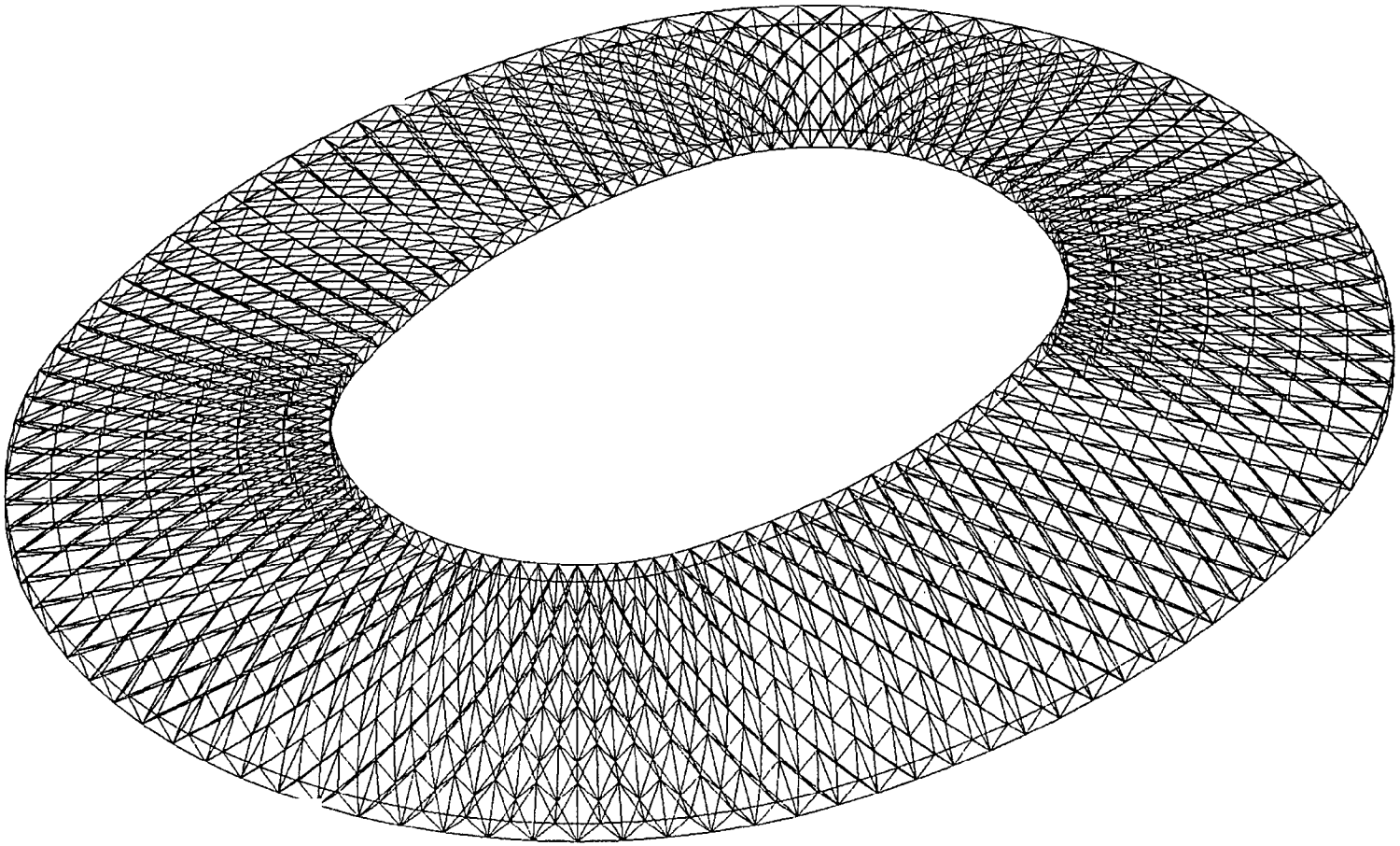
FIG. 35 is a perspective view of a double-layer cable-strut roof system projecting in plan another substantially oval annular curve in accordance with yet a further embodiment of the second system of the present invention.

FIG. 35 is a perspective view of a double-layer cable-strut roof system projecting in plan another substantially oval annular curve in accordance with yet a further embodiment of the second system of the present invention. The roof system is constructed in a similar manner shown in FIG. 33 with two inner and outer compression rings, but this embodiment is adaptable for spanning large areas with more cables and struts provided accordingly.

Figure 36:
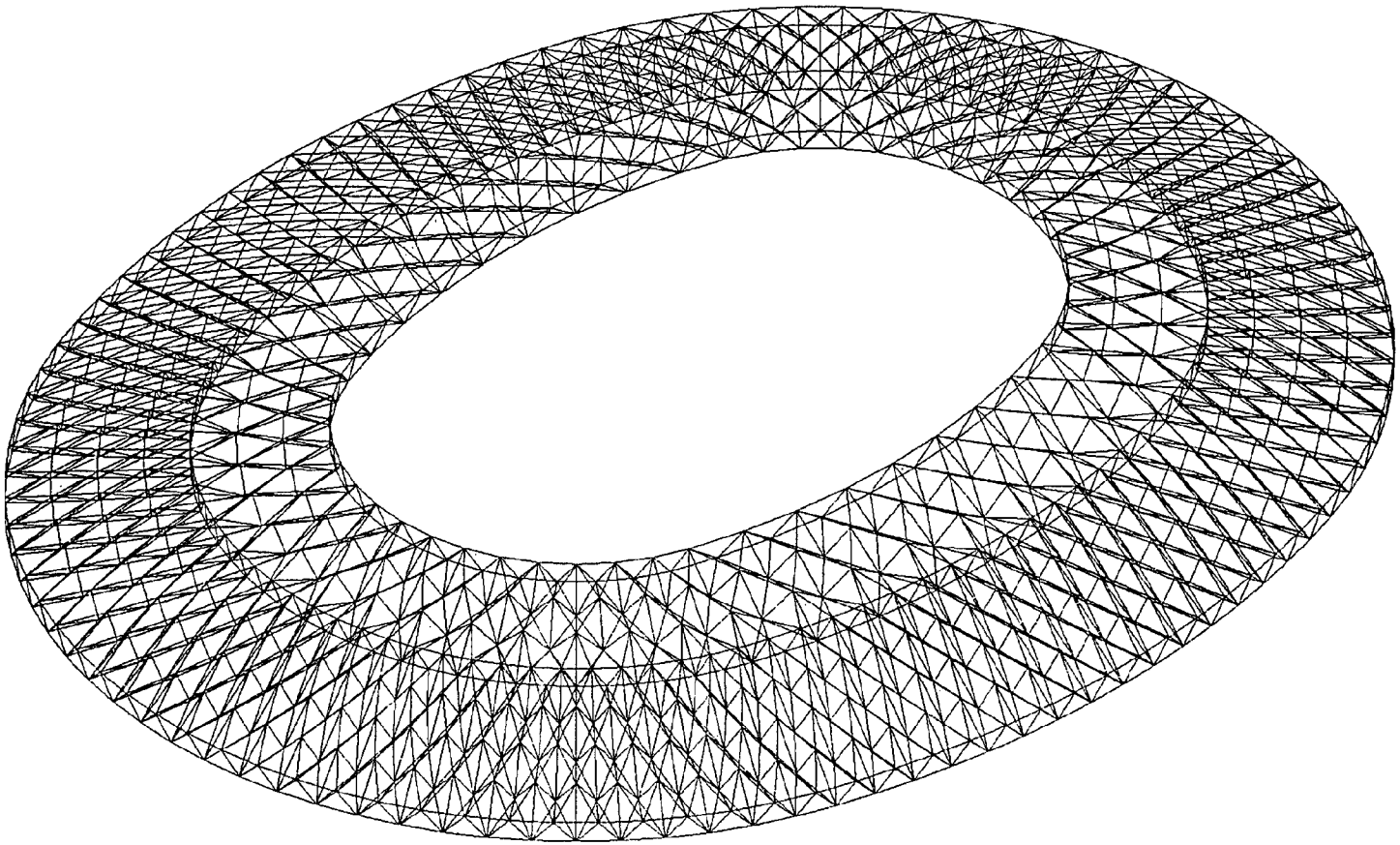
FIG. 36 is a perspective view of a double-layer cable-strut roof system projecting in plan yet another substantially oval annular curve in accordance with still a further embodiment of the second system of the present invention.

FIG. 36 is a perspective view of a double-layer cable-strut roof system projecting in plan yet another substantially oval annular curve in accordance with still a further embodiment of the second system of the present invention. The roof system includes three compression rings located on an upper layer and on a lower layer at different locations respectively, which is constructed in a similar manner shown in FIG. 33 but is adaptable for spanning large areas with more cables and struts provided, one more upper and lower intermediate compression rings being included accordingly in the system compared with the system shown in FIG. 33.

Figure 37:
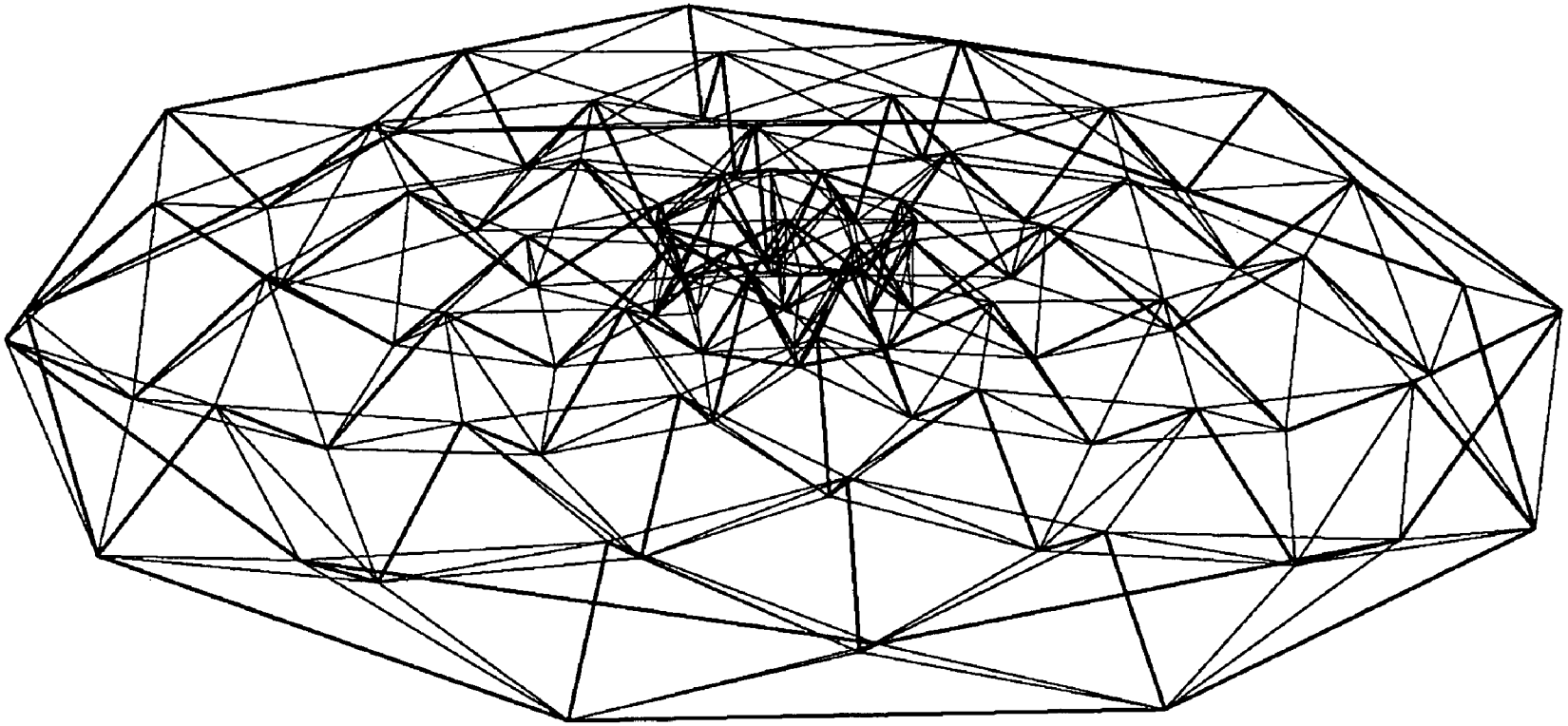
FIG. 37 is a perspective view of a double-layer cable-strut roof system projecting in plan a substantially circular curve in accordance with still a further embodiment of the second system of the present invention.
Figure 38:
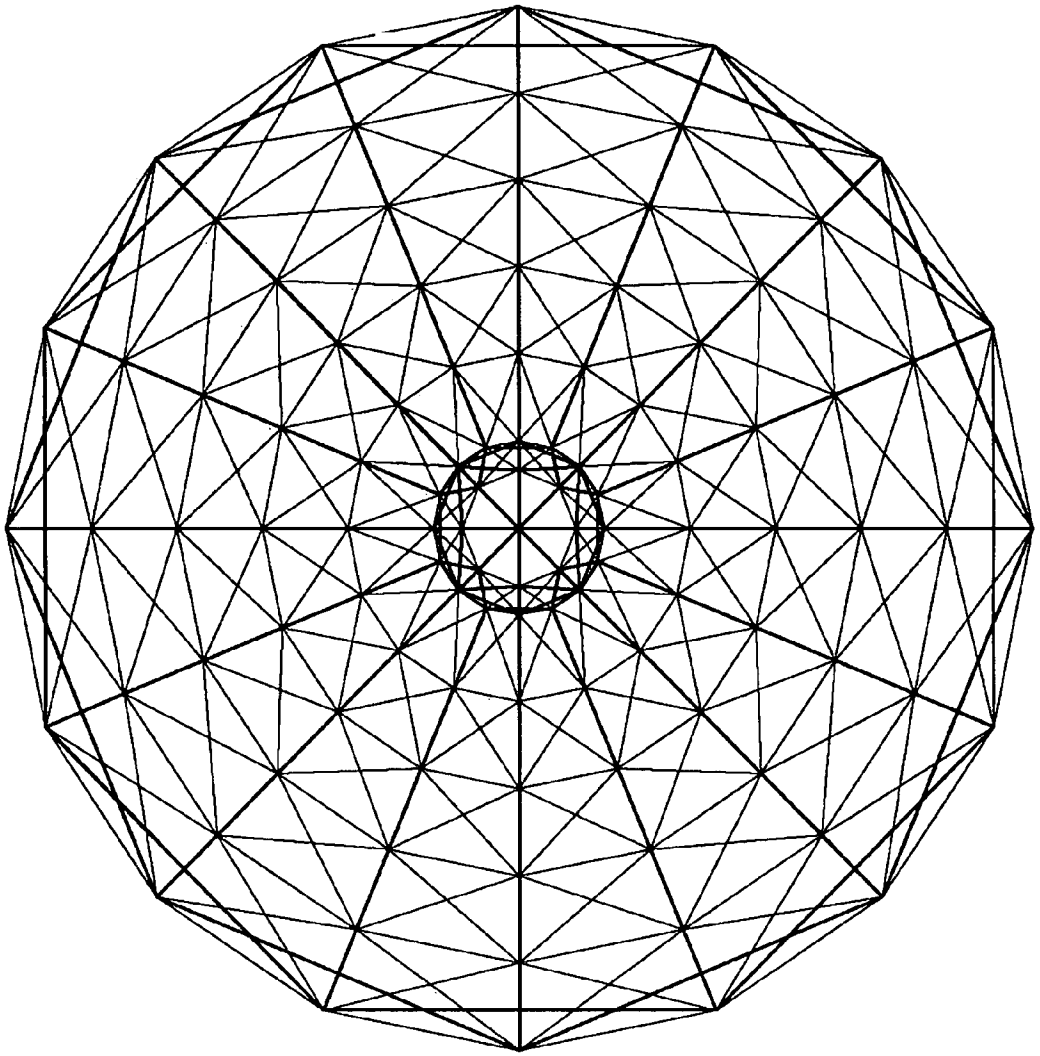
FIG. 38 is a top plan view of the roof system of FIG. 37.

FIG. 37 is a perspective view of a double-layer cable-strut roof system projecting in plan a substantially circular curve in accordance with still a further embodiment of the second system of the present invention. FIG. 38 is a top plan view of the roof system. The roof system is constructed in a similar manner shown in FIG. 24, but the major axis and the minor axis of this embodiment are equal in length and only one vertical compression cable is provided within the inner compression rings.

Figure 39:
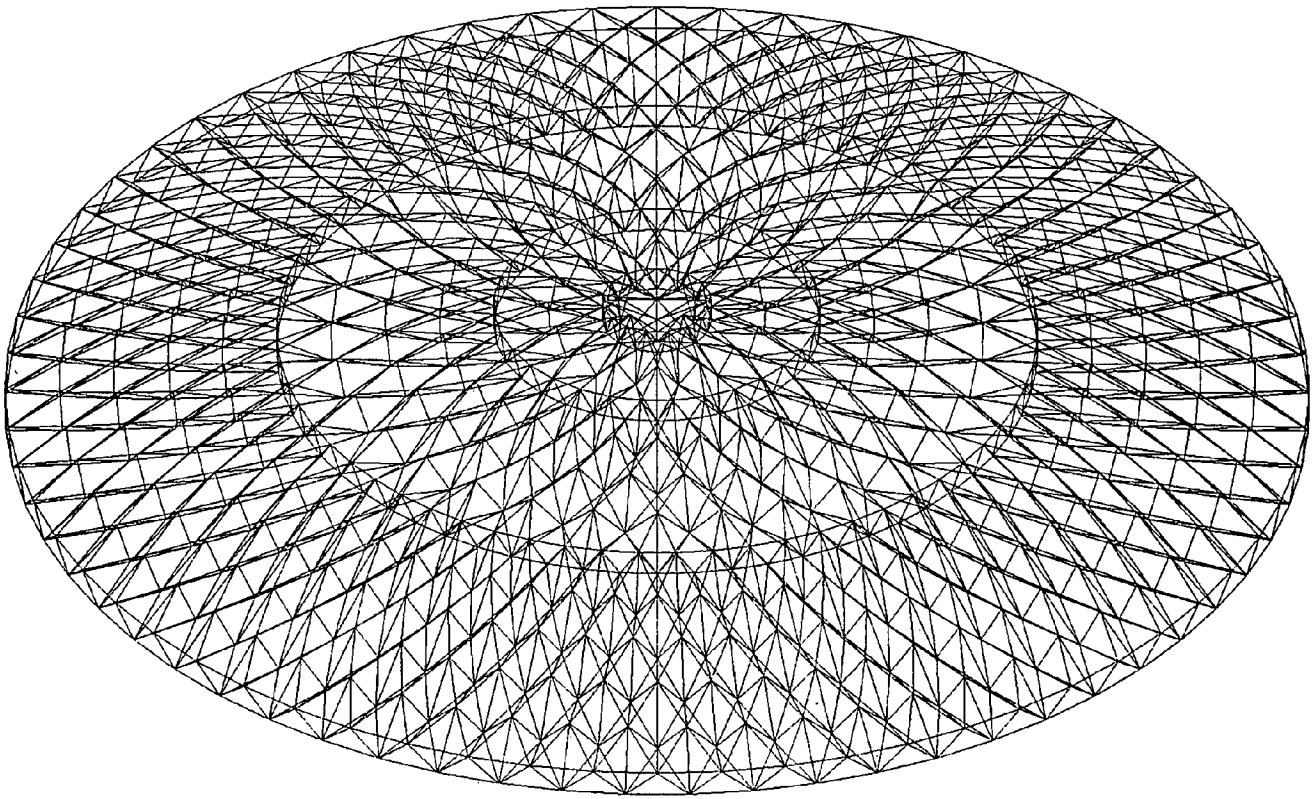
FIG. 39 is a perspective view of a double-layer cable-strut roof system projecting in plan another substantially circular curve in accordance with still a further embodiment of the second system of the present invention.

FIG. 39 is a perspective view of a double-layer cable-strut roof system projecting in plan another substantially circular curve in accordance with still a further embodiment of the second system of the present invention. The roof system includes four compression rings located on an upper layer and on a lower layer at different locations respectively, which is constructed in a similar manner shown in FIG. 37 but is adaptable for spanning large areas with more cables and struts provided, two more upper and lower inner compression rings being included accordingly in the system compared with the system shown in FIG. 37.

Figure 40:
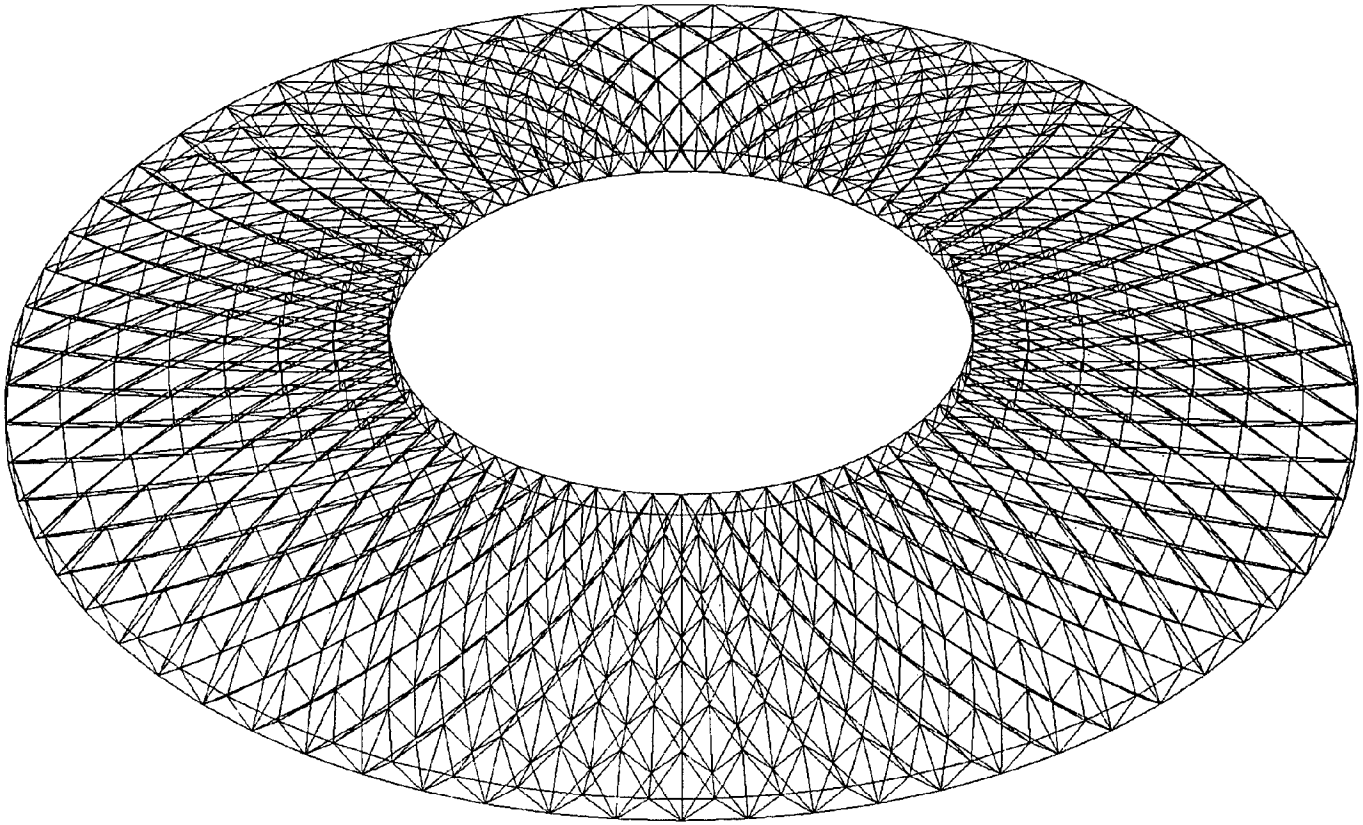
FIG. 40 is a perspective view of a double-layer cable-strut roof system projecting in plan a substantially circular annular curve in accordance with still a further embodiment of the second system of the present invention.

FIG. 40 is a perspective view of a double-layer cable-strut roof system projecting in plan a substantially circular annular curve in accordance with still a further embodiment of the second system of the present invention. The roof system is constructed in a similar manner shown in FIG. 35 but the major axis and the minor axis of this embodiment are equal in length.

Figure 41:
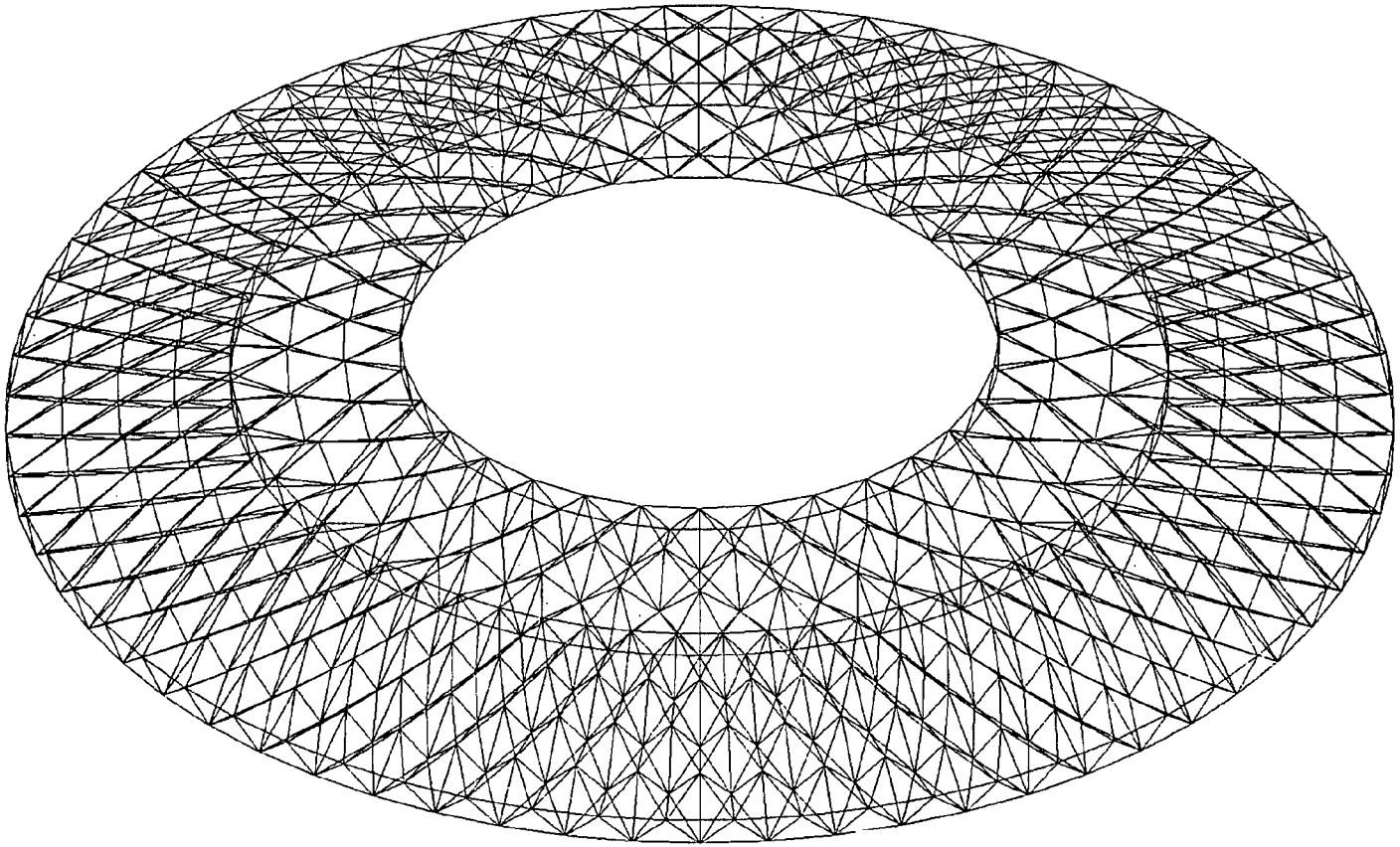
FIG. 41 is a perspective view of a double-layer cable-strut roof system projecting in plan another substantially circular annular curve in accordance with still a further embodiment of the second system of the present invention.

FIG. 41 is a perspective view of a double-layer cable-strut roof system projecting in plan another substantially circular annular curve in accordance with still a further embodiment of the second system of the present invention. The roof system includes three compression rings located on an upper layer and on a lower layer at different locations respectively, which is constructed in a similar manner shown in FIG. 40 but one more upper and lower inner compression rings being included in the system compared with the system shown in FIG. 40.

Figure 42:
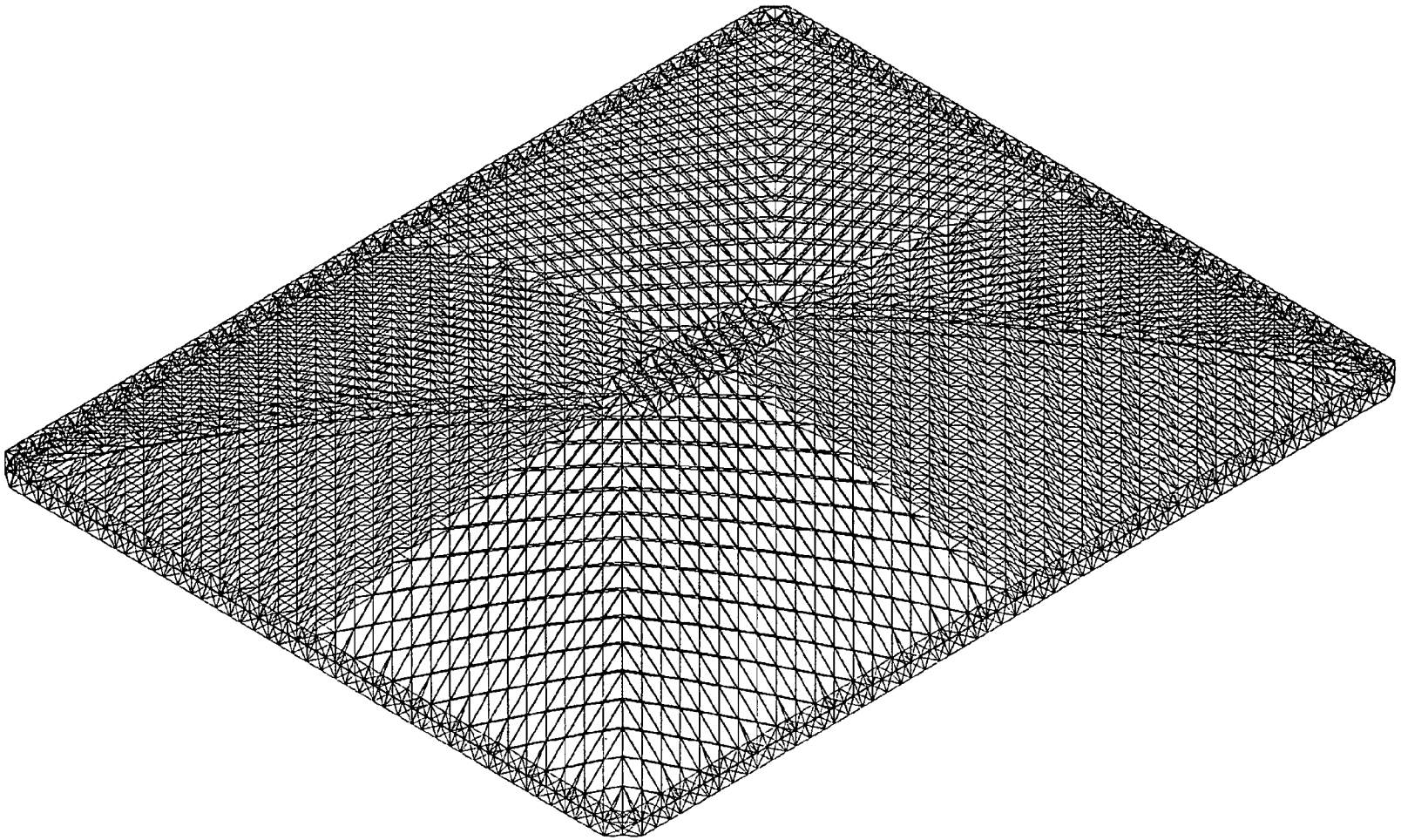
FIG. 42 is a perspective view of a double-layer cable-strut roof system projecting in plan a substantially rectangular curve in accordance with still a further embodiment of the second system of the present invention.

FIG. 42 is a perspective view of a double-layer cable-strut roof system projecting in plan a substantially rectangular curve in accordance with still a further embodiment of the second system of the present invention, which comprises an upper layer and a lower layer parallel to the upper layer. A plurality of diagonal struts each having an upper end and a lower end are provided for defining upper and lower points or nodes of the system. These diagonal struts include: a longitudinally oriented first diagonal strut extending outwardly from an upper node to a lower node, a longitudinally oriented second diagonal strut extending inwardly from an upper node to a lower node, the first diagonal strut being arranged alternately with the second diagonal strut; a transversely oriented first diagonal strut extending outwardly from an upper node to a lower node, a transversely oriented second diagonal strut extending inwardly from an upper node to a lower node, the first diagonal strut being arranged alternately with the second diagonal strut.

A plurality of diagonal cables are provided for running between the upper node of one diagonal strut and the lower node of an adjacent diagonal strut. The diagonal cables include: (1) a diagonal cable being positioned along one of the inner axes of the rectangular curve, running between two inner nodes of two transversely adjacent first and second diagonal struts and running between two outer nodes of two transversely adjacent first and second diagonal struts; (2) a peripheral diagonal cable being positioned along one of the outer sides of the rectangular curve, running between two outer nodes of two adjacent outermost first and second diagonal struts.

A plurality of struts and cables positioned along each of the inner axes of the rectangle, a plurality of compression rings, and a network of cables are provided on the upper layer and on the lower layer respectively. The network of cables interconnects each first diagonal strut to an adjacent second diagonal strut.

In the present embodiment, the plurality of struts and the correlative cables and the struts positioned along each of the inner axes of the rectangular curve constitute a continuous compression central structure, while those positioned along each of the outer sides of the rectangular curve constitute a continuous compression edge structure. The discontinuous sets of diagonal struts and continuous cables are arranged in a similar manner as discussed in previous embodiments of the second system of the present invention, but here each set of diagonal struts are located parallel to a long outer side or a short outer side of the rectangular curve.

Figure 43:
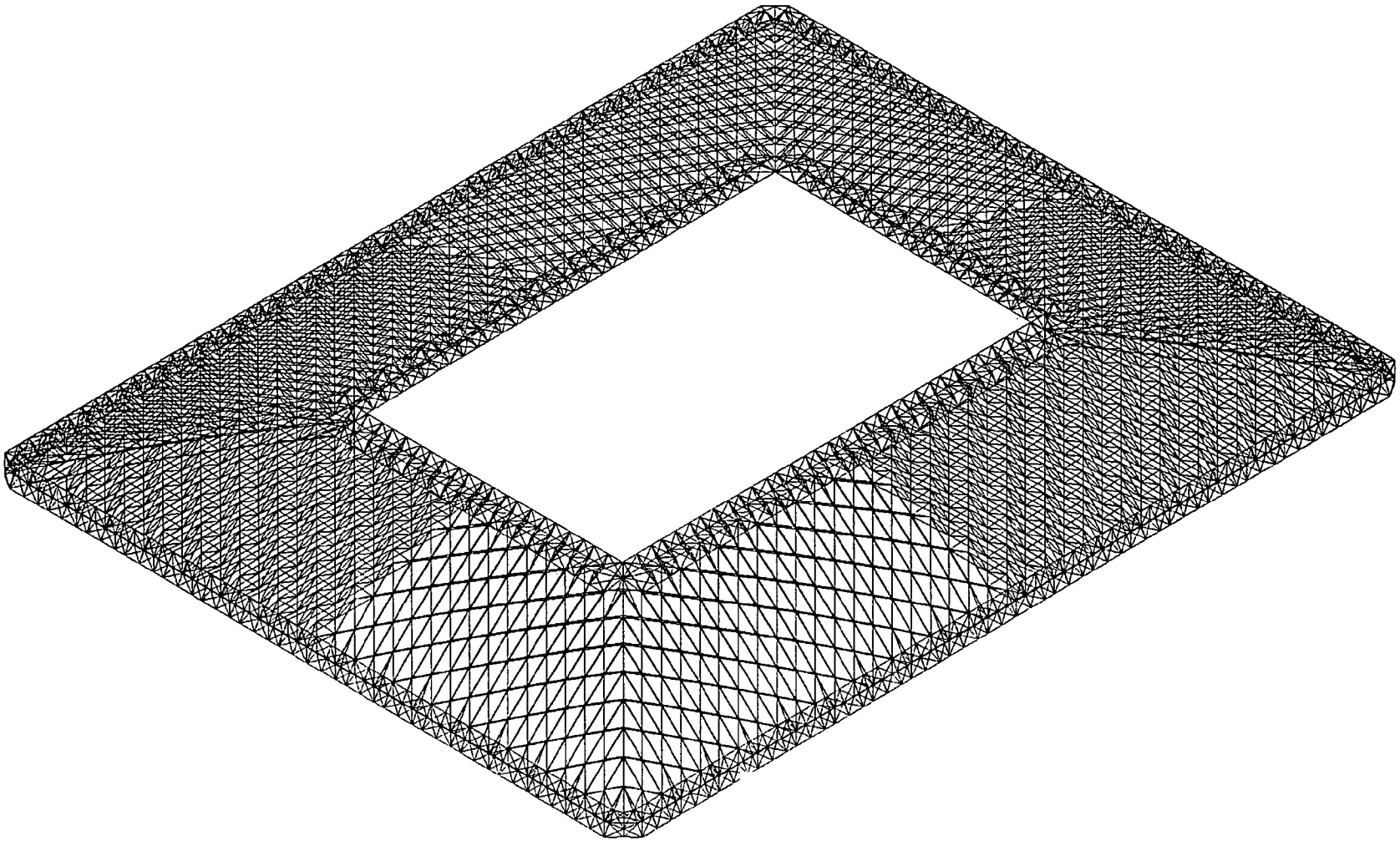
FIG. 43 is a perspective view of a double-layer cable-strut roof system projecting in plan a substantially rectangular annular curve in accordance with still a further embodiment of the second system of the present invention.

FIG. 43 is a perspective view of a double-layer cable-strut roof system projecting in plan a substantially rectangular annular curve in accordance with still a further embodiment of the second system of the present invention. Four lines each connecting one vertex of an inner rectangle and a corresponding one vertex of an outer rectangle constitute the inner axes of the roof system.

As shown in FIG. 43, the roof system comprises an upper layer and a lower layer parallel to the upper layer. A plurality of diagonal struts each having an upper end and a lower end are provided for defining upper and lower points or nodes of the system. These diagonal struts include: a longitudinally oriented first diagonal strut extending outwardly from an upper node to a lower node, a longitudinally oriented second diagonal strut extending inwardly from an upper node to a lower node, the first diagonal strut being arranged alternately with the second diagonal strut; a transversely oriented first diagonal strut extending outwardly from an upper node to a lower node, a transversely oriented second diagonal strut extending inwardly from an upper node to a lower node, the first diagonal strut being arranged alternately with the second diagonal strut.

A plurality of diagonal cables are provided for running between the upper node of one diagonal strut and the lower node of an adjacent diagonal strut. The diagonal cables include: (1) axial diagonal cables being positioned along each of the inner axes of the roof system, including: an axial diagonal cable running between the outer nodes of two adjacent first and second diagonal struts; an axial diagonal cable running between the inner nodes of two adjacent first and second diagonal struts; (2) inner peripheral diagonal cables being positioned along each of the sides of the inner rectangle, including: an inner peripheral diagonal cable running between the inner nodes of two adjacent innermost first and second diagonal struts; (3) outer peripheral diagonal cables being positioned along each of the sides of the outer rectangle, including: an outer peripheral diagonal cable running between the outer nodes of two adjacent outermost first and second diagonal struts.

A plurality of inner and outer compression rings and a network of cables are provided on the upper layer and on the lower layer respectively. The network of cables interconnects each first diagonal strut to a transversely adjacent second diagonal strut.

Figure 44:
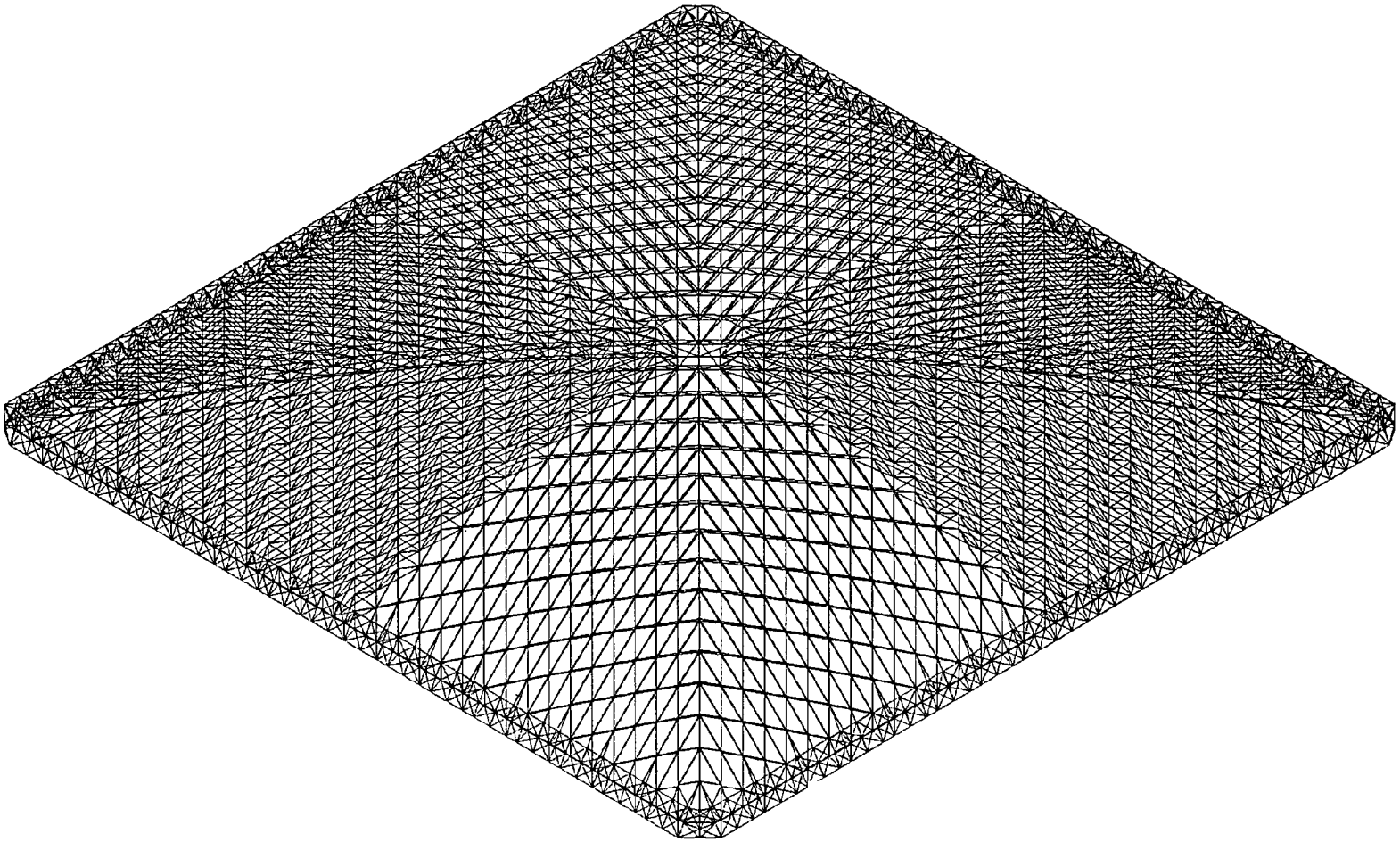
FIG. 44 is a perspective view of a double-layer cable-strut roof system projecting in plan a substantially square curve in accordance with still a further embodiment of the second system of the present invention.

FIG. 44 is a perspective view of a double-layer cable-strut roof system projecting in plan a substantially square curve in accordance with still a further embodiment of the second system of the present invention. The roof system is constructed in a similar manner shown in FIG. 42 but the long side and the short side of this square curve are equal in length.

Figure 45:
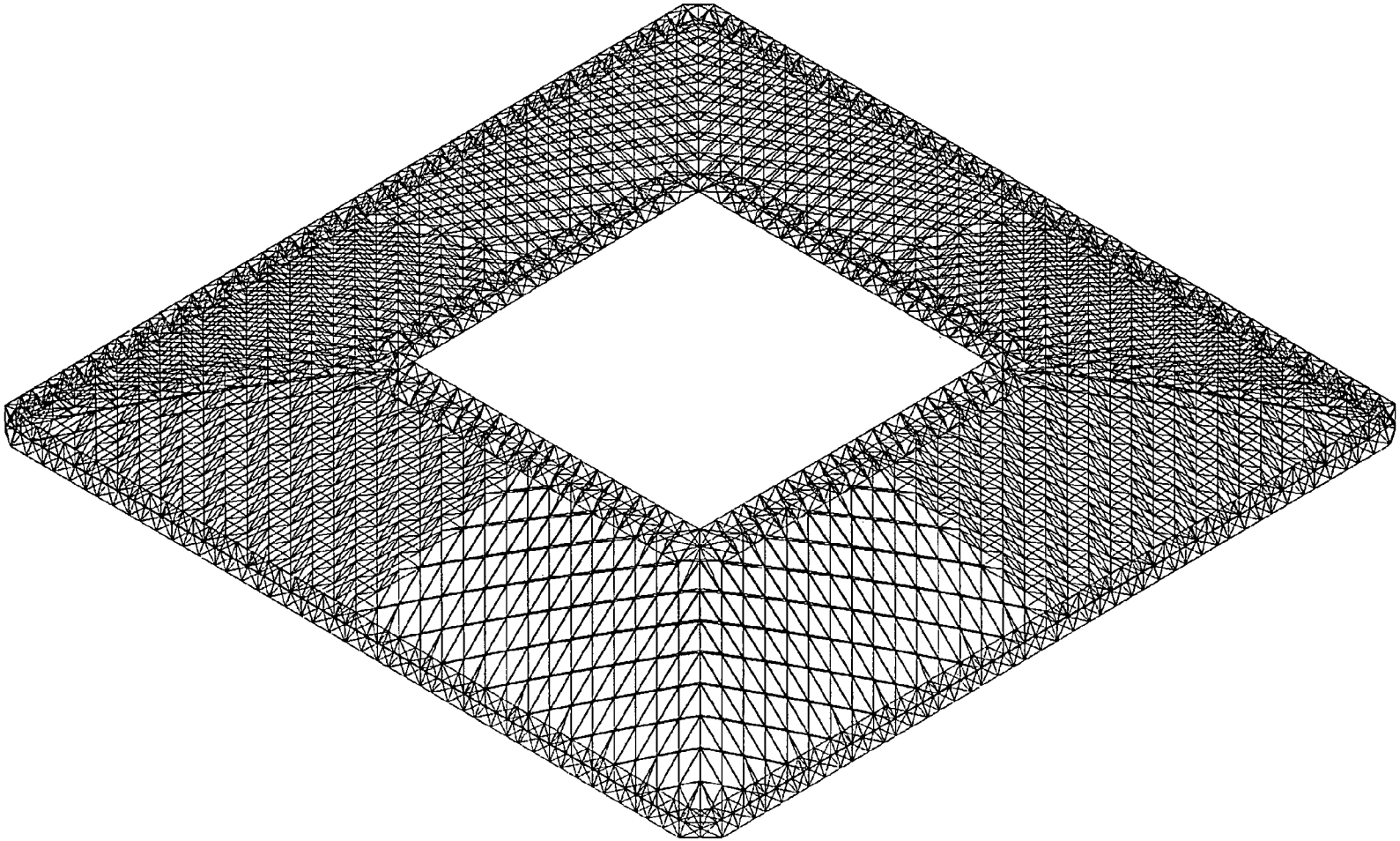
FIG. 45 is a perspective view of a double-layer cable-strut roof system projecting in plan a substantially square annular curve in accordance with still a further embodiment of the second system of the present invention.

FIG. 45 is a perspective view of a double-layer cable-strut roof system projecting in plan a substantially square annular curve in accordance with still a further embodiment of the second system of the present invention. The roof system is constructed in a similar manner shown in FIG. 43 but the long side and the short side of this square annular curve are equal in length.

Figure 46:
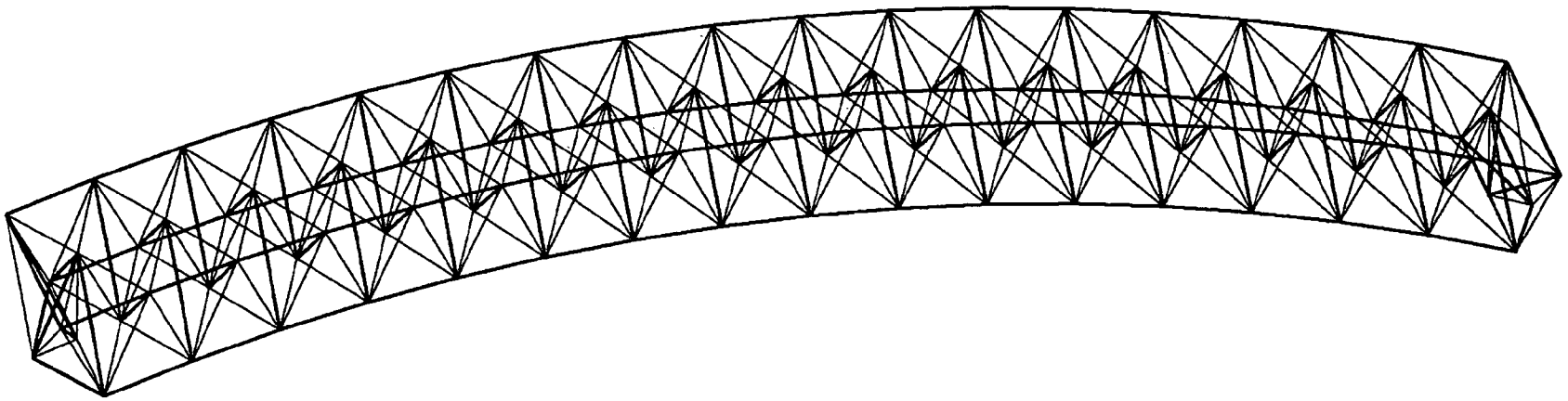
FIG. 46 is a perspective view of a double-layer cable-strut arch.

FIG. 46 is a perspective view of a double-layer cable-strut arch that projects in plan a substantially long rectangular curve. It will be appreciated that the structure is a specific utilization of the first or the second system when structural size in one direction is far beyond that in the other direction. The arch comprises an upper layer and a lower layer parallel to the upper layer. A plurality of diagonal struts each having an upper end and a lower end are provided for defining upper and lower points or nodes of the arch. The diagonal struts include: (1) a plurality of sets of first diagonal struts each of which comprising one first diagonal strut and a plurality of sets of second diagonal struts each of which comprising one second diagonal strut, wherein each first diagonal strut extends outwardly from an upper node to a lower node, each two first diagonal struts crossing at two upper nodes to form a common node located on a central long axis of an upper rectangle; and wherein each second diagonal strut is arranged alternately with the first diagonal strut and extends inwardly from an upper node to a lower node, each two second diagonal struts crossing at two lower nodes to form a common node located on a central long axis of a lower rectangle; (2) a central diagonal strut positioned along the long axis of the arch.

A plurality of diagonal cables are provided for running between the upper node of one diagonal strut and the lower node of an adjacent diagonal strut. The diagonal cables include: (1) a peripheral diagonal cable being positioned along one of the outer sides of the rectangle and running between two outer nodes of two adjacent diagonal struts of first and second or central diagonal struts; (2) a central diagonal cable being positioned along the long central line of the arch and running between two inner nodes of two adjacent diagonal struts of first and second or central diagonal struts.

An outer compression ring and a network of cables within the outer compression ring are provided on the upper layer and on the lower layer respectively. The network of cables includes: upper cables and lower cables interconnect two adjacent diagonal struts of first and second or central diagonal struts.

While the present invention has been described in conjunction with the preferred embodiments, it should be clearly understood that the embodiments of the invention described above are not intended as limitations on the scope of the invention. Those skilled in the art will recognize that numerous variations and modifications may be made without departing from the scope of the present invention.

For example, the thickness of a double-layer cable-strut roof system may be various; the upper and the lower layers may be plane surfaces or curve surfaces; the curve surface may be regular or irregular, convex or concave. In various configuration of the present invention, the roof system may project in plan any one of a substantially oval curve, a substantially circular curve, other non-circular curve, a substantially quadrangular curve or other polygonal curve. The roof structure may cover the underlying building space in its entirety or, alternatively, may cover a perimeter portion of the building space leaving the center area uncovered. The roof structure may be constituted by a plurality of structural units. The numerous variations could be made by changing length or gradient of a diagonal strut, by changing number or spacing of each set of diagonal struts, by changing direction along which each set of diagonal struts located or, by changing components arrangements of a central and an edge structures. In the preferred embodiments, components run radially or perpendicularly to the edge structure, but they may not run radially or perpendicularly to the edge structure in accordance with specific requirements of structural plan.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A double-layer cable-strut roof system, comprising:

a central structure;

an edge structure;

a plurality of sets of first diagonal struts, each of which comprising a plurality of first diagonal struts and being located along a first direction, extending from said central structure to said edge structure;

a plurality of sets of second diagonal struts, each of which comprising a plurality of second diagonal struts and being located along a second direction, extending from said central structure to said edge structure, wherein an inner end of each of said first diagonal struts is located on an upper layer and an outer end of each of said first diagonal struts is located on a lower layer, defining upper inner and lower outer nodes respectively;

wherein an inner end of each of said second diagonal struts is located on said lower layer and an outer end of said second diagonal strut is located on said upper layer, defining lower inner and upper outer nodes respectively;

wherein said first diagonal struts of each of said sets of first diagonal struts are spaced apart from each other, an innermost first diagonal strut of each of said sets being connected to said central structure and an outermost first diagonal strut of each of said sets being connected to said edge structure;

wherein said second diagonal struts of each of said sets of second diagonal struts are spaced apart from each other, an innermost second diagonal strut of each of said sets being connected to said central structure and an outermost second diagonal strut of each of said sets being connected to said edge structure;

wherein said first direction of each of said sets of first diagonal struts is spaced apart from said second direction of adjacent one of said sets of second diagonal struts between said central and said edge structures; and wherein each of said sets of first diagonal struts is arranged alternately with one of said sets of second diagonal struts; and a plurality of cables interconnecting said first diagonal struts and said second diagonal struts, and comprising:

a first diagonal cable extending from said upper inner node of one of said first diagonal struts of one of said sets of first diagonal struts to said lower outer node of an inner adjacent one of said first diagonal struts of said set;

a second diagonal cable extending from said lower inner node of one of said second diagonal struts of one of said sets of second diagonal struts to said upper outer node of an inner adjacent one of said second diagonal struts of said set;

a first upper cable extending from said upper inner node of one of said first diagonal struts of one of said sets of first diagonal struts to said upper outer node of a transversely adjacent one of said second diagonal struts of an adjacent one of said sets of second diagonal struts;

a second upper cable extending from said upper inner node of said first diagonal strut of said set of first diagonal struts to said upper outer node of one of said second diagonal struts located on outer adjacent side of said transversely adjacent second diagonal strut of said adjacent set of second diagonal struts;

a first lower cable extending from said lower inner node of one of said second diagonal struts of one of said sets of second diagonal struts to said lower outer node of a transversely adjacent one of said first diagonal struts of an adjacent one of said sets of first diagonal struts; and a second lower cable extending from said lower inner node of said second diagonal strut of said set of second diagonal struts to said lower outer node of one of said first diagonal struts located on outer adjacent side of said transversely adjacent first diagonal strut of said set of first diagonal struts.

2. The double-layer cable-strut roof system, as recited in claim 1, wherein said edge structure comprises an inner-suspended cable-strut structure, comprising:

an edge upper tension-compression ring;

an edge upper compression ring;

an edge lower tension-compression ring;

an edge lower compression ring;

a plurality of first pairs of edge diagonal struts, each of which crossing at two inner ends thereof to form a common upper inner node located on said upper layer and within said edge upper tension-compression ring, two outer ends of said first pair of edge diagonal struts defining two lower outer nodes connected to said edge lower tension-compression ring respectively, each of said first pairs of edge diagonal struts being arranged along said first direction of one of said sets of first diagonal struts;

a plurality of second pairs of edge diagonal struts, each of which crossing at two inner ends thereof to form a common lower inner node located on said lower layer and within said edge lower tension-compression ring, two outer ends of said second pair of edge diagonal struts defining two upper outer nodes connected to said edge upper tension-compression ring respectively, each of said second pairs of edge diagonal struts being located along said second direction of one of said sets of second diagonal struts and arranged alternately with one of said first pairs of edge diagonal struts;

a plurality of first edge diagonal struts each of which having an inner end defining an upper inner node connected to said edge upper tension-compression ring and an outer end defining a lower outer node connected to said edge lower compression ring respectively, one of said first edge diagonal struts being located along said first direction of one of said sets of first diagonal struts and another one of said first edge diagonal struts being located at said upper outer node of one edge diagonal strut of one of said second pairs of edge diagonal struts;

a plurality of second edge diagonal struts each of which having an inner end defining a lower inner node connected to said edge lower tension-compression ring and an outer end defining an upper outer node connected to said edge upper compression ring, one of said second edge diagonal struts being located along said second direction of one of said sets of second diagonal struts and another one of said second edge diagonal struts being located at said lower outer node of one edge diagonal strut of one of said first pairs of edge diagonal struts; and a plurality of edge cables comprising:

a first edge diagonal cable extending from said upper inner node of one of said first pairs of edge diagonal struts to said lower outer node of a corresponding one of said outermost first diagonal struts of said sets of first diagonal struts;

a second edge diagonal cable extending from said lower inner node of one of said second pairs of edge diagonal struts to said upper outer node of a corresponding one of said outermost second diagonal struts of said sets of second diagonal struts;

a first edge annular diagonal cable extending from said upper inner node of one of said first pairs of edge diagonal struts to said lower inner node of an adjacent one of said second pairs of edge diagonal struts;

a second edge annular diagonal cable extending from said upper inner node of one of said first edge diagonal struts to said lower inner node of a transversely adjacent one of said second edge diagonal struts;

a third edge annular diagonal cable extending from said lower outer node of said first edge diagonal strut to said upper outer node of said transversely adjacent second edge diagonal strut;

a first edge upper cable extending from said upper outer node of one edge diagonal strut of one of said second pairs of edge diagonal struts to said upper inner node of an adjacent one of said outermost first diagonal struts of said sets of first diagonal struts;

a second edge upper cable extending from said upper inner node of said first edge diagonal strut to said upper outer node of said transversely adjacent second edge diagonal strut;

a third edge upper cable extending from said upper outer node of said edge diagonal strut of said second pair of edge diagonal struts to said upper inner node of an adjacent one of said first pairs of edge diagonal struts;

a first edge lower cable extending from said lower outer node of one edge diagonal strut of one of said first pairs of edge diagonal struts to said lower inner node of an adjacent one of said outermost second diagonal struts of said sets of second diagonal struts;

a second edge lower cable extending from said lower outer node of said first edge diagonal strut to said lower inner node of said transversely adjacent second edge diagonal strut; and a third edge lower cable extending from said lower outer node of said edge diagonal strut of said first pair of edge diagonal struts to said lower inner node of an adjacent one of said second pairs of edge diagonal struts.

3. The double-layer cable-strut roof system, as recited in claim 2, wherein said central structure comprises an outer-suspended cable-strut structure, comprising:

a central upper tension-compression ring;

a central upper compression ring;

a central lower tension-compression ring;

a central lower compression ring;

a plurality of first pairs of central diagonal struts, each of which crossing at two outer ends thereof to form a common lower outer node located on said lower layer and outward of said central lower tension-compression ring, two inner ends of said first pair of central diagonal struts defining two upper inner nodes connected to said central upper tension-compression ring respectively, each of said first pairs of central diagonal struts being located along said first direction of one of said sets of first diagonal struts;

a plurality of second pairs of central diagonal struts, each of which crossing at two outer ends thereof to form a common upper outer node located on said upper layer and outward of said central upper tension-compression ring, two inner ends of said second pair of central diagonal struts defining two lower inner nodes connected to said central lower tension-compression ring respectively, each of said second pairs of central diagonal struts being arranged alternately with one of said first pairs of central diagonal struts and located along said second direction of one of said sets of second diagonal struts;

a plurality of first central diagonal struts each having an inner end defining an upper inner node connected to said central upper compression ring and an outer end defining a lower outer node connected to said central lower tension-compression ring, one of said first central diagonal struts being located along said first direction of one of said sets of first diagonal struts and another one of said first central diagonal struts being located at said lower inner node of one diagonal strut of one of said second pairs of central diagonal struts;

a plurality of second central diagonal struts each having an inner end defining a lower inner node connected to said central lower compression ring and an outer end defining an upper outer node connected to said central upper tension-compression ring, one of said second central diagonal struts being located along said second direction of one of said sets of second diagonal struts and another one of said second central diagonal struts being located at said upper inner node of one central diagonal strut of one of said first pairs of central diagonal struts; and a plurality of central cables comprising:

a first central diagonal cable extending from said lower outer node of one of said first pairs of central diagonal struts to said upper inner node of a corresponding one of said innermost first diagonal struts of said sets of first diagonal struts;

a second central diagonal cable extending from said upper outer node of one of said second pairs of central diagonal struts to said lower inner node of a corresponding one of said innermost second diagonal struts of said sets of second diagonal struts;

a first central annular diagonal cable extending from said upper inner node of one of said first central diagonal struts to said lower inner node of a transversely adjacent one of said second central diagonal struts;

a second central annular diagonal cable extending from said lower outer node of said first central diagonal strut to said upper outer node of said transversely adjacent second central diagonal strut;

a third central annular diagonal cable extending from said lower outer node of one of said first pairs of central diagonal struts to said upper outer node of an adjacent one of said second pairs of central diagonal struts;

a first central upper cable extending from said upper inner node of said first central diagonal strut to said upper outer node of said transversely adjacent second central diagonal strut;

a second central upper cable extending from said upper inner node of one central diagonal strut of one of said first pairs of central diagonal struts to said upper outer node of an adjacent one of said innermost second diagonal struts of said sets of second diagonal struts;

a third central upper cable extending from said upper inner node of said central diagonal strut of said first pair of central diagonal struts to said upper outer node of an adjacent one of said second pairs of central diagonal struts;

a first central lower cable extending from said lower outer node of said first central diagonal strut to said lower inner node of said transversely adjacent second central diagonal strut;

a second central lower cable extending from said lower inner node of one central diagonal strut of one of said second pairs of central diagonal struts to said lower outer node of an adjacent one of said innermost first diagonal struts of said sets of first diagonal struts; and a third central lower cable extending from said lower inner node of said central diagonal strut of said second pair of central diagonal struts to said lower outer node of an adjacent one of said first pairs of central diagonal struts.

4. The double-layer cable-strut roof system, as recited in claim 3, wherein both said central upper and said central lower tension-compression rings comprise a plurality of central struts and central cables joined together node-to-node, two nodes of each of said central struts and central cables of said central upper tension-compression ring being located at positions defined by intersections of said central upper tension-compression ring with alternating ones of said innermost first diagonal struts of said sets of first diagonal struts, said first pairs of central diagonal struts and said second central diagonal struts, two nodes of each of said central struts and central cables of said central lower tension-compression ring being located at positions defined by intersections of said central lower tension-compression ring with alternating ones of said innermost second diagonal struts of said sets of second diagonal struts, said second pairs of central diagonal struts and said first central diagonal struts; wherein both said central upper and said central lower compression rings comprise a plurality of central struts joined together node-to-node, two nodes of each of said central struts of said central upper compression ring being located at positions defined by intersections of said central upper compression ring with alternating ones of said first central diagonal struts, two nodes of each of said central struts of said central lower compression ring being located at positions defined by intersections of said central lower compression ring with alternating ones of said second central diagonal struts.

5. The double-layer cable-strut roof system, as recited in claim 3, wherein said central structure further comprises:

an inner-suspended cable-strut structure sharing said central upper compression ring and said central lower compression ring with said outer-suspended cable-strut structure, comprising:

a plurality of first inner diagonal struts each having an outer end defining a lower outer node connected to said central lower compression ring and an inner end defining an upper inner node, each two of said first inner diagonal struts crossing at two inner nodes thereof to form a common upper inner node located on said upper layer, one of said first inner diagonal struts being located along said first direction of one of said sets of first diagonal struts;

a plurality of second inner diagonal struts each having an outer end defining an upper outer node connected to said central upper compression ring and an inner end defining a lower inner node, each two of said second inner diagonal struts crossing at two inner nodes thereof to form a common lower inner node located on said lower layer, one of said second inner diagonal struts being located along said second direction of one of said sets of second diagonal struts; and a plurality of cable units being provided and comprising:

a central diagonal cable and a vertical cable extending from said upper inner node of one of said first inner diagonal struts to said lower inner node of a transversely adjacent one of said second inner diagonal struts;

a central upper cable extending from said upper inner node of said first inner diagonal strut to an adjacent upper inner node of another one of said first inner diagonal struts;

an upper cable extending from said upper inner node of said first inner diagonal strut to said upper outer node of said transversely adjacent second inner diagonal strut;

a central lower cable extending from said lower inner node of said second inner diagonal strut to an adjacent lower inner node of another one of said second inner diagonal struts; and a lower cable extending from said lower outer node of said first inner diagonal strut to said lower inner node of said transversely adjacent second inner diagonal strut.

6. The double-layer cable-strut roof system, as recited in claim 3, further comprising: at least one intermediate structure between said central structure and said edge structure which intersects said sets of first and second diagonal struts and is joined together with said sets of first and second diagonal struts directly and by a plurality of cables, wherein said intermediate structure comprises an inner-suspended cable-strut structure and an outer-suspended cable-strut structure arranged with a common upper compression ring and a common upper tension-compression ring, and a common lower compression ring and a common lower tension-compression ring.

7. The double-layer cable-strut roof system, as recited in claim 2, wherein both said edge upper and said edge lower tension-compression rings comprise a plurality of edge struts and edge cables joined together node-to-node, two nodes of each of said edge struts and two nodes of each of said edge cables of said edge upper tension-compression ring being located at positions defined by intersections of said edge upper tension-compression ring with alternating ones of said outermost second diagonal struts of said sets of second diagonal struts, said second pairs of edge diagonal struts and said first edge diagonal struts, two nodes of each of said edge struts and two nodes of each of said edge cables of said edge lower tension-compression ring being located at positions defined by intersections of said edge lower tension-compression ring with alternating ones of said outermost first diagonal struts of said sets of first diagonal struts, said first pairs of edge diagonal struts and said second edge diagonal struts; wherein both said edge upper and said edge lower compression rings comprise a plurality of edge struts joined together node-to-node, two nodes of each of said edge struts of said edge upper compression ring being located at positions defined by intersections of said edge upper compression ring with alternating ones of said second edge diagonal struts, two nodes of each of said edge struts of said edge lower compression ring being located at positions defined by intersections of said edge lower compression ring with alternating ones of said first edge diagonal struts.

8. The double-layer cable-strut roof system, as recited in claim 1, wherein said edge structure comprises an inner-suspended cable-strut structure, comprising:

an edge upper compression ring;

an edge lower compression ring;

a plurality of first pairs of edge diagonal struts, each of which crossing at two inner ends thereof to form a common upper inner node located on said upper layer and within said edge compression ring, two outer ends of said first pair of edge diagonal struts defining two lower outer nodes connected to said edge lower compression ring respectively, each of said first pairs of edge diagonal struts being located along said first direction of one of said sets of first diagonal struts;

a plurality of second pairs of edge diagonal struts, each of which crossing at two inner ends thereof to form a common lower inner node located on said lower layer and within said edge lower compression ring, two outer ends of said second pair of edge diagonal struts defining two upper outer nodes connected to said edge upper compression ring respectively, each of said second pairs of edge diagonal struts being arranged alternately with one of said first pairs of diagonal struts and located along said second direction of one of said sets of second diagonal struts; and a plurality of edge cables comprising:

a first edge diagonal cable extending from said upper inner node of one of said first pairs of edge diagonal struts to said lower outer node of a corresponding one of said outermost first diagonal struts of said sets of first diagonal struts;

a second edge diagonal cable extending from said lower inner node of one of said second pairs of edge diagonal struts to said upper outer node of a corresponding one of said outermost second diagonal struts of said sets of second diagonal struts;

a first edge annular diagonal cable extending from said upper inner node of one of said first pairs of edge diagonal struts to said lower inner node of an adjacent one of said second pairs of edge diagonal struts;

a second edge annular diagonal and vertical cables extending from said lower outer node of one diagonal strut of one of said first pairs of edge diagonal struts to said upper outer node of an adjacent edge diagonal strut of an adjacent one of said second pairs of edge diagonal struts;

a first edge upper cable extending from said upper outer node of one edge diagonal strut of one of said second pairs of edge diagonal struts to said upper inner node of an adjacent one of said outermost first diagonal struts of said sets of first diagonal struts;

a second edge upper cable extending from said upper outer node of said edge diagonal strut of said second pair of edge diagonal struts to said upper inner node of an adjacent one of said first pairs of edge diagonal struts;

a first edge lower cable extending from said lower outer node of one edge diagonal strut of one of said first pairs of edge diagonal struts to said lower inner node of an adjacent one of said outermost second diagonal struts of said sets of second diagonal struts; and a second edge lower cable extending from said lower outer node of said edge diagonal strut of said first pair of edge diagonal struts to said lower inner node of an adjacent one of said second pairs of edge diagonal struts.

9. The double-layer cable-strut roof system, as recited in claim 8, wherein said central structure comprises an outer-suspended cable-strut structure, comprising:

a central upper compression ring;

a central lower compression ring;

a plurality of first pairs of central diagonal struts, each of which crossing at two outer ends thereof to form a common lower outer node located on said lower layer and outward of said central lower compression ring, two inner ends of said first pair of central diagonal struts defining two upper inner nodes connected to said central upper compression ring respectively, each of said first pairs of central diagonal struts being located along said first direction of one of said sets of first diagonal struts;

a plurality of second pairs of central diagonal struts, each of which crossing at two outer ends thereof to form a common upper outer node located on said upper layer and outward of said central upper compression ring, two inner ends of said second pair of central diagonal struts defining two lower inner nodes connected to said central lower compression ring respectively, each of said second pairs of central diagonal struts being arranged alternately with one of said first pairs of central diagonal struts and located along said second direction of one of said sets of second diagonal struts; and a plurality of central cables comprising:

a first central diagonal cable extending from said lower outer node of one of said first pairs of central diagonal struts to said upper inner node of a corresponding one of said innermost first diagonal struts of said sets of first diagonal struts;

a second central diagonal cable extending from said upper outer node of one of said second pairs of central diagonal struts to said lower inner node of a corresponding one of said innermost second diagonal struts of said sets of second diagonal struts;

a first central annular diagonal cable extending from said lower outer node of one of said first pairs of central diagonal struts to said upper outer node of an adjacent one of said second pairs of central diagonal struts;

a second central annular diagonal cable and a vertical cable extending from said upper inner node of one central diagonal strut of one of said first pairs of central diagonal struts to said lower inner node of an adjacent central diagonal strut of an adjacent one of said second pairs of central diagonal struts;

a first central upper cable extending from said upper inner node of said central diagonal strut of said first pair of central diagonal struts to said upper outer node of an adjacent one of said innermost second diagonal struts of said sets of second diagonal struts;

a second central upper cable extending from said upper inner node of said diagonal strut of said first pair of central diagonal struts to said upper outer node of an adjacent one of said second pairs of central diagonal struts;

a first central lower cable extending from said lower inner node of one central diagonal strut of one of said second pairs of central diagonal struts to said lower outer node of an adjacent one of said innermost first diagonal struts of said sets of first diagonal struts; and a second central lower cable extending from said lower inner node of said central diagonal strut of said second pair of central diagonal struts to said lower outer node of an adjacent one of said first pairs of central diagonal struts.

10. The double-layer cable-strut roof system, as recited in claim 9, wherein said central upper and said central lower compression rings comprise a plurality of central struts joined together node-to-node, two nodes of each of said central struts of said central upper compression ring being located at positions defined by intersections of said central upper compression ring with alternating ones of said innermost first diagonal struts of said sets of first diagonal struts and said first pairs of central diagonal struts, two nodes of each of said central struts of said central lower compression ring being located at positions defined by intersections of said central lower compression ring with alternating ones of said innermost second diagonal struts of said sets of second diagonal struts and said second pairs of central diagonal struts.

11. The double-layer cable-strut roof system, as recited in claim 8, wherein both said edge upper and said edge lower compression rings comprise a plurality of edge struts joined together node-to-node, two nodes of each of said edge struts of said edge upper compression ring being located at positions defined by intersections of said edge upper compression ring with alternating ones of said outermost second diagonal struts of said sets of second diagonal struts and said second pairs of edge diagonal struts, two nodes of each of said edge struts of said edge lower compression ring being located at positions defined by intersections of said edge lower compression ring with alternating ones of said outermost first diagonal struts of said sets of first diagonal struts and said first pairs of edge diagonal struts.

12. The double-layer cable-strut roof system, as recited in claim 1, wherein said system projects in plan any one of a substantially oval curve, a substantially oval annular curve, a substantially circular curve, a substantially circular annular curve, a non-circular curve and a non-circular annular curve, each of said first diagonal struts of said sets of first diagonal struts and each of said second diagonal struts of said sets of second diagonal struts being oriented radially along any one of said substantially oval curve, said substantially oval annular curve, said substantially circular curve, said substantially circular annular curve, said non-circular curve and said non-circular annular curve.

13. The double-layer cable-strut roof system, as recited in claim 1, wherein said system projects in plan any one of a substantially rectangular curve and a substantially rectangular annular curve, each of said first diagonal struts of said sets of first diagonal struts and each of said second diagonal struts of said sets of second diagonal struts being arranged substantially perpendicular to two adjacent outer sides of said substantially rectangular curve and said substantially rectangular annular curve.

14. The double-layer cable-strut roof system, as recited in claim 13, wherein said central structure comprises an axial structure defined and arranged along an axial direction of any one of said substantially rectangular curve and said substantially rectangular annular curve, and wherein said edge structure comprises a closed cable-strut structure defined and arranged around said outer sides of any one of said substantially rectangular curve and said substantially rectangular annular curve.

15. A double-layer cable-strut roof system comprising:

a central structure;

an edge structure;

a plurality of sets of diagonal struts, each of which being located along a predefined direction and comprising a plurality of first diagonal struts and a plurality of second diagonal struts, extending from said central structure to said edge structure, wherein each of said first diagonal struts has an inner end located on an upper layer and an outer end located on a lower layer, defining upper inner and lower outer nodes respectively;

wherein each of said second diagonal struts has an inner end located on said lower layer and an outer end located on said upper layer, defining lower inner and upper outer nodes respectively;

wherein said first and said second diagonal struts of each of said sets are arranged alternately and joined together node-to-node, forming a zig-zag shape, an innermost first diagonal strut of one of said sets being connected to said central structure, an innermost second diagonal strut of another one of said sets being connected to said central structure, an outermost first diagonal strut of one of said sets being connected to said edge structure and an outermost second diagonal strut of another one of said sets being connected to said edge structure;

wherein each of said sets is spaced apart from each other and said sets are independent of one another between said central and said edge structures;

wherein each of said first diagonal struts of said sets is transversely adjacent to said second diagonal strut of an adjacent one of said sets and vice versa; and a plurality of cables interconnecting said first diagonal struts and said second diagonal struts, and comprising:

a first diagonal cable extending from said upper inner node of one of said first diagonal struts of one of said sets of diagonal struts to said lower inner node of a transversely adjacent one of said second diagonal struts of an adjacent one of said sets of diagonal struts;

a second diagonal cable extending from said lower outer node of said first diagonal strut of said set of diagonal struts to said upper outer node of said transversely adjacent second diagonal strut of said adjacent set of diagonal struts;

a first upper cable extending from said upper inner node of said first diagonal strut of said set of diagonal struts to said upper outer node of said transversely adjacent second diagonal strut of said adjacent set of diagonal struts;

a second upper cable extending from said upper inner node of said first diagonal strut of said set of diagonal struts to said upper inner node of another one of said first diagonal struts whose outer node is connected to said inner node of said transversely adjacent second diagonal strut of said adjacent set of diagonal struts;

a first lower cable extending from said lower outer node of said first diagonal strut of said set of diagonal struts to said lower inner node of said transversely adjacent second diagonal strut of said adjacent set of diagonal struts; and a second lower cable extending from said lower outer node of said first diagonal strut of said set of diagonal struts to said lower outer node of another one of said first diagonal struts whose inner node is connected to said outer node of said transversely adjacent second diagonal strut of said adjacent set of diagonal struts.

16. The double-layer cable-strut roof system, as recited in claim 15, wherein said edge structure comprises an edge annular cable-strut structure comprising an edge upper compression ring and an edge lower compression ring.

17. The double-layer cable-strut roof system, as recited in claim 16, wherein said central structure comprises a central annular cable-strut structure comprising a central upper compression ring and a central lower compression ring.

18. The double-layer cable-strut roof system, as recited in claim 17, wherein both said central upper and said central lower compression rings comprise a plurality of central struts joined together node-to-node, two nodes of each of said central struts of said central upper compression ring being located at positions defined by intersections of said central upper compression ring with alternating ones of said innermost first diagonal struts of said sets of diagonal struts, two nodes of each of said central struts of said central lower compression ring being located at positions defined by intersections of said central lower compression ring with alternating ones of said innermost second diagonal struts of said sets of diagonal struts.

19. The double-layer cable-strut roof system, as recited in claim 17, wherein said central structure further comprises:

an inner-suspended cable-strut structure sharing said central upper compression ring and said central lower compression ring with said annular cable-strut structure, comprising:

a plurality of sets of first inner diagonal struts, each of which comprising a pair of first inner diagonal struts , each of said pairs crossing at two inner nodes , two outer nodes of said pair being connected to said central lower compression ring at said inner node of a corresponding one of said innermost second diagonal struts of said sets of diagonal struts;

a plurality of sets of second inner diagonal struts, each of which comprising a pair of second inner diagonal struts, each of said pairs crossing at two inner nodes, two outer nodes of said pair being connected to said central upper compression ring at said inner node of a corresponding one of said innermost first diagonal struts of said sets of diagonal struts;

each of said sets of first inner diagonal struts being arranged alternately with one of said second inner diagonal struts; and a plurality of cable units comprising:

a central diagonal cable and a vertical cable extending from said upper inner node of one of said first inner diagonal struts to said lower inner node of an adjacent one of said second inner diagonal struts;

a central upper strut extending from said upper inner node of one of said first inner diagonal struts to an adjacent upper inner node of another one of said first inner diagonal struts;

an upper cable extending from said upper inner node of one of said first inner diagonal struts to said upper outer node of an adjacent one of said second inner diagonal struts;

a central lower strut extending from said lower inner node of one of said second inner diagonal struts to an adjacent lower inner node of another one of said second inner diagonal struts; and a lower cable extending from said lower inner node of one of said second inner diagonal struts to said lower outer node of an adjacent one of said first inner diagonal struts.

20. The double-layer cable-strut roof system, as recited in claim 16, wherein both said edge upper and said edge lower compression rings comprise a plurality of edge struts joined together node-to-node, two nodes of each of said edge struts of said edge upper compression ring being located at positions defined by intersections of said edge upper compression ring with alternating ones of said outermost second diagonal struts of said sets of diagonal struts, two nodes of each of said edge struts of said edge lower compression ring being located at positions defined by intersections of said edge lower compression ring with alternating ones of said outermost first diagonal struts of said sets of diagonal struts.

21. The double-layer cable-strut roof system, as recited in claim 15, further comprising: at least one intermediate structure between said central and said edge structures which intersects said sets of diagonal struts and is joined together with said sets of diagonal struts directly and by a plurality of cables, wherein said intermediate structure comprises a plurality of upper and lower compression rings each comprising a plurality of struts joined together node-to-node, two nodes of each of said struts of said upper and said lower compression rings being located at positions defined by intersections of alternating ones of said upper and said lower compression rings with alternating ones of said first and said second diagonal struts of said sets of diagonal struts.

22. The double-layer cable-strut roof system, as recited in claim 15, wherein said system projects in plan any one of a substantially oval curve, a substantially oval annular curve, a substantially circular curve, a substantially circular annular curve, a non-circular curve and a non-circular annular curve, each of said first and said second diagonal struts of said sets of diagonal struts being oriented radially along any one of said substantially oval curve, said substantially oval annular curve, said substantially circular curve, said substantially circular annular curve, said non-circular curve and said non-circular annular curve.

23. The double-layer cable-strut roof system, as recited in claim 15, wherein said system projects in plan any one of a substantially rectangular curve and a substantially rectangular annular curve, each of said first and said second diagonal struts of said sets of diagonal struts being arranged substantially perpendicular to two adjacent outer sides of said substantially rectangular curve and said substantially rectangular annular curve.

24. The double-layer cable-strut roof system, as recited in claim 23, wherein said central structure comprises an axial structure defined and arranged along an axial direction of any one of said substantially rectangular curve and said substantially rectangular annular curve, and wherein said edge structure comprises a closed cable-strut structure defined and arranged around said outer sides of any one of said substantially rectangular curve and said substantially rectangular annular curve.

25. A double-layer cable-strut roof system that projects in plan a substantially long rectangular curve comprising:

a plurality of sets of first diagonal struts each of which comprising a first diagonal strut and a plurality of sets of second diagonal struts each of which comprising one second diagonal strut, each of said sets being substantially perpendicular to a long outer side of said rectangular curve and being spaced apart from each other on a centerline of said rectangular curve, wherein each of said first diagonal struts has an inner end located on an upper layer and an outer end located on a lower layer, defining upper inner and lower outer nodes respectively;

wherein each of said second diagonal struts has an inner end located on said lower layer and an outer end located on said upper layer, defining lower inner and upper outer nodes respectively;

wherein each of said sets of first diagonal struts is arranged alternately with one of said sets of second diagonal struts along a long side of said rectangular curve;

wherein each two of said first diagonal struts cross at a long centerline of an upper substantially rectangular curve;

wherein each two of said second diagonal struts cross at a long centerline of a lower substantially rectangular curve;

an upper closed compression curve formed by connecting adjacent upper outer nodes of said second diagonal struts in sequence, comprising a plurality of struts;

a lower closed compression curve formed by connecting adjacent lower outer nodes of said first diagonal struts in sequence, comprising a plurality of struts; and a plurality of cables comprising:

a central diagonal cable extending from said upper inner node of one of said first diagonal struts to said lower inner node of an adjacent one of said second diagonal struts;

a peripheral diagonal cable extending from said lower outer node of said first diagonal strut to said upper outer node of said adjacent second diagonal strut;

an upper cable extending from said upper inner node of said first diagonal strut to said upper outer node of said adjacent second diagonal strut; and a lower cable extending from said lower outer node of said first diagonal strut to said lower inner node of said adjacent second diagonal strut.

* * * * *